US011595768B2

(12) United States Patent
Gustafsson et al.

(10) Patent No.: US 11,595,768 B2
(45) Date of Patent: Feb. 28, 2023

(54) RETENTION FORCE INCREASING COMPONENTS

(71) Applicant: Cochlear Limited, Macquarie University (AU)

(72) Inventors: Johan Gustafsson, Mölnlycke (SE); Oliver Ridler, Cherrybrook (AU)

(73) Assignee: Cochlear Limited, Macquarie University (AU)

( * ) Notice: Subject to any disclaimer, the term of this patent is extended or adjusted under 35 U.S.C. 154(b) by 1161 days.

(21) Appl. No.: 15/368,382

(22) Filed: Dec. 2, 2016

(65) Prior Publication Data

US 2018/0160241 A1 Jun. 7, 2018

(51) Int. Cl.
*H04R 25/00* (2006.01)
*H01F 7/02* (2006.01)

(52) U.S. Cl.
CPC ..... *H04R 25/606* (2013.01); *H01F 7/0252* (2013.01); *H04R 25/554* (2013.01); *H04R 2225/021* (2013.01); *H04R 2460/13* (2013.01)

(58) Field of Classification Search
CPC .... H04R 25/60; H04R 25/604; H04R 25/606; H04R 25/607; H04R 25/609
See application file for complete search history.

(56) References Cited

U.S. PATENT DOCUMENTS 3,043,000 A 7/1962 Hatfield
3,487,403 A 12/1969 Pihl
3,573,812 A 4/1971 Pihl
D227,118 S 6/1973 Muraoka
3,771,685 A 11/1973 Micallef
3,801,767 A 4/1974 Marks
(Continued)

FOREIGN PATENT DOCUMENTS

AU 2009101370 A4 3/2013
GB 414579 A 8/1934
(Continued)

OTHER PUBLICATIONS

Daniel Rutter, "Comparison: Lightwave 2000, 3000, 4000, Illuminator and Pocket-Bright, and Petzl Tikka" pp. 1-30, Feb. 14, 2002. http://www.dansdata.com/ledlights7.htm.

*Primary Examiner* — Carrie R Dorna
(74) *Attorney, Agent, or Firm* — Pilloff Passino & Cosenza LLP; Martin J. Cosenza

(57) ABSTRACT

An external component of a prosthesis, including a first module including a functional component and first structure including magnetic material. The first module is configured to be retained against skin via a magnetic field at least partially generated by a magnet implanted in a recipient that interacts with the magnetic material of the first structure, the first module including a skin interfacing surface configured to interact with skin of the recipient when the first module is retained against the skin of the recipient, a second module including a second structure including magnetic material configured to enhance magnetic retention of the external component to skin of a recipient, wherein the second module is removably attached to the first module and visible from an outside of the external component when the second module is attached to the first module and when viewed from a side opposite the skin interfacing side.

44 Claims, 33 Drawing Sheets

(56) References Cited

U.S. PATENT DOCUMENTS 3,987,967 A 10/1976 Kuznetsov et al.
4,003,521 A 1/1977 Hess
4,038,990 A 8/1977 Thompson
4,197,840 A 4/1980 Beck et al.
4,199,741 A 4/1980 Paulet
4,226,164 A 10/1980 Carter
4,240,428 A 12/1980 Akhavi
4,257,936 A 3/1981 Matsumoto et al.
4,317,969 A 3/1982 Riegler et al.
4,352,960 A 10/1982 Dormer et al.
D267,541 S 1/1983 Kanemitsu
4,414,701 A 11/1983 Johnson
4,596,971 A 6/1986 Hirabayashi et al.
4,606,329 A 8/1986 Hough
4,610,621 A 9/1986 Taber et al.
4,628,907 A 12/1986 Epley
4,634,191 A 1/1987 Studer
4,676,772 A 6/1987 Hooven
4,726,378 A 2/1988 Kaplan
4,731,718 A 3/1988 Sheu
4,736,747 A 4/1988 Drake
4,743,264 A 5/1988 Sherva-Parker
4,792,368 A 12/1988 Sagawa et al.
4,817,607 A 4/1989 Tatge
RE32,947 E 6/1989 Dormer et al.
4,868,530 A 9/1989 Ahs
4,917,504 A 4/1990 Scott et al.
4,918,745 A 4/1990 Hutchison
4,920,679 A 5/1990 Sarles et al.
5,014,592 A 5/1991 Zweig et al.
5,015,224 A 5/1991 Maniglia
5,096,763 A 3/1992 Ogata et al.
5,105,811 A 4/1992 Kuzma
5,183,056 A 2/1993 Dalen et al.
5,196,710 A 3/1993 Kalfaian
5,282,858 A 2/1994 Bisch et al.
5,314,453 A 5/1994 Jeutter
D348,067 S 6/1994 Lucey et al.
5,338,287 A 8/1994 Miller et al.
5,360,388 A 11/1994 Spindel et al.
5,423,317 A 6/1995 Iijima et al.
5,456,654 A 10/1995 Ball
5,554,096 A 9/1996 Ball
5,603,726 A 2/1997 Schulman et al.
5,624,376 A 4/1997 Ball et al.
5,630,835 A 5/1997 Brownlee
5,716,407 A 2/1998 Knapp et al.
5,746,897 A 5/1998 Heimanson et al.
5,749,912 A 5/1998 Zhang et al.
5,757,183 A 5/1998 Smith et al.
5,775,652 A 7/1998 Crawshaw et al.
5,785,477 A 7/1998 McGuffey et al.
5,800,336 A 9/1998 Ball et al.
5,857,958 A 1/1999 Ball et al.
5,877,664 A 3/1999 Jackson, Jr.
5,897,486 A 4/1999 Ball et al.
5,913,815 A 6/1999 Ball et al.
5,945,762 A 8/1999 Chen et al.
5,965,282 A 10/1999 Baermann
5,971,334 A 10/1999 Crawshaw et al.
6,040,762 A 3/2000 Tompkins
6,073,973 A 6/2000 Boscaljon et al.
6,101,417 A 8/2000 Vogel et al.
6,138,681 A 10/2000 Chen et al.
6,157,278 A 12/2000 Katznelson et al.
6,157,281 A 12/2000 Katznelson et al.
6,175,767 B1 1/2001 Doyle, Sr.
6,178,079 B1 1/2001 Renger
6,178,353 B1 1/2001 Griffith et al.
6,190,305 B1 2/2001 Ball et al.
6,208,235 B1 3/2001 Trontelj
6,208,882 B1 3/2001 Lenarz et al.
6,217,508 B1 4/2001 Ball et al.
6,219,580 B1 4/2001 Faltys et al.
6,244,142 B1 6/2001 Swanson
6,246,533 B1 6/2001 Davis et al.
6,259,951 B1 7/2001 Kuzma et al.
6,263,230 B1 7/2001 Haynor et al.
6,272,382 B1 8/2001 Faltys et al.
6,292,678 B1 9/2001 Hall et al.
6,295,472 B1 9/2001 Rubinstein et al.
6,295,473 B1 9/2001 Rosar
6,308,101 B1 10/2001 Faltys et al.
6,313,551 B1 11/2001 Hazelton
6,348,070 B1 2/2002 Teissl et al.
6,355,998 B1 3/2002 Schöb et al.
6,358,281 B1 3/2002 Berrang et al.
6,401,723 B1 6/2002 Garibaldi et al.
6,475,134 B1 11/2002 Ball et al.
6,505,062 B1 1/2003 Ritter et al.
6,506,987 B1 1/2003 Woods
6,522,909 B1 2/2003 Garibaldi et al.
6,542,777 B1 4/2003 Griffith et al.
6,571,676 B1 6/2003 Folsom et al.
6,643,378 B2 11/2003 Schumaier
6,668,065 B2 12/2003 Lee et al.
6,838,963 B2 1/2005 Zimmerling et al.
6,857,612 B2 2/2005 Goodbred
D512,416 S 12/2005 Malaver
6,991,594 B2 1/2006 Holcomb
7,038,565 B1 5/2006 Chell
7,091,806 B2 8/2006 Zimmerling et al.
7,190,247 B2 3/2007 Zimmerling
7,191,007 B2 3/2007 Desai et al.
7,200,504 B1 4/2007 Fister
7,225,028 B2 5/2007 Della Santina et al.
7,266,208 B2 9/2007 Charvin et al.
7,338,028 B2 3/2008 Zimmerling et al.
7,386,143 B2 6/2008 Easter et al.
7,532,937 B2 5/2009 Horio et al.
7,566,296 B2 7/2009 Zimmerling et al.
7,610,096 B2 10/2009 McDonald, III
7,642,887 B2 1/2010 Zimmerling
7,647,120 B2 1/2010 Della Santina et al.
7,695,427 B2 4/2010 Kugler et al.
7,762,998 B2 7/2010 Birk et al.
7,856,986 B2 12/2010 Darley
7,976,453 B2 7/2011 Zimmerling et al.
7,991,477 B2 8/2011 McDonald, III
8,013,699 B2 9/2011 Zimmerling
8,118,725 B2 2/2012 Zimmerling et al.
8,211,174 B2 7/2012 Park et al.
8,255,058 B2 8/2012 Gibson et al.
8,260,435 B2 9/2012 Johnson et al.
8,270,647 B2 9/2012 Crawford et al.
8,340,774 B2 12/2012 Hochmair et al.
8,406,443 B2 * 3/2013 Westerkull ..... H04R 25/606 381/326
8,515,112 B2 8/2013 Crawford et al.
8,532,783 B2 9/2013 Zimmerling et al.
8,634,909 B2 1/2014 Zimmerling et al.
8,734,475 B2 5/2014 Ekvall et al.
8,744,106 B2 6/2014 Ball
8,758,394 B2 6/2014 Zimmerling et al.
8,768,480 B2 7/2014 Charvin
8,811,643 B2 8/2014 Crawford et al.
8,897,475 B2 11/2014 Ball et al.
8,983,102 B2 3/2015 Crawford et al.
9,002,469 B2 4/2015 D'Ambrosio
9,014,782 B2 4/2015 Miyoshi
9,022,917 B2 5/2015 Kasic et al.
9,042,995 B2 5/2015 Dinsmoor et al.
RE45,701 E 9/2015 Zimmerling et al.
9,136,728 B2 9/2015 Dinsmoor et al.
9,144,676 B2 9/2015 Gibson et al.
9,179,228 B2 11/2015 Ruppersberg et al.
9,210,521 B2 12/2015 Kasic et al.
9,258,656 B2 2/2016 Ruppersberg et al.
9,392,384 B2 7/2016 Crawford et al.
9,526,810 B2 12/2016 Ruppersberg
9,627,120 B2 4/2017 Scott et al.
9,736,601 B2 8/2017 Kasic et al.
9,739,842 B2 8/2017 Holm et al.
9,788,125 B2 10/2017 Ruppersberg et al.

(56) References Cited

U.S. PATENT DOCUMENTS

RE46,624 E 12/2017 Zimmerling et al.
9,872,115 B2 1/2018 Kennes
9,872,993 B2 1/2018 Zimmerling
10,405,891 B2 9/2019 Pool et al.
2001/0021805 A1 9/2001 Blume et al.
2002/0076071 A1 6/2002 Single
2002/0103430 A1 8/2002 Hastings
2002/0116033 A1 8/2002 Greatbatch et al.
2002/0116034 A1 8/2002 Miller et al.
2002/0120332 A1 8/2002 Law et al.
2003/0034039 A1 2/2003 Schmid et al.
2003/0034705 A1 2/2003 Hakansson
2003/0089933 A1 5/2003 Janesky et al.
2003/0120202 A1 6/2003 Gordon
2003/0139782 A1 7/2003 Duncan
2003/0161481 A1 8/2003 Miller et al.
2003/0161482 A1 8/2003 Miller et al.
2003/0163021 A1 8/2003 Miller et al.
2003/0163022 A1 8/2003 Miller et al.
2003/0171787 A1 9/2003 Money et al.
2003/0171792 A1 9/2003 Zarinetchi et al.
2003/0181956 A1 9/2003 Duncan et al.
2004/0012470 A1 1/2004 Zimmerling et al.
2004/0032962 A1 2/2004 Westerkull
2004/0136558 A1 7/2004 Usuki et al.
2004/0147804 A1 7/2004 Schneider et al.
2004/0148025 A1 7/2004 Schneider et al.
2004/0260361 A1 12/2004 Gibson
2004/0260362 A1 12/2004 Darley
2005/0001703 A1 1/2005 Zimmerling
2005/0004629 A1 1/2005 Gibson et al.
2005/0062567 A1 3/2005 Zimmerling et al.
2005/0070346 A1 3/2005 Pan
2005/0101830 A1 5/2005 Easter et al.
2005/0159791 A1 7/2005 Daly et al.
2005/0165471 A1 7/2005 Wang et al.
2005/0171579 A1 8/2005 Tasche et al.
2005/0197715 A1* 9/2005 Kugler ..... A61B 17/0401 623/23.65
2005/0216075 A1 9/2005 Wang et al.
2005/0228214 A1 10/2005 Schneider et al.
2005/0228215 A1 10/2005 Schneider et al.
2005/0240098 A1 10/2005 Zhong et al.
2006/0030905 A1 2/2006 Malaver
2006/0045298 A1 3/2006 Westerkull
2006/0056649 A1 3/2006 Schumaier
2006/0084857 A1 4/2006 Massengill et al.
2006/0119356 A1 6/2006 Rabe et al.
2006/0184212 A1 8/2006 Faltys et al.
2006/0217792 A1 9/2006 Hussein et al.
2006/0241746 A1 10/2006 Shaoulian et al.
2006/0244560 A1 11/2006 Zimmerling et al.
2006/0247488 A1 11/2006 Waldmann
2007/0053536 A1* 3/2007 Westerkull ..... H04R 25/606 381/326
2007/0083078 A1 4/2007 Easter et al.
2007/0100197 A1 5/2007 Perkins et al.
2007/0126540 A1 6/2007 Zimmerling
2007/0170533 A1 7/2007 Doogue et al.
2007/0208403 A1 9/2007 Della Santina et al.
2008/0009920 A1 1/2008 Gibson et al.
2008/0044049 A1 2/2008 Ho et al.
2008/0071353 A1 3/2008 Weber et al.
2008/0221641 A1 9/2008 Hochmair
2008/0293998 A1 11/2008 Andrews
2008/0304686 A1 12/2008 Meskens et al.
2009/0030529 A1 1/2009 Berrang et al.
2009/0043149 A1 2/2009 Abel
2009/0069869 A1 3/2009 Stouffer et al.
2009/0138062 A1 5/2009 Balslev
2009/0237080 A1 9/2009 Kato et al.
2009/0248155 A1 10/2009 Parker
2009/0251264 A1 10/2009 Fullerton et al.
2009/0281367 A1 11/2009 Cho et al.
2009/0287036 A1 11/2009 Shapiro et al.
2009/0287278 A1 11/2009 Charvin
2009/0295521 A1 12/2009 Fullerton et al.
2010/0145135 A1 6/2010 Ball et al.
2010/0219712 A1 9/2010 Kogure et al.
2010/0237969 A1 9/2010 Crawshaw
2010/0272299 A1 10/2010 Van Schuylenbergh et al.
2010/0292759 A1 11/2010 Hahn et al.
2011/0004278 A1 1/2011 Aghassian
2011/0022120 A1 1/2011 Ball et al.
2011/0031839 A1 2/2011 Fullerton et al.
2011/0054237 A1 3/2011 Shapiro et al.
2011/0077502 A1 3/2011 Rofougaran
2011/0106210 A1 5/2011 Meskens
2011/0112607 A1 5/2011 Zierhofer
2011/0130622 A1 6/2011 Iberg
2011/0152603 A1 6/2011 Perkins et al.
2011/0224789 A1 9/2011 Griffith
2011/0264172 A1 10/2011 Zimmerling et al.
2011/0268303 A1 11/2011 Ahsani
2011/0285488 A1 11/2011 Scott et al.
2011/0291507 A1 12/2011 Post
2011/0295053 A1 12/2011 Ball
2012/0022616 A1 1/2012 Gamham et al.
2012/0029267 A1 2/2012 Ball
2012/0062992 A1 3/2012 Kimoto
2012/0078035 A1 3/2012 Andersson et al.
2012/0080039 A1 4/2012 Siegert
2012/0088956 A1 4/2012 Asnes et al.
2012/0095283 A1 4/2012 Andersson et al.
2012/0104875 A1 5/2012 Park
2012/0108887 A1 5/2012 Vermeiren
2012/0172659 A1 7/2012 Ball et al.
2012/0237067 A1 9/2012 Asnes
2012/0238799 A1 9/2012 Ball et al.
2012/0262019 A1 10/2012 Smith et al.
2012/0262020 A1 10/2012 Smith et al.
2012/0284969 A1 11/2012 Fullerton et al.
2012/0296155 A1 11/2012 Ball
2012/0313473 A1 12/2012 Chen et al.
2012/0319809 A1 12/2012 Fullerton
2012/0323066 A1 12/2012 Cho et al.
2012/0330378 A1 12/2012 Crawford et al.
2013/0004003 A1 1/2013 Tada
2013/0006044 A1 1/2013 Menzl
2013/0018218 A1 1/2013 Haller et al.
2013/0023954 A1 1/2013 Meskens
2013/0046131 A1 2/2013 Ball et al.
2013/0046360 A1 2/2013 Gibson et al.
2013/0053874 A1 2/2013 Ekvall et al.
2013/0096366 A1 4/2013 Bervoets et al.
2013/0099703 A1 4/2013 Epstein et al.
2013/0110198 A1 5/2013 Stoffaneller
2013/0114834 A1 5/2013 Bern
2013/0165738 A1 6/2013 Ball et al.
2013/0190552 A1 7/2013 Leblans
2013/0195304 A1 8/2013 Andersson
2013/0199031 A1 8/2013 Fullerton et al.
2013/0202140 A1 8/2013 Asnes
2013/0207760 A1 8/2013 Clarke et al.
2013/0214631 A1 8/2013 Smith et al.
2013/0261701 A1 10/2013 Kuratle et al.
2013/0268012 A1 10/2013 Sison
2013/0278254 A1 10/2013 Reeder et al.
2013/0281764 A1* 10/2013 Bjorn ..... H04R 25/606 600/25
2013/0289384 A1 10/2013 Jenison et al.
2013/0305522 A1 11/2013 Fullerton et al.
2014/0005522 A1 1/2014 Zurovcik
2014/0012069 A1 1/2014 Ball
2014/0012070 A1 1/2014 Nagl et al.
2014/0012071 A1 1/2014 Nagl et al.
2014/0012349 A1 1/2014 Zimmerling
2014/0064531 A1 3/2014 Andersson et al.
2014/0094876 A1 4/2014 Wingeier et al.
2014/0121447 A1 5/2014 Kasic et al.
2014/0121450 A1 5/2014 Kasic et al.
2014/0121451 A1 5/2014 Kasic et al.
2014/0163308 A1 6/2014 Miller et al.
2014/0163309 A1 6/2014 Bernhard et al.

(56) References Cited

U.S. PATENT DOCUMENTS

| | | | | |
|---|---|---|---|---|
| 2014/0213139 | A1 | 7/2014 | Ferguson | |
| 2014/0257081 | A1 | 9/2014 | Rapoport | |
| 2014/0270297 | A1 | 9/2014 | Gustafsson et al. | |
| 2014/0275731 | A1 | 9/2014 | Andersson et al. | |
| 2014/0275736 | A1 | 9/2014 | Ruppersberg et al. | |
| 2014/0292321 | A1 | 10/2014 | Yamazaki et al. | |
| 2014/0300437 | A1 | 10/2014 | Fullerton et al. | |
| 2014/0302741 | A1 | 10/2014 | Whittaker | |
| 2014/0321681 | A1 | 10/2014 | Ball et al. | |
| 2014/0336447 | A1* | 11/2014 | Bjorn | H04R 25/606 600/25 |
| 2014/0343626 | A1 | 11/2014 | Thenuwara et al. | |
| 2014/0364681 | A1 | 12/2014 | Hillbratt et al. | |
| 2014/0364682 | A1 | 12/2014 | Hillbratt et al. | |
| 2014/0364922 | A1 | 12/2014 | Garnham et al. | |
| 2015/0022298 | A1 | 1/2015 | Fullerton | |
| 2015/0032186 | A1 | 1/2015 | Cushing et al. | |
| 2015/0045607 | A1 | 2/2015 | Hakansson | |
| 2015/0045855 | A1 | 2/2015 | Griffith | |
| 2015/0087892 | A1 | 3/2015 | Tourrel et al. | |
| 2015/0092969 | A1 | 4/2015 | Meskens et al. | |
| 2015/0104052 | A1 | 4/2015 | Gustafsson et al. | |
| 2015/0117689 | A1 | 4/2015 | Bergs et al. | |
| 2015/0156595 | A1 | 6/2015 | Zhong et al. | |
| 2015/0157778 | A1 | 6/2015 | Ishiyama et al. | |
| 2015/0160426 | A1 | 6/2015 | Chao et al. | |
| 2015/0160470 | A1 | 6/2015 | Terajima | |
| 2015/0173468 | A1 | 6/2015 | Stevenson | |
| 2015/0192432 | A1 | 7/2015 | Noguchi et al. | |
| 2015/0201290 | A1 | 7/2015 | Nikles et al. | |
| 2015/0215708 | A1 | 7/2015 | Meskens et al. | |
| 2015/0265842 | A1 | 9/2015 | Ridler et al. | |
| 2015/0281860 | A1* | 10/2015 | Johansson | H04R 25/606 381/326 |
| 2015/0312686 | A1 | 10/2015 | Gustafsson et al. | |
| 2015/0382114 | A1 | 12/2015 | Andersson et al. | |
| 2016/0021470 | A1 | 1/2016 | Gustafsson | |
| 2016/0037273 | A1 | 2/2016 | Gustafsson | |
| 2016/0058555 | A1 | 3/2016 | Andersson et al. | |
| 2016/0100260 | A1 | 4/2016 | Ruppersberg et al. | |
| 2016/0112813 | A1 | 4/2016 | Hillbratt et al. | |
| 2016/0161288 | A1 | 6/2016 | Lu | |
| 2016/0198270 | A9 | 7/2016 | Nagl et al. | |
| 2016/0205484 | A1 | 7/2016 | Nagl et al. | |
| 2016/0234613 | A1 | 8/2016 | Westerkull | |
| 2016/0247616 | A1 | 8/2016 | Smith et al. | |
| 2016/0361537 | A1 | 12/2016 | Leigh et al. | |
| 2016/0381473 | A1 | 12/2016 | Gustafsson | |
| 2017/0078808 | A1 | 3/2017 | Kennes | |
| 2017/0111728 | A1 | 4/2017 | Kim et al. | |
| 2017/0162311 | A1 | 6/2017 | Shmbo et al. | |
| 2017/0216523 | A1 | 8/2017 | Neftel et al. | |
| 2017/0251313 | A1 | 8/2017 | Gustafsson | |
| 2018/0252228 | A1 | 9/2018 | Henseler et al. | |
| 2018/0270591 | A1 | 9/2018 | Kennes | |
| 2018/0288538 | A1 | 10/2018 | Andersson et al. | |
| 2018/0352349 | A1 | 12/2018 | Fung et al. | |
| 2018/0369586 | A1 | 12/2018 | Lee et al. | |
| 2019/0076649 | A1 | 3/2019 | Lee et al. | |
| 2019/0151653 | A1 | 5/2019 | Leigh et al. | |
| 2019/0215623 | A1 | 7/2019 | Bodvarsson | |
| 2019/0239007 | A1 | 8/2019 | Kennes et al. | |
| 2019/0293454 | A1 | 9/2019 | Bidaux et al. | |
| 2020/0114151 | A1 | 4/2020 | Smith et al. | |
| 2021/0106815 | A1 | 4/2021 | Smith et al. | |
| 2021/0257139 | A1 | 8/2021 | Nellessen | |
| 2021/0316136 | A1 | 10/2021 | Smith et al. | |

FOREIGN PATENT DOCUMENTS

| | | | |
|---|---|---|---|
| GB | 2196855 | A | 5/1988 |
| GB | 2205999 | A | 12/1988 |
| GB | 2266045 | A | 10/1993 |
| JP | 2010075394 | A | 4/2010 |
| JP | 2012191448 | A | 10/2012 |
| KR | 101743793 | A | 5/2013 |
| KR | 101297828 | B1 | 8/2013 |
| KR | 101537380 | B1 | 7/2015 |
| WO | 9716835 | A1 | 5/1997 |
| WO | 2007024657 | A1 | 3/2007 |
| WO | 2015/065442 | A2 | 5/2015 |
| WO | 2016207856 | A1 | 12/2016 |
| WO | 2016207860 | A1 | 12/2016 |
| WO | 2017046650 | A1 | 3/2017 |
| WO | 2017105511 | A1 | 6/2017 |

* cited by examiner

RETENTION FORCE INCREASING COMPONENTS

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems. Conversely, cochlear implants can have utilitarian value with respect to recipients where all of the inner hair inside the cochlea has been damaged or otherwise destroyed. Electrical impulses are provided to electrodes located inside the cochlea, which stimulate nerves of the recipient so as to evoke a hearing percept.

SUMMARY

In accordance with one aspect, there is an external component of a prosthesis, comprising a first module including a functional component and first structure including magnetic material, wherein the first module is configured to be retained against skin of a recipient via a magnetic field at least partially generated by a permanent magnet implanted in a recipient that interacts with the magnetic material of the first structure, the first module including a skin interfacing surface configured to interact with skin of the recipient when the first module is retained against the skin of the recipient; and a second module including a second structure including magnetic material configured to enhance magnetic retention of the external component to skin of a recipient, wherein the second module is removably attached to the first module and visible from an outside of the external component when the second module is attached to the first module and when viewed from a side opposite the skin interfacing side.

In another exemplary embodiment, there is a button sound processor, comprising a first component including a first permanent magnet; and a second component including soft magnetic material, wherein the second component is configured to direct a magnetic flux at least partially generated by the first permanent magnet differently from that which would exist in the absence of the second component via the soft magnetic material.

In accordance with another aspect, there is a method, comprising: obtaining a first portion of a headpiece for a prosthesis, the first portion including electronic components of the prosthesis and a first permanent magnet; obtaining a second portion of the headpiece, the second portion including a magnetic material; attaching the second portion to the first portion; and attaching the combined first and second portions to a recipient having implanted therein a second permanent magnet such that the first portion and the second portion are magnetically retained to the skin of the recipient via interaction with the magnetic field generated by the second permanent magnet and component(s) of the headpiece, wherein the magnetic material alters the magnetic flux established by the second permanent magnet such that the magnetic flux is widened about a longitudinal axis between the second permanent magnet and the first portion relative to that which would be the case in the absence of the second portion.

In accordance with another aspect, there is a body piece configured for transcutaneous communication with an implanted component implanted in a recipient, comprising: an inductance coil; a first permanent magnet; and a second permanent magnet, wherein the first permanent magnet has a north-south polarity that is parallel to a longitudinal axis of the body piece, the second permanent magnet has a north-south polarity at an oblique angle relative to the north-south polarity of the first permanent magnet, and the body piece is configured such that the second permanent magnet is readily removably connected at least indirectly to the first permanent magnet.

BRIEF DESCRIPTION OF THE DRAWINGS

Some embodiments are described below with reference to the attached drawings, in which.

DETAILED DESCRIPTION

Figure 1:
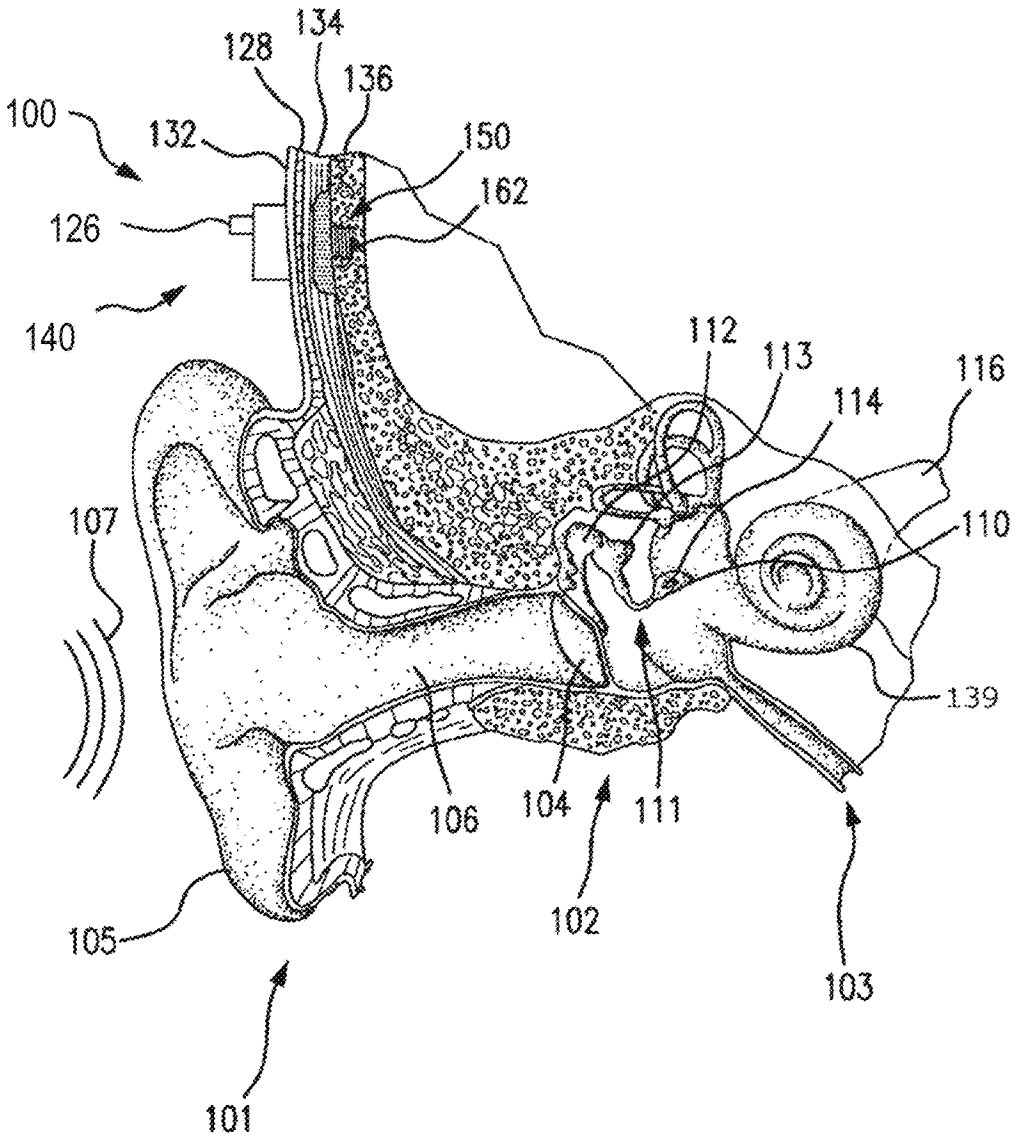
FIG. 1 is a perspective view of an exemplary bone conduction device in which at least some embodiments can be implemented.

Embodiments herein are described primarily in terms of a bone conduction device, such as an active transcutaneous bone conduction device. However, it is noted that the teachings detailed herein and/or variations thereof are also applicable to a cochlear implant and/or a middle ear implant. Accordingly, any disclosure herein of teachings utilized with a bone conduction device also corresponds to a disclosure of utilizing those teachings with respect to a cochlear implant and utilizing those teachings with respect to a middle ear implant. Moreover, at least some exemplary embodiments of the teachings detailed herein are also applicable to an active and/or a passive transcutaneous bone conduction device. It is further noted that the teachings detailed herein can be applicable to other types of prostheses, such as by way of example only and not by way of limitation, a retinal implant. Indeed, the teachings detailed herein can be applicable to any component that is held against the body that utilizes an RF coil and/or an inductance coil or any type of communicative coil to communicate with a component implanted in the body. That said, the teachings detailed herein will be directed by way of example only and not by way of limitation towards a component that is held against the head of a recipient for purposes of the establishment of an external component of the hearing prosthesis. In view of this, FIG. 1 is a perspective view of a bone conduction device 100 in which embodiments may be implemented. As shown, the recipient has an outer ear 101, a middle ear 102, and an inner ear 103. Elements of outer ear 101, middle ear 102, and inner ear 103 are described below, followed by a description of bone conduction device 100.

Still, it is noted that in at least some exemplary embodiments, element 100 is instead a cochlear implant, where the RF inductance coil of the external component communicates with an RF inductance coil of the implanted component, which implanted RF inductance coil is in signal communication with a receiver/stimulator of a cochlear implant, which receiver/stimulator receives signals from the RF inductance coil and converts those signals into electrical signals applied to electrodes implanted in the cochlea to evoke a hearing percept via electrical stimulation. Note also that in at least some exemplary embodiments, element 100 is instead a so-called middle ear implant, where the RF inductance coil of the external component communicates with an RF inductance of the implanted component, which RF inductance coil is in signal communication with the receiver/stimulator of a middle ear implant. The receiver/stimulator receives signals from the RF inductance coil and converts those signals into electrical signals that are applied to an actuator to cause the actuator to actuate, and thus evoke a hearing percept via mechanical stimulation of components of the auditory system.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113, and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. Bone conduction device 100 comprises an external component 140 and implantable component 150. As shown, bone conduction device 100 is positioned behind outer ear 101 of the recipient and comprises a sound input element 126 to receive sound signals. Sound input element 126 may comprise, for example, a microphone. In an exemplary embodiment, sound input element 126 may be located, for example, on or in bone conduction device 100, or on a cable extending from bone conduction device 100.

More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

Bone conduction device 100 comprises a sound processor (not shown), an actuator (also not shown), and/or various other operational components. In operation, the sound processor converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 can be a passive transcutaneous bone conduction device. That is, no active components, such as the actuator, are implanted beneath the recipient's skin 132. In such an arrangement, the active actuator is located in external component 140, and implantable component 150 includes a magnetic plate, as will be discussed in greater detail below. The magnetic plate of the implantable component 150 vibrates in response to vibration transmitted through the skin, mechanically and/or via a magnetic field, that is generated by an external magnetic plate.

In another arrangement of FIG. 1, bone conduction device 100 can be an active transcutaneous bone conduction device where at least one active component, such as the actuator, is implanted beneath the recipient's skin 132 and is thus part of the implantable component 150. As described below, in such an arrangement, external component 140 may comprise a sound processor and transmitter, while implantable component 150 may comprise a signal receiver and/or various other electronic circuits/devices.

Figure 2:
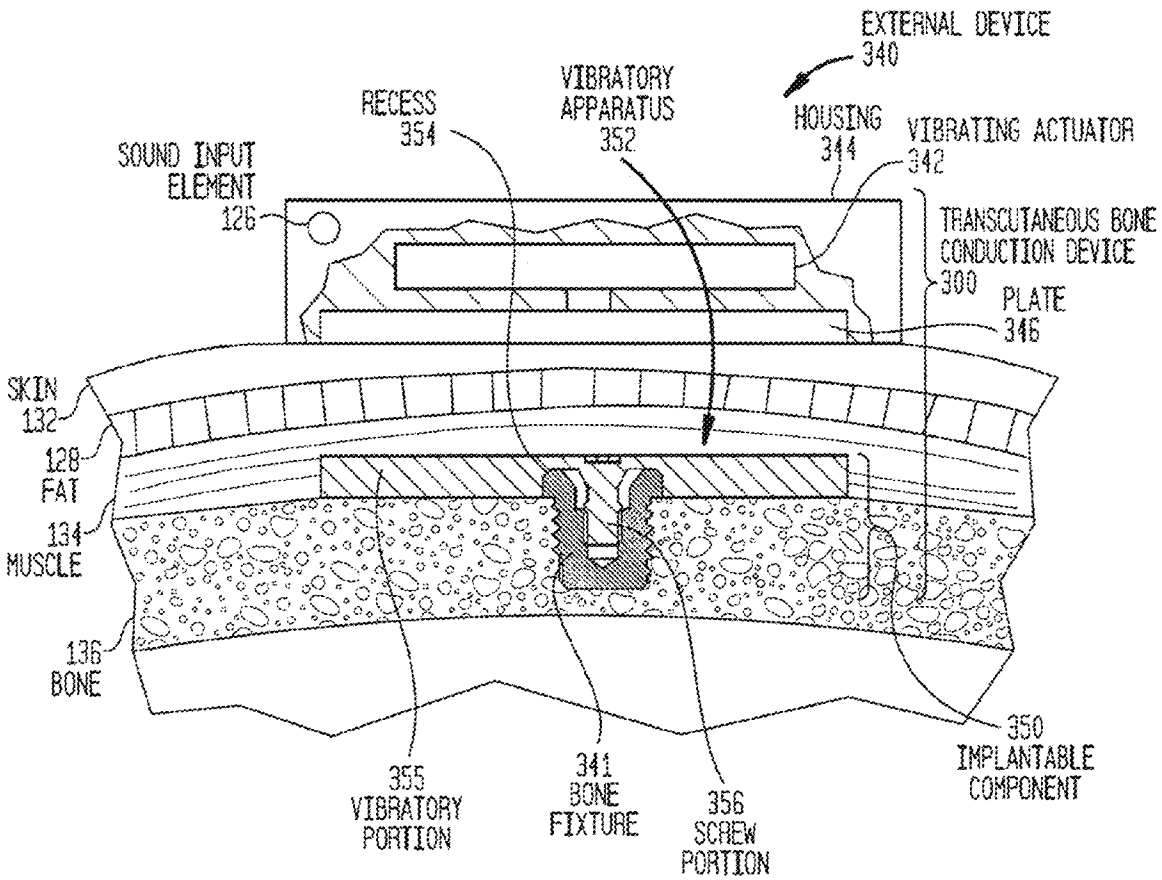
FIG. 2 is a schematic diagram conceptually illustrating a passive transcutaneous bone conduction device.
Figure 3:
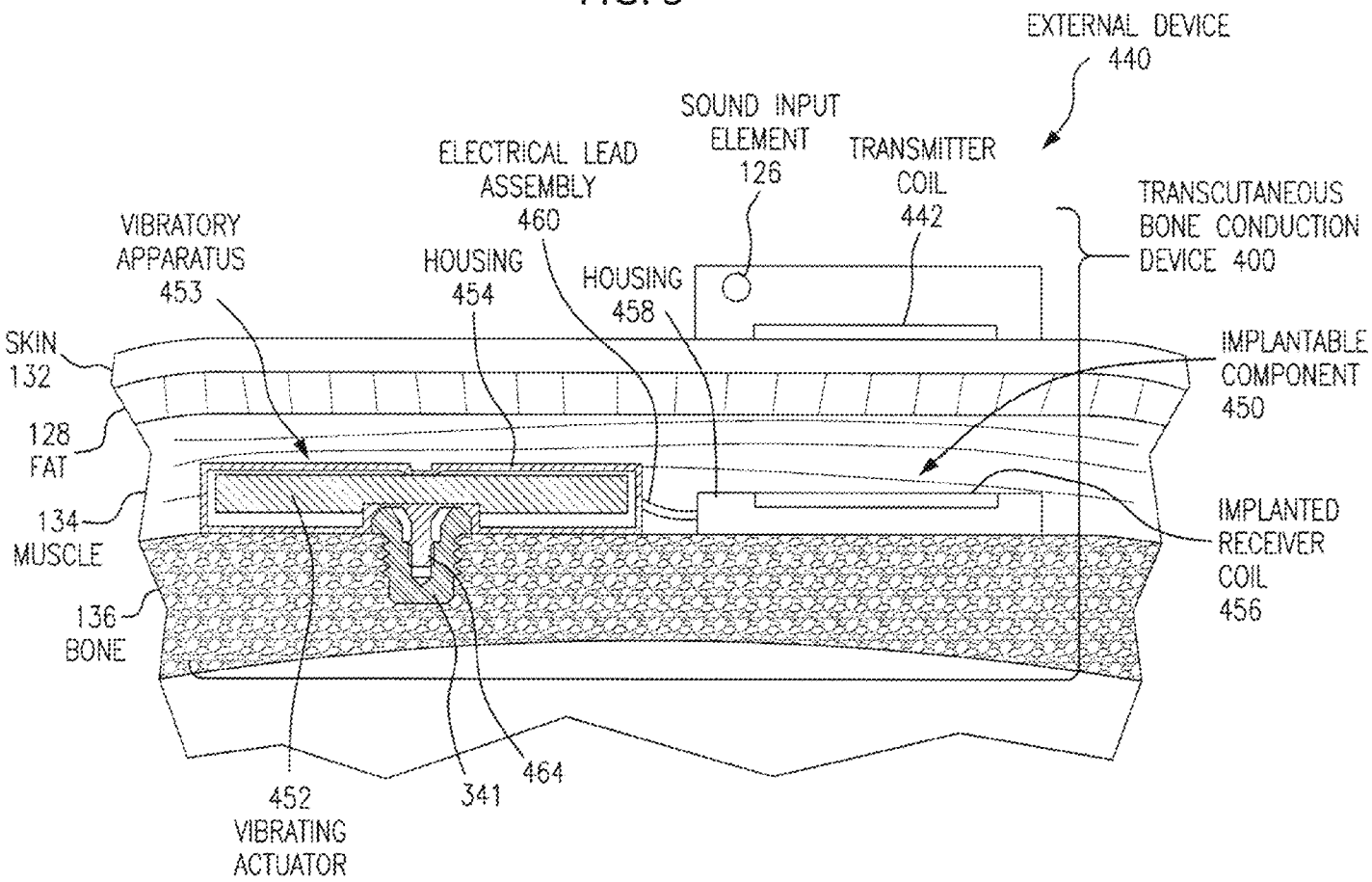
FIG. 3 is a schematic diagram conceptually illustrating an active transcutaneous bone conduction device in accordance with at least some exemplary embodiments.

FIG. 2 depicts an exemplary transcutaneous bone conduction device 300 that includes an external device 340 (corresponding to, for example, element 140 of FIG. 1) and an implantable component 350 (corresponding to, for example, element 150 of FIG. 1). The transcutaneous bone conduction device 300 of FIG. 3 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating electromagnetic actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating electromagnetic actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object, such as an abutment, with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

FIG. 3 depicts an exemplary embodiment of a transcutaneous bone conduction device 400 according to another embodiment that includes an external device 440 (corresponding to, for example, element 140B of FIG. 1) and an implantable component 450 (corresponding to, for example, element 150 of FIG. 1). The transcutaneous bone conduction device 400 of FIG. 3 is an active transcutaneous bone conduction device in that the vibrating electromagnetic actuator 452 is located in the implantable component 450. Specifically, a vibratory element in the form of vibrating electromagnetic actuator 452 is located in housing 454 of the implantable component 450. In an exemplary embodiment, much like the vibrating electromagnetic actuator 342 described above with respect to transcutaneous bone conduction device 300, the vibrating electromagnetic actuator 452 is a device that converts electrical signals into vibration.

External component 440 includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating electromagnetic actuator 452 via electrical lead assembly 460. The vibrating electromagnetic actuator 452 converts the electrical signals into vibrations.

The vibrating electromagnetic actuator 452 is mechanically coupled to the housing 454. Housing 454 and vibrating electromagnetic actuator 452 collectively form a vibratory apparatus 453. The housing 454 is substantially rigidly attached to bone fixture 341.

Figure 4:
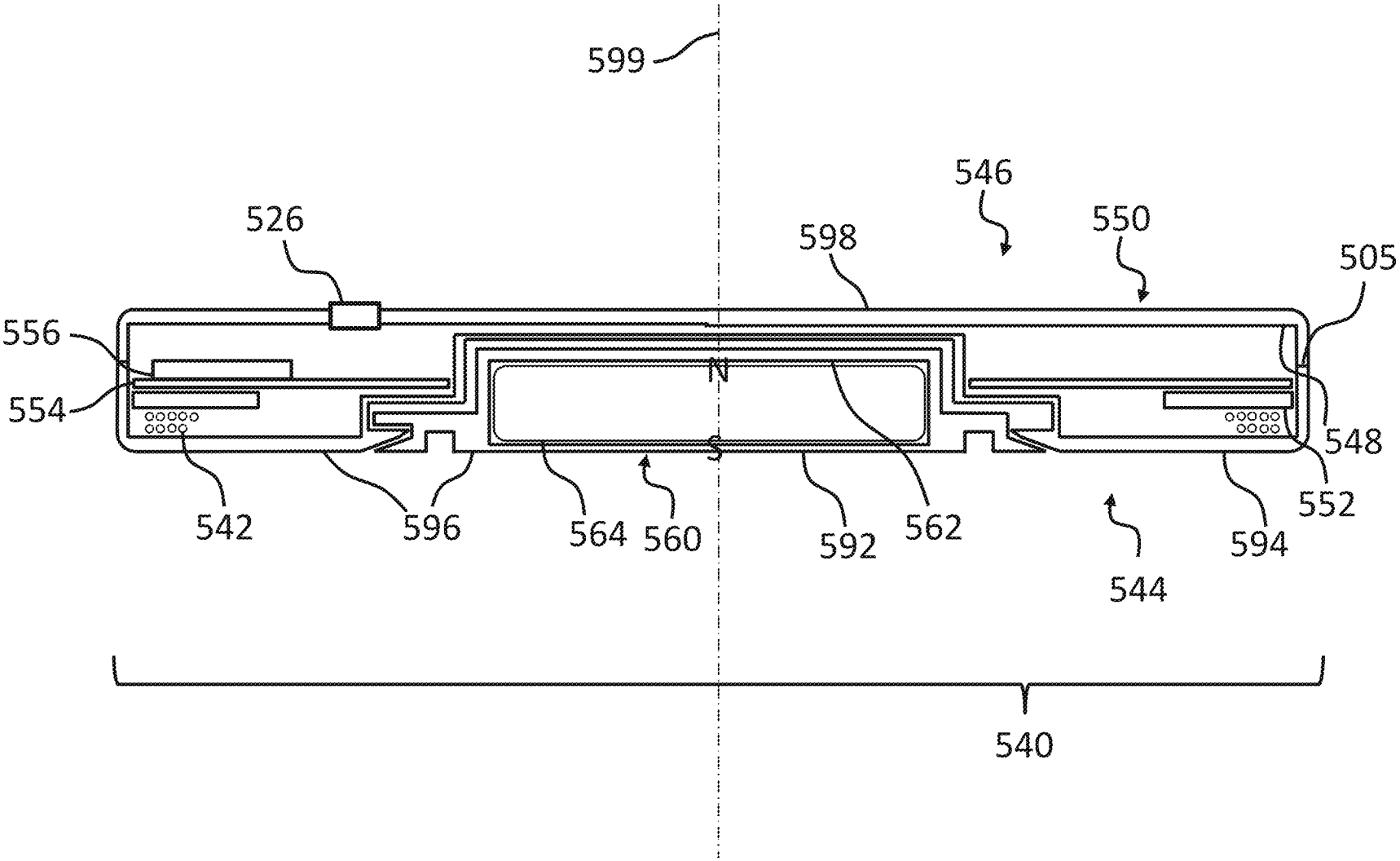
FIG. 4 is a schematic diagram of a cross-section of an exemplary external component according to an exemplary embodiment.

FIG. 4 depicts a cross-sectional view of an exemplary external component 540 corresponding to a device that can be used as external component 440 in the embodiment of FIG. 3. In an exemplary embodiment, external component 540 has all of the functionalities detailed above with respect to external component 440.

External component 540 comprises a first sub-component 550 and a second sub-component 560. It is briefly noted that back lines have been eliminated in some cases for purposes of ease of illustration (e.g., such as the line between sub-component 550 and sub-component 560—note that FIGS. 5 and 6 and 7 respectively depict these sub-components in isolation relative to the other component). It is further noted that unless otherwise stated, the components of FIG. 4 are rotationally symmetric about axis 599, although in other embodiments, such is not necessarily the case.

In an exemplary embodiment, external component 540 is a so-called button sound processor as detailed above. In this regard, in the exemplary embodiment of FIG. 4, the external component 540 includes a sound capture apparatus 526 (depicted located on the top of component 540, but in other embodiments, can be located on the side—in other embodiments, there is no sound capture apparatus button sound processor—instead, the sound capture apparatus is located remotely from the sound processor), which can correspond to the sound capture apparatuses 126 detailed above, and also includes a sound processor apparatus 556 which is in signal communication with, or located on or otherwise integrated into a printed circuit board 554. Further as can be seen in FIG. 4, an electromagnetic radiation interference shield 554 is interposed between the coil 542 and the PCB 554 and/or the sound processor 556. In an exemplary embodiment, the shield 552 is a ferrite shield. These components are housed in or otherwise supported by sub-component 550. Sub-component 550 further houses or otherwise supports RF coil 542. Coil 542 can correspond to the coil 442 detailed above. In an exemplary embodiment, sound captured by the sound capture apparatus 526 is provided to the sound processor 556, which converts the sound into a processed signal which is provided to the RF coil 542. In an exemplary embodiment, the RF coil 542 is an inductance coil. The inductance coil is energized by the signal provided from the processor 556. The energized coil produces an electromagnetic field that is received by an implanted coil in the implantable component 450, which is utilized by the implanted component 450 as a basis to evoke a hearing percept as detailed above.

The external component 540 further includes a magnet 564 which is housed in sub-component 560. Sub-component 560 is removably replaceable to/from sub-component 550. In the exemplary embodiment of FIG. 4 when utilized in conjunction with the embodiment of FIG. 3, the magnet 564 forms a transcutaneous magnetic link with a ferromagnetic material implanted in the recipient (such as a magnet that is part of the implantable component 450, etc.). This transcutaneous magnetic link holds the external component 540 against the skin of the recipient. In this regard, the external component 550 includes a skin interface side 544, which skin interface side is configured to interface with skin of a recipient, and an opposite side 546 that is opposite the skin interface side 544. That is, when the external component 540 is held against the skin of the recipient via the magnetic link, such as when the external component 540 is held against the skin overlying the mastoid bone where the implantable component is located in or otherwise attached to the mastoid bone, side 546 is what a viewer who is looking at the recipient wearing the external component 540 can see (i.e., in a scenario where the external component 540 is held against the skin over the mastoid bone, and a viewer is looking at the side of the recipient's head, side 546 would be what the viewer sees of the external component 540).

Still with reference to FIG. 4, skin interface side 544 includes skin interface surfaces 592 and 594. Skin interface surface 592 corresponds to the bottom most surface of sub-component 560, and skin interface surface 594 corresponds to the bottom most surface of sub-component 550. Collectively, these surfaces establish surface assembly 596. Surface assembly 596 corresponds to the skin interface surfaces of the external component 540. It is briefly noted that in some exemplary embodiments, the arrangement of the external component 540 is such that the sub-component 560 can be placed into the sub-component 550 such that the bottom surface 592 is recessed relative to the bottom surface 594, and thus the surface 592 may not necessarily contact or otherwise interface with the recipient. It is further briefly noted that in some alternate exemplary embodiments, the arrangement of the external component 540 is reversed, where surface 594 does not contact the recipient because surface 592 remains proud of surface 594 after insertion of the sub-component 560 into the sub-component 550.

It is briefly noted that as used herein, the sub-component 550 is utilized as shorthand for the external component 540. That is, external component 540 exists irrespective of whether the sub-component 560 is located in the sub-component 550 or otherwise attached to sub-component 550.

In the embodiment of FIG. 4, the external component 550 is configured such that the sub-component 560, and thus the magnet 564 and the housing containing magnet 564 (housing 562), is installable into the external component 540 (i.e., from sub-component 550) from the skin interface side 544, and thus is installable into the housing 548 at the skin interface side. Also, in some embodiments, the sub-component 560 is removable from the external component 550. Turning sub-component 560 relative to sub-component 550 "locks" sub-component 560 to sub-component 550, and turning the other way "unlocks" sub-component 560 from sub-component 550, thus making the sub-components rotationally lockable to one another. However, it is briefly noted that the turn locking as detailed herein does not correspond to mere thread engagement, such as by way of example how a bolt is threaded onto a nut, or vice versa, because such does not result in locking of the components together. Some additional details of the arrangements utilized to obtain the aforementioned rotational locking are described in greater detail below. However, it is briefly noted that in some alternate embodiments, the sub-components are snap coupled or otherwise snap locked to one another without rotation. By way of example only and not by way of limitation, the housing sub-component containing the magnet can have a detent receptacle located on a side surface, where a male detent of the housing containing the RF coil or the like interfaces with the receptacle so as to lock the sub-components together. Any arrangement that can enable the retention of the sub-components one another can be utilized in at least some exemplary embodiments.

The sub-component 550 comprises a housing 548 that contains the RF coil 542, the sound processor apparatus 556, and, in some embodiments, a battery.

While the embodiment of FIG. 4 depicts the second sub-component 560 as being a separate component from sub-component 550 that is removable therefrom, in an alternate embodiment, sub-component 560 is not removable from sub-component 550. Moreover, in some exemplary embodiments, there is no sub-component 560. Instead, the magnet 564 is located within a housing structure that effectively corresponds to housing 548 where the bottom wall thereof extends from one side of the button sound processor to the other. Some additional details of these embodiments will be described below.

Due to variations in skin flap thickness (the distance between a top surface of the magnet implanted in the recipient and the outer surface of the skin), there can be utilitarian value with respect to varying the strength of the magnetic field generated by the magnet(s) of the external component 540. That is, in an exemplary embodiment, all things being equal, for a greater skin flap thickness, a stronger magnetic field should be generated by the external component to obtain the same or effectively same retention forces between the external component and implantable component. This is because the retention force decreases with increasing skin flap thickness, all things being equal. In at least some exemplary embodiments, the strength of the magnetic field generated by the external component 540 is varied by the use of exchangeable magnet models. For example, the second sub-component 560 could be replaced with a new sub-component 560 that has a stronger magnet 564/the magnet 564 located within the housing 562 of the second sub-component 560 generates a stronger magnetic field. It is noted that in at least some exemplary embodiments, it is the size of the magnet that results in a greater/stronger magnetic field. In at least some exemplary embodiments of these exemplary embodiments, this size is increased by making the magnet thicker (i.e., increasing the height of the magnet in the direction of the longitudinal axis 599). Thus, the height or thickness of the button sound processor is greater than that which would otherwise be the case so as to accommodate the thicker magnet. With respect to the embodiment of FIG. 4, while the magnet depicted in that figure effectively takes up the entire inner volume of the housing 562, this magnet can be considered to be the "strongest" magnet, where a weaker magnet would be not as thick as the magnet depicted in FIG. 4. However, it will be appreciated that so as to permit the first sub-component 550 to receive a second sub-component 560 having a stronger magnet 564 (where strength is increased by increasing the thickness of the magnet) the sub-component 550 must still be configured to receive this thicker magnet, and thus it is the thicker magnet that drives the overall design of the external component 540 in general, and the thickness of the external component in particular. Note also that this is the case with respect to embodiments where the magnet is movable within the external component 540 so as to adjust the resulting magnetic field between the magnet of the external component and the magnet of the implantable component—there still must be a given thickness of the external component to accommodate the movement of the magnet.

In view of the above, it can be understood that adjusting the retention force by managing features associated with the magnet 564 (thickness, position, etc.) drives a thicker (distance along the axis 599) external component than that which would otherwise be the case if a minimum thickness magnet can be utilized/the magnet need not be moved within the external component 540. According to at least some exemplary embodiments detailed herein, a thinner magnet is utilized as magnet 564 and/or the position of magnet 564 along the longitudinal axis 599 is such that the magnet is as close to the skin interfacing surface assembly 596 as possible, thus reducing and/or eliminating the impact of the magnet 564 with respect to driving the thickness of the external component. In an exemplary embodiment, the thickness and the positioning of the magnet is designed to accommodate the typical recipient. In an exemplary embodiment, the thickness and positioning of the magnet is designed to accommodate recipients where statistically lower retention force between the external component and the implantable component is needed to retain the external component to the recipient relative to other recipients. By way of example only and not by way of limitation, if a population of recipients is such that 75% have a skin flap thickness of X to Y and the remaining 25% have a skin flap thickness of Y+Z, the design of the external component vis-à-vis the magnet 564 (size and positioning) could be directed towards achieving utilitarian retention for the 75% of the population that have the skin flap thickness of X to Y, thus resulting in an external component that has a thickness that is less than that which would be the case if the design of the external component vis-à-vis the internal magnet 560 was to accommodate those of the 75 percentile and those of the remaining 25 percentile.

Note also that this concept can be extended to situations where a given percentile of a population almost never experiences accelerations above a certain level, and the remaining population sometimes experiences accelerations above a certain level. The design of the external component can be directed towards meeting the requirements of the former, thus reducing the thickness of the external component 540.

Still, such an embodiment (where the design is directed towards the population requiring a less-strong magnetic field generated by the internal magnet of the external component 540) can result in a situation where the retention force between the external component and implantable component is not as utilitarian as that which otherwise could be the case for a given population (e.g., the population having the skin flap thickness of Y+Z). Accordingly, there is utilitarian value with respect to being able to increasing the strength of the magnetic field used to hold the external component to the skin of the recipient for the "greater retention force need" populations.

Figure 5:
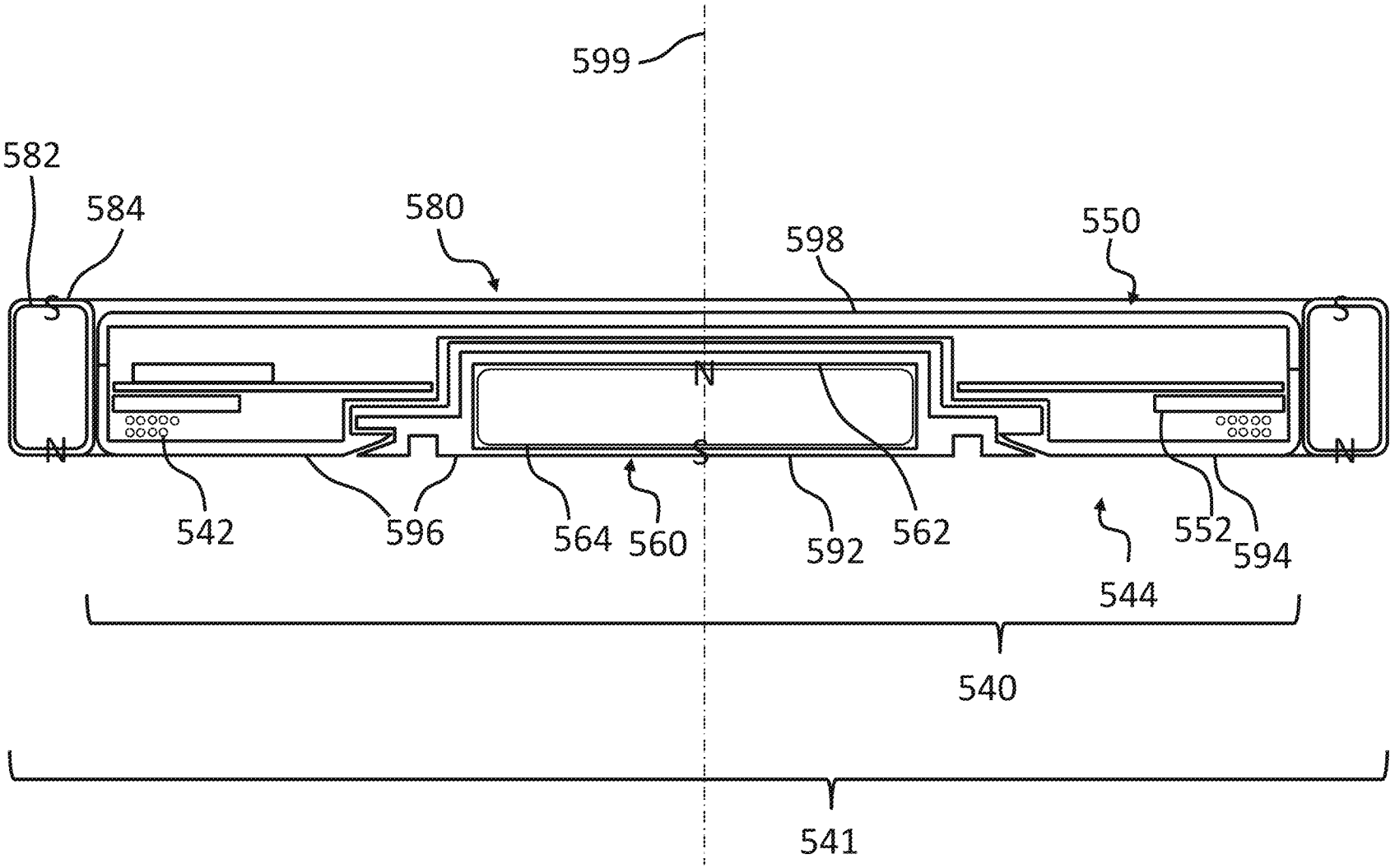
FIG. 5 is a schematic diagram of a cross-section of an exemplary external assembly according to the exemplary embodiment of FIG. 4, with the addition of a module that increases magnetic retention force.
Figure 6A:
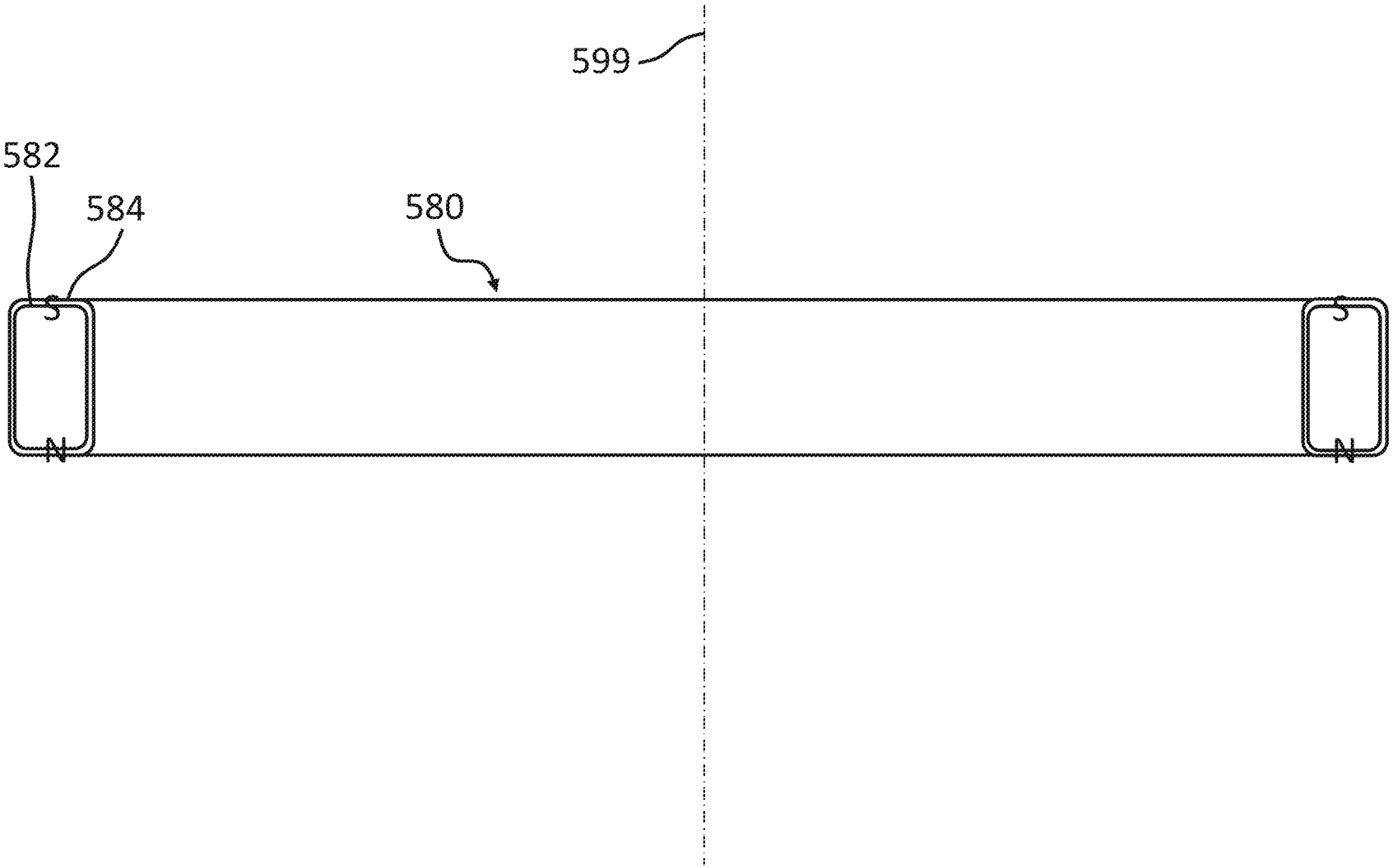
FIG. 6A is a cross-sectional view of the module of FIG. 5.
Figure 6B:
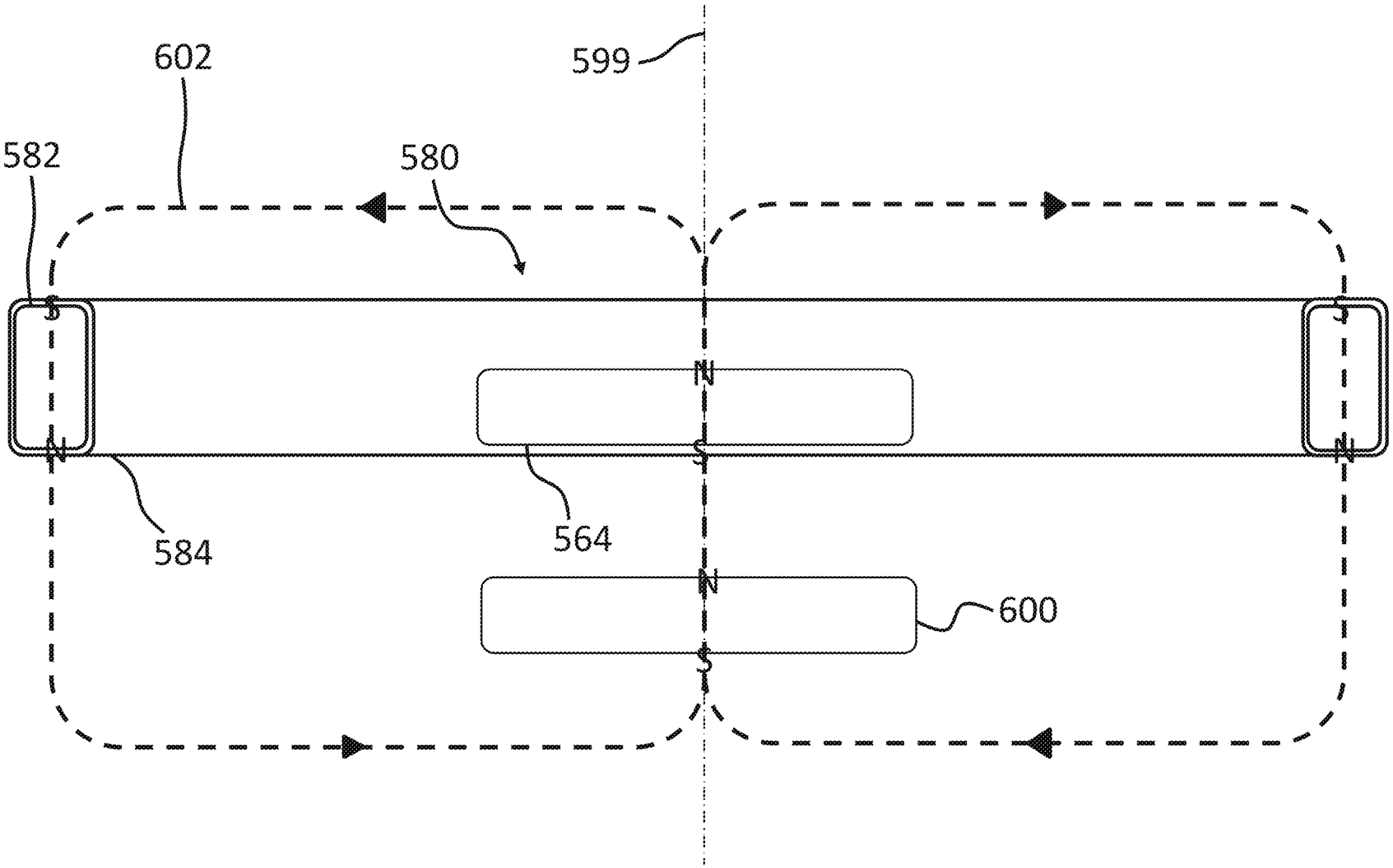
FIG. 6B depicts by way of conceptual illustration a magnetic flux that results from the utilization of the module of FIG. 5.

FIGS. 5 and 6A depict an exemplary embodiment that enables the increase in the retention force resulting from the magnetic field generated by the external componentry. Here, in this embodiment, a removable module 580 is removably attached to the external component 540, which attachment to component 540 results in an external component assembly 541. The removable module 580 includes a permanent magnet 582 located in a housing 584. In an exemplary embodiment, housing 584 and magnet 582 are ring-shaped. These components extend about the longitudinal axis 599. In an exemplary embodiment, the inner circumference of the housing 584 is configured to match the outer circumference of the housing 548 of the first sub-component 550. In an exemplary embodiment, in a scenario where there is utilitarian value with respect to increasing the strength of the magnetic field generated by the external componentry, module 580 is placed around the first sub-component 550 and attached thereto. This results in a combined generated magnetic field (the field generated by magnet 564 plus magnet 582 that is stronger or otherwise results in a greater retention force between the external magnets (582 and 564) and the implanted magnet. FIG. 6B depicts a portion of the resulting magnetic field when the external magnets in the implantable magnet interact with each other. Because of the addition of magnet 582, the resulting magnetic field creates a stronger retention force between the external component and implantable component.

The module 580 is readily attachable to the external component 540. In an exemplary embodiment, the module 580 and the external component 540 are configured such that once the module 580 is attached to the component 540, the module 580 cannot be removed. In this regard, such an embodiment can be directed towards a scenario where the external component 540 is to be customized to a given recipient, and because the external component 540 will not be used by another recipient, the customization can be achieved in a semi-permanent matter. That said, in an alternate embodiment, the module 580 is readily removable after attachments to the external component 540. In an exemplary embodiment, such can be achieved by a snap fit or an interference that between the external component 540 and the module 580. Still further, in an exemplary embodiment, the outer circumference of the external component 540 and the internal circumference of the module 580 can be threaded so that the module 580 can be screwed on to the external component 540. Any device, system, and/or method of achieving the attachment of the module 580 to the external component 540, and, in some embodiments, any device, system, and/or method of achieving the subsequent removal of the module 580 to the external component 540 (with respect to those embodiments where the module 580 is removable) can be utilized in at least some exemplary embodiments.

Figure 7:
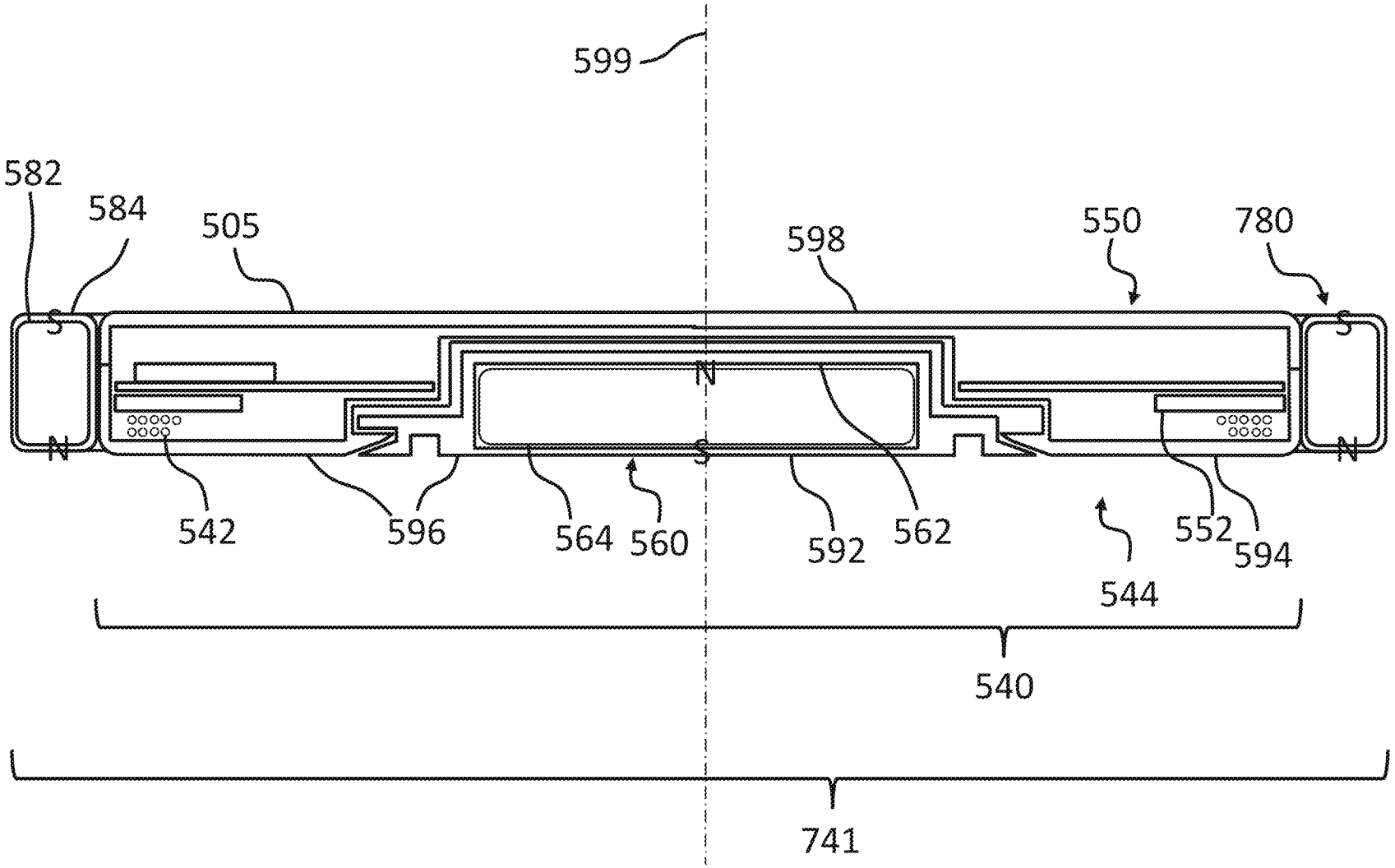
FIG. 7 depicts another exemplary embodiment of another module when utilized with the external component of FIG. 4.

Briefly, it is noted that the geometries of the module 580 can be different than that depicted in FIG. 5. In this regard, the embodiment depicted in FIG. 5 is such that the bottom surface of the module 580 in general, and the housing 584 in particular, further establishes a skin interfacing surface that is parallel with and on the same level as the skin interfacing assembly 596. In this regard, the bottom surface of the housing 584 becomes part of the skin interfacing assembly 596. Note further that in the embodiment depicted in FIG. 5, the module 580 extends above the top surface of the housing of the external component 540/the surface of the housing of the external component 540 opposite the skin interfacing side 544. This is done so as to increase the thickness of the magnet 582, and thus increase the strength of the resulting magnetic field. Conversely, FIG. 7 depicts an exemplary embodiment where the thickness of the module 580 is such that it has a value that is less than the thickness of the external component 540, as can be seen. That is, when module 780, which corresponds to module 580 detailed above, save for the differences in thickness, is attached to the external component 540 to establish external component assembly 741, the top surface and the bottom surface of module 780 is respectively located below and above the top surface and the bottom surface of the external component 540. That said, in an exemplary embodiment, the bottom surface of the module 780 can be located flush with the skin interfacing surface of the external component 540. Alternatively, and/or in addition to this, the top surface of the module 780 can be located flush with the top surface of the external component 540 (the side opposite the skin interfacing side).

Also, while the embodiments of FIGS. 6A and 7 depict a module 580 having only one magnet, in alternative embodiments, two or more magnets can be located in the module. Note also that while the embodiment of FIGS. 5 and 7 depict only a single module located about the external component 540, in an alternate embodiment, two or more modules can be utilized. In some embodiments, the modules can be such that they lie one on top of the other with respect to position along the longitudinal axis 599. In some embodiments, the modules can be concentric with each other such that one module envelops the other module. Combinations of these can be utilized as well. Such embodiments can have utilitarian value with respect to providing a system that enables the resulting magnetic force generated by the external componentry to be "fine-tuned" by adding additional modules. That is, instead of having one module that increases the retention force by a given value, a plurality of modules can be utilized to increase the retention force in increments. Note also that even in embodiments that utilize a single module, in an exemplary embodiment, a plurality of different modules can be provided, one of which is selected so as to "fine-tune" the retention force.

In view of the above, there is an external component of a prosthesis (e.g., the assembly of 541 or 741), comprising, a first module (e.g., the external component 540) including a functional component (e.g., the processor therein and first structure including magnetic material (e.g., magnet 564, although in other embodiments, the magnetic material is a ferromagnetic material that is not a magnet (e.g., instead a soft magnetic material—more on this below)). The first module is configured to be retained against skin of a recipient via a magnetic field at least partially generated by a permanent magnet implanted in a recipient (e.g., magnet 600) that interacts with the magnetic material of the first structure, the first module including a skin interfacing surface configured to interact with skin of the recipient when the first module is retained against the skin of the recipient. This external component further includes a second module (e.g., module 580 or 780) including a second structure including magnetic material (magnet 582, although in other embodiments, the magnetic material is a ferromagnetic material that is not a magnet (e.g., instead a soft magnetic material—more on this below)) configured to enhance magnetic retention of the external component to skin of a recipient. In some embodiments, the second module is removably attached to the first module and visible from an outside of the external component when the second module is attached to the first module and when viewed from a side opposite the skin interfacing side (e.g., when looking downward along the longitudinal axis 599 in FIG. 5). This as opposed to placement of the module on the side of the external component 540 at a location where the module cannot be seen. In this regard, this embodiment covers the annular ring-shaped module 580 of FIG. 5, and embodiments where a module or the like is located on the top surface (side 546). In an exemplary embodiment, there is no module located on side 544 or beneath (relative to the longitudinal axis 599) surface 592 and/or surface 594. It is noted that in an exemplary embodiment, not including the surfaces of the module that face the external component (e.g., the inner circumference of the housing of the module 780), at least about 20%, 25%, 30%, 35%, 40%, 45%, 50%, 55% or 60% or 70% or more of the surface area of the module can be seen when viewed from the side opposite the skin interfacing side and/or when looking downward along the longitudinal axis 599 in FIG. 5. In an exemplary embodiment, at least about 20%, 25%, 30%, 35%, 40%, 45%, 50%, 55%, 60%, 65%, 70%, 75%, 80%, 85%, 90%, 95% or 100% of the module 580 or 780 with respect to location along the longitudinal axis is above the skin interfacing surface of the external component (e.g., in FIG. 5, 100% of the module 580 is located above the skin interfacing surface). This as opposed to a module that is located on the skin interfacing side.

In an exemplary embodiment, the second module extends about a majority of the first module (in the embodiment of FIG. 5, all the way around, although in other embodiments, second module can be a "C" shaped) with magnets spaced symmetrically about the longitudinal axis, where embodiments can include more than one magnet in the second module such that the symmetry can be obtained without a housing or structure that extends completely about the external component. To be clear, the second module can be a ring-shaped module extending about the first module. In the exemplary embodiment of FIGS. 5 and 7, the second module has an inner circumference that is concentric with an outer circumference of the first module.

The ring can include a single annular magnet, can include a plurality of annular magnets, can include a plurality of magnets that are arrayed about the longitudinal axis 599 in a symmetrical manner (while in other embodiments, in a non-symmetrical manner). Any arrangement or configuration of magnet(s) that can enable the teachings detailed herein can be utilized in at least some exemplary embodiments.

Note also that the second module can extend over the first module. Some additional features of such will be described below. However, it is noted that while the embodiment depicted in FIGS. 5 and 7 are such that the housing 584 extends about the longitudinal axis/around the outer circumference of the external component 540, in some alternative embodiments (or in addition to this), the structure of the second module can extend across the top of the external component so as to position the magnet(s) on the lateral sides of the external component 540.

In an exemplary embodiment, the thickness (height—distance along the longitudinal axis) of the magnet 564 is no more than about 4, 5, 6, 7, 8, 9, 10, 11 12, 13, 14, 15 mm or any value or range of values therebetween in about 0.1 mm increments. In an exemplary embodiment, the maximum space inside the external component 540, with respect to distance along the longitudinal axis, is about 5, 6, 7, 8, 9, 10, 11, 12, 13, 14, 15, 16 mm or any value or range of values therebetween in about 0.1 mm increments. In an exemplary embodiment, the maximum diameter of magnet 564 is about 10, 11, 12, 13, 14, 15, 16, 17, 18, 19, 20, 21, 22, 23, 24, 25, 26, 27, 28, 29 mm or any value or range of values therebetween in about 0.1 mm increments.

It is also noted that in an exemplary embodiment, an outer circumference of the first sub-component 550 in particular, and the external component 540 in general, has a diameter about 20, 21, 22, 23, 24, 25, 26, 27, 28, 29, 30, 31, 32, 33, 34, 35, 36, 37, 38, 39 or 40 mm or any value or range of values therebetween in about 0.1 mm increments, and the addition of module 580 increases the respective diameter by 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.25, 3.5, 3.75, 4.0, 4.25, 4.5, 4.75, 5, 5.25, 5.5, 5.75, 6.0, 6.25, 6.5, 6.75, 7.0, 7.25, 7.5, 7.75, 8.0, 8.5, 9.0, 9.5, 10, 10.5, 11, 12, 13, 14, 15 mm or more or any value or range of values therebetween in about 0.1 mm increments. Note that these values could be the maximum diameter, the minimum diameter (all on planes normal to the longitudinal axis), a mean diameter, a median diameter and/or a modal diameter.

It is noted that while the embodiments detailed above have been described in terms of an assembly of multiple components (a housing, a magnet, etc.), in an alternate embodiment, a "raw" magnet can extend about the external component 540 without a housing thereabout, perhaps painted or the like.

It is noted that in some embodiments, the module 580 or 780 is such that the permanent magnet thereof, when used with the external component 540, is configured such that the permanent magnet of the module is misaligned with the implanted magnet 600 when the external component interacts with the magnetic field of the implanted magnet. That is, the magnet of the module 580 or 780 does not mirror the implant magnet. Some additional details of this are described below.

Also, as can be seen, the magnets of the modules 580 and 780 are positioned such that the longitudinal axis 599 of the button sound processor does not extend therethrough, but does extend through the magnet of the component 540. In an exemplary embodiment, the magnet of the module is the farthest component of the assembly away from the longitudinal axis, save for a housing containing the magnet (in embodiments that utilize such). In an exemplary embodiment, the longitudinal axis 599 extends through no portion of the module 580 or 780.

Figure 8:
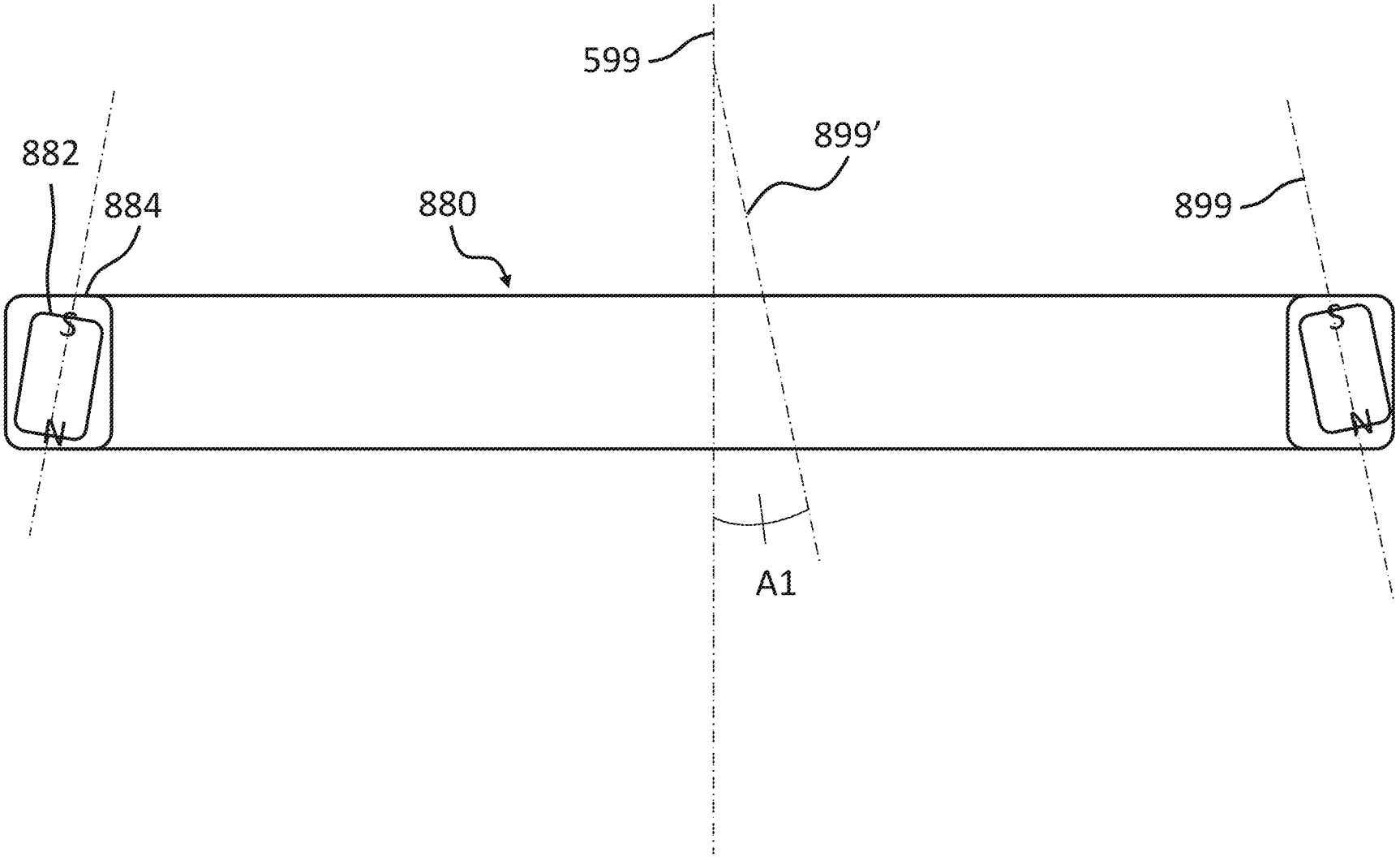
FIGS. 8 and 9A depict yet other exemplary embodiments of other modules that are usable with the external component of FIG. 4.

FIG. 8 presents an alternate embodiment of a module 880 that can be used in some embodiments with the external component 540 to increase the retention force between the external component and implantable component. Here, module 880 includes a magnet 882 that is canted, or, more accurately, has a north-south pole that is canted relative to the longitudinal axis 599. In the embodiment depicted in FIG. 8, the magnet 882 is a ring magnet that extends completely about the longitudinal axis 599, and is housed in a housing 884, which housing presents an interface between the magnet and the outer circumference of the external component 540. In some embodiments, a plurality of magnets 882 is arrayed about axis 599. In the embodiment depicted in FIG. 8, the angle of the north-south pole of the magnet(s) relative to the longitudinal axis 599 is about 30 degrees. FIG. 8 depicts angle A1, which is an angle between the longitudinal axis 599 and a line 899', which is a proxy for the local north-south axis (i.e., the axis 899 is parallel to and lying on the same plane as the angle 899'). In an exemplary embodiment, A1 is about 1, 2, 3, 4, 5, 6, 7, 8, 9, 10, 15, 20, 25, 30, 35, 40, 45, 50, 55, 60, 65, 70, 75, or 80 degrees, or any value or range of values therebetween in about 0.1 degree increments (e.g., about 20.4 degrees to about 44.2 degrees, about 30.5 degrees, etc.).

In an exemplary embodiment, the increase in retention force by utilizing the oblique angle is increased by about 1%, 2%, 3%, 4%, 5%, 6%, 7%, 8%, 9%, 10%, 11%, 12%, 15%, 20%, 25%, 30%, 35%, 40% or more or any value or range of values therebetween in 0.1% increments, all things being equal.

While the embodiment of FIG. 8 depicts a magnet having a local outer cross-section that is generally symmetric about the north-south pole, in other embodiments, such as that depicted in FIG. 9, where the magnet(s) 982 of the module 989 has a local outer cross-section that is asymmetrical, which asymmetry cants the north-south axis relative to the longitudinal axis 599 as can be seen. Housing 984 provides an interface between the magnet 892 and the outer circumference of the external component 540.

Any arrangement that enables the north-south axis of the magnet to be oblique relative to the longitudinal axis 599 can be utilized in at least some exemplary embodiments.

In view of the above, it can be seen that in an exemplary embodiment, there is a body piece configured for transcutaneous communication with an implanted component implanted in a recipient, comprising an inductance coil, a first permanent magnet, and a second permanent magnet. In some embodiments, the first permanent magnet (e.g., magnet 564) has a north-south polarity that is parallel to a longitudinal axis (599) of the body piece. The second permanent magnet (e.g., 882 or 982) has a north-south polarity at an oblique angle relative to the north-south polarity of the first permanent magnet. The body piece is configured such that the second permanent magnet is readily removably connected at least indirectly to the first permanent magnet. In some embodiments, the body piece includes a first housing directly or indirectly supporting the first permanent magnet and directly or indirectly supporting the inductance coil (this is the first sub-component 550, or more accurately, the housing of the first sub-component 550, which supports the permanent magnet and the inductance coil). The body piece includes a second housing containing the second permanent magnet, the second housing being removably connected to the first housing at an outside thereof.

Figure 9A:
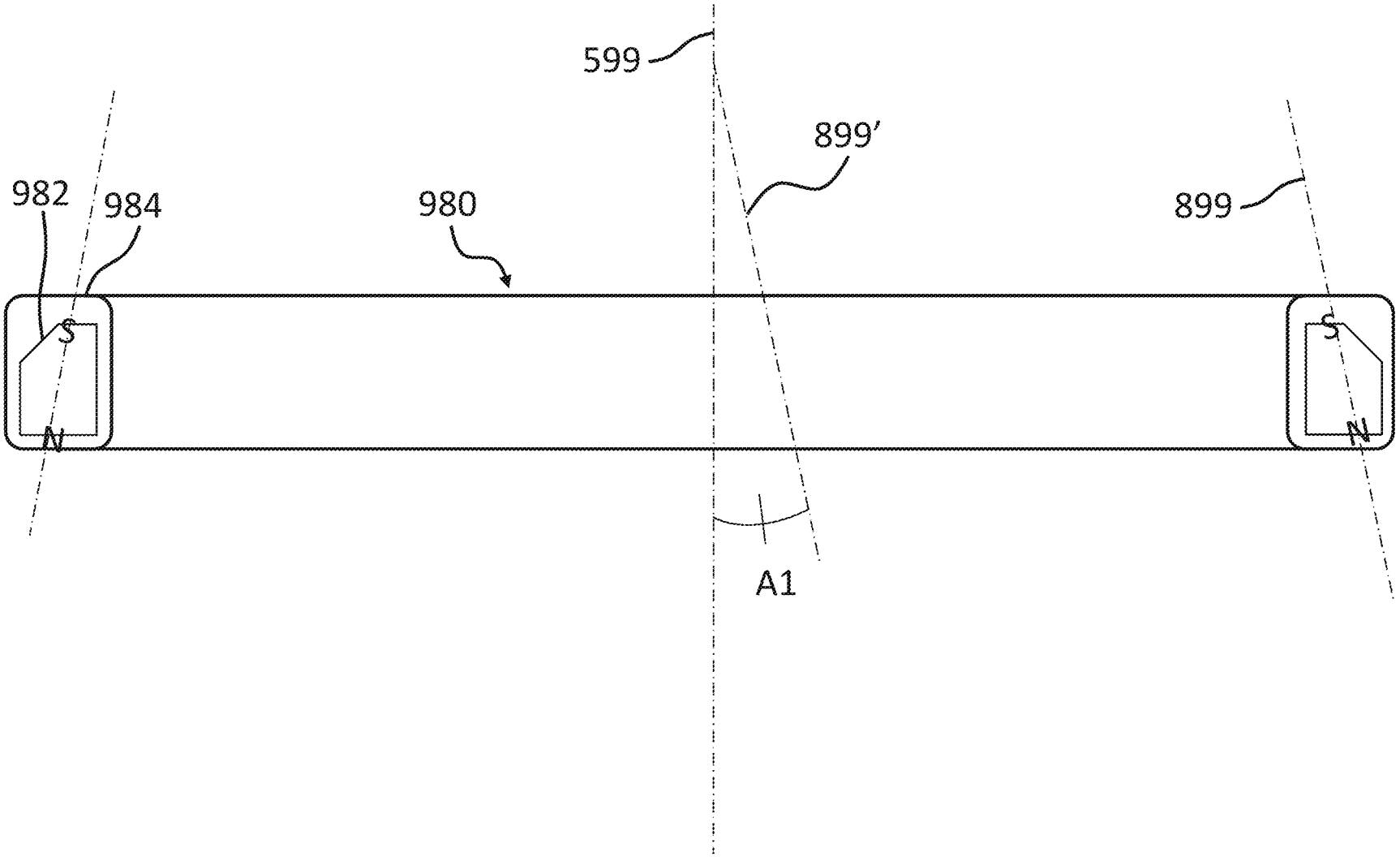

In the embodiment of FIGS. 8 and 9A, the magnet 882 or 982 can be a ring magnet that encircles the first permanent magnet, and a cross-section of the body piece lying on a plane lying on the longitudinal axis (e.g., the plane of FIGS. 8 and 9A) such that the north-south pole of the second permanent magnet has an equal and opposite angle on either side of the longitudinal axis relative to the longitudinal axis (i.e., angle A1 is the same but opposite, as can be understood from FIGS. 8 and 9A). That said, in an exemplary embodiment, there are a plurality of permanent magnets in/a part of the module that is attached to the external component 540, wherein respective north-south polarities of the second permanent magnets are such that the angle between the longitudinal axis and the respective north-south axis of the second permanent magnets is at least about the same with respect to normalized location about the longitudinal axis. In this regard, while the embodiment of FIG. 8 is depicted as a ring magnet that extends completely about the longitudinal axis 599, alternatively, the magnet can be segmented, with gaps between each segment (or with the segments directly abutting one another). If the cross-section on the left of the axis 599 represented one segment and the cross-section on the right of axis 599 represented another segment, the angle between the longitudinal axis of the respective north-south axis would be the same with respect to normalized location about the longitudinal axis (i.e., with respect to position about the longitudinal axis—in a scenario where there were four magnets each subtending an angle of exactly 90°, and the cross-sectional views of FIGS. 8 and 9A constituted cross-sections through the exact center of two of those four magnets, the normalized locations about the longitudinal axis of the other two would be the plane extending normal to the page of FIGS. 8 and 9A).

Figure 9B:
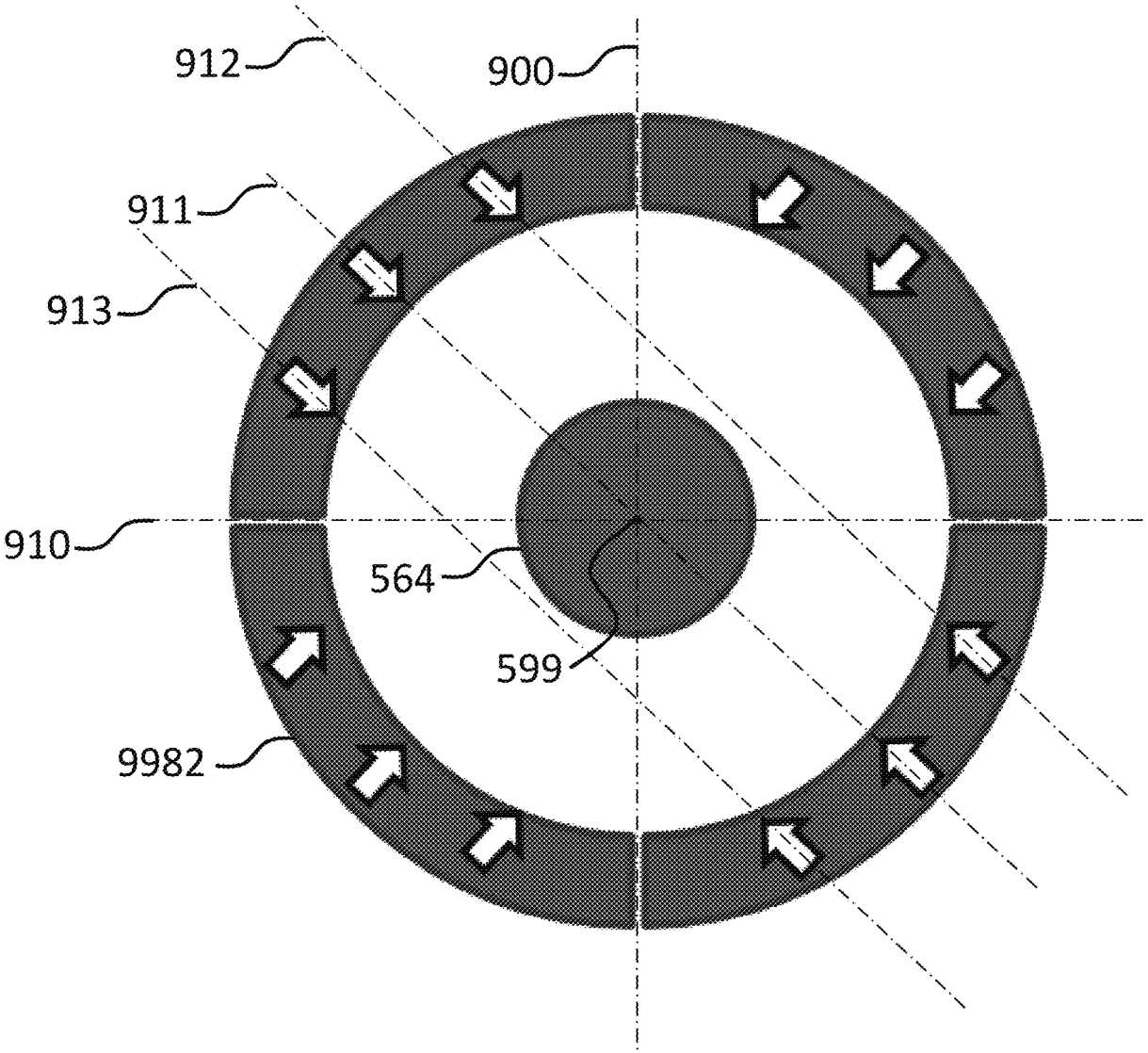
FIGS. 9B and 9C are top views depicting exemplary embodiments of alternate embodiments of modules that can be utilized the external component of FIG. 4.

FIG. 9B depicts an embodiment with a segmented magnet assembly of the second module (where here, it is probable that the magnets would be housed in a housing (not shown), although in some embodiments, the magnets could be held together in a different manner without a housing). As can be seen, there are four (4) magnets 9982 that collectively extend about the longitudinal axis 599 (which is represented by the dot at the intersection of axis 900 and 910, each of which is 90° offset from each other) and magnet 564 of the external component 540. In this embodiment, it is noted that the magnetic field of each of the magnet segments 9982 is such that the respective north-south polarity of the magnets is such that the polarity is not always "focused" on the longitudinal axis 599, but instead is such that the north-south polarities lie on respective planes that are parallel to one another. This is represented by the arrows of FIG. 9B, and the lines 911, 912 and 913, each of which are lines on planes that are parallel to the longitudinal axis 599 and parallel to one another. That is, FIG. 9B depicts a plurality of permanent magnets 9982 in/a part of the module that is attached to the external component 540, wherein respective north-south polarities of the second permanent magnets are such that the average angle between the longitudinal axis and the respective north-south axis of the respective second permanent magnets is at least about the same with respect to normalized location about the longitudinal axis from magnet to magnet.

In view of FIGS. 8 and 9A, when such is utilized with the embodiment of FIG. 4, it can be seen that in some embodiments, with respect to respective cross-sections of the first permanent magnet and the second permanent magnet lying on a plane on the longitudinal axis, the outer shapes of the respective cross-sections are at least one of different (e.g., one is rectangular shaped and the other is not rectangular shaped) or rotated relative to one another (as in FIG. 8).

Figure 10:
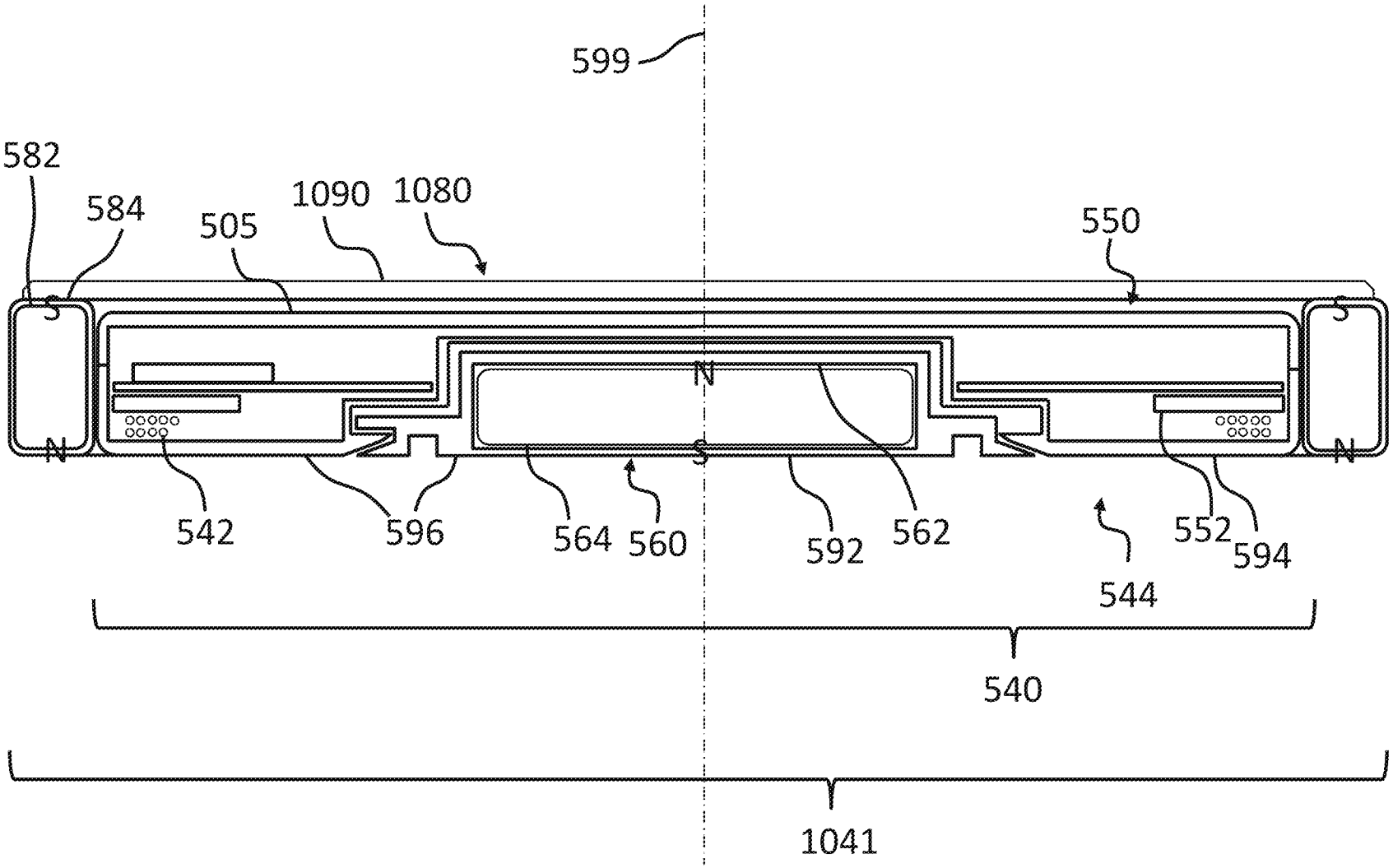
FIG. 10 depicts a schematic of another exemplary module utilized with the external component of FIG. 4.
Figure 11:
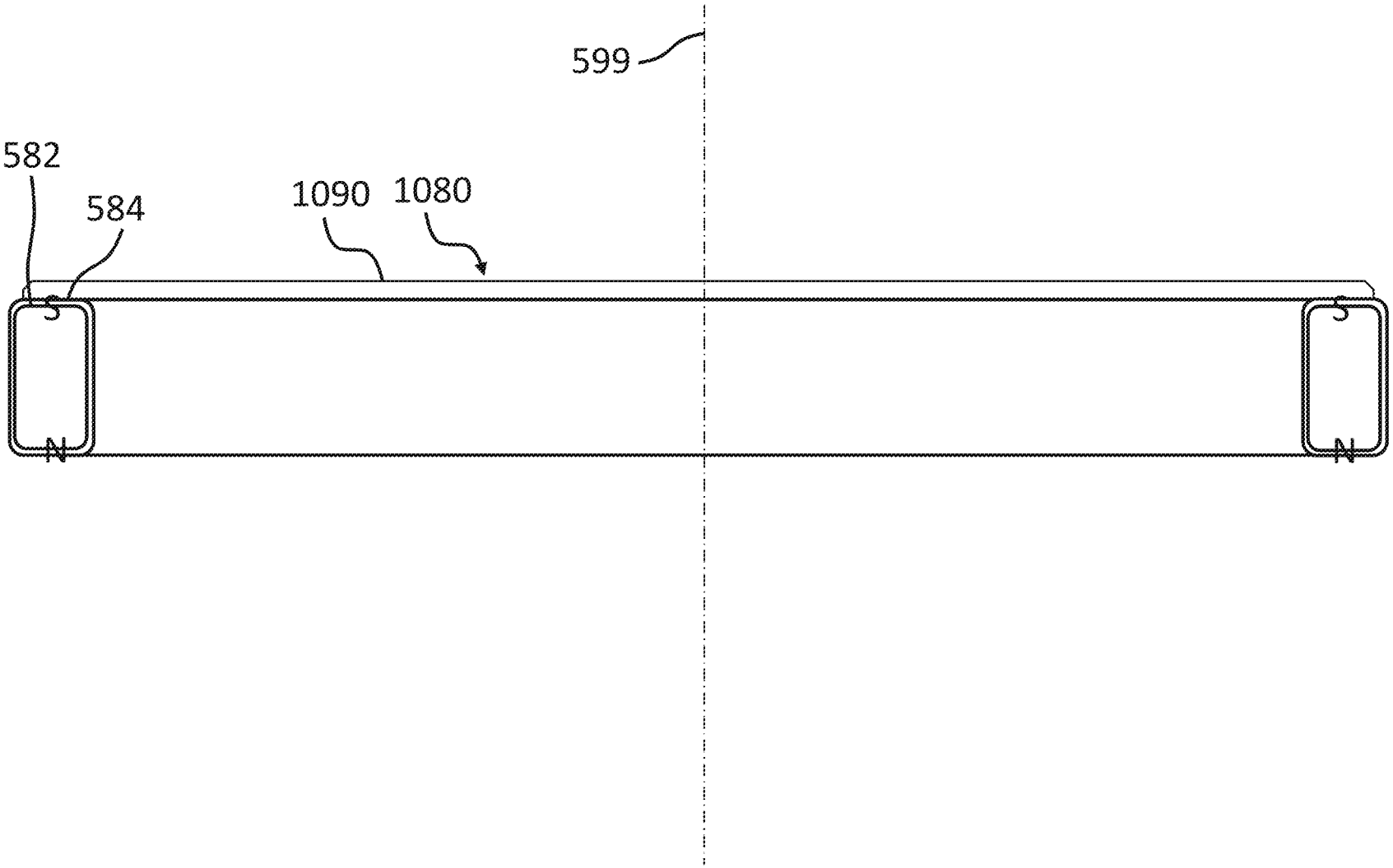
FIG. 11 depicts a cross-sectional view of the module depicted in FIG. 10.

FIGS. 10 and 11 depict an alternate embodiment of a module 1080 that fits around the external component 540 to establish an assembly 1041. Here, the module 1080 includes the components of module 580, with the addition of cross-connection 1090. In an exemplary embodiment, cross connection 1090 is utilized to hold separate magnets 582 located in separate housings 584 in place. In an exemplary embodiment, a connection can be established between crossmember 1090 and the housing of the external component 540. In an exemplary embodiment, crossmember 1090 is a plastic beam that extends from one side of the module 1080 to the other side of the module 1080. In the embodiment depicted in FIG. 10, there are two magnets 582 symmetrically spaced about the longitudinal axis 599. In an alternate embodiment, there are four magnets 582 symmetrically spaced about the longitudinal axis 599. Indeed, in an exemplary embodiment, these magnets can correspond to magnets 9982 of FIG. 9B, and crossmember 1090 can take the form of a "+" shaped structure when viewed from the frame of reference of FIG. 9B. In still alternate embodiments, crossmember 1090 can be a plate, such as a circular plate, that extends in all directions about axis 599. Such can be utilized in the case of a ring magnet that contiguously extends about axis 599. That said, such a circular plate can be utilized with respect to the segmented magnets. Still further, such a circular plate can be utilized with respect to segmented magnets, such as the close-pack arrangement of FIG. 9B, and a more spread-out arrangement (e.g., 2 magnets, 3 magnets, 4 magnets, 5, 6, 7, 8 or more, that are symmetrically arranged about the longitudinal axis, each subtending an angle of about 10, 15, 20, 25, 30, 35, 40, 45, 50, 55, 60, 65, 70, 75 or more degrees, etc.). Corollary to this is that the cross beam concept can be utilized with the ring magnet that contiguously extends about the longitudinal axis. Any combination can be utilized with any other combination providing that such can be enabled.

Figure 9C:
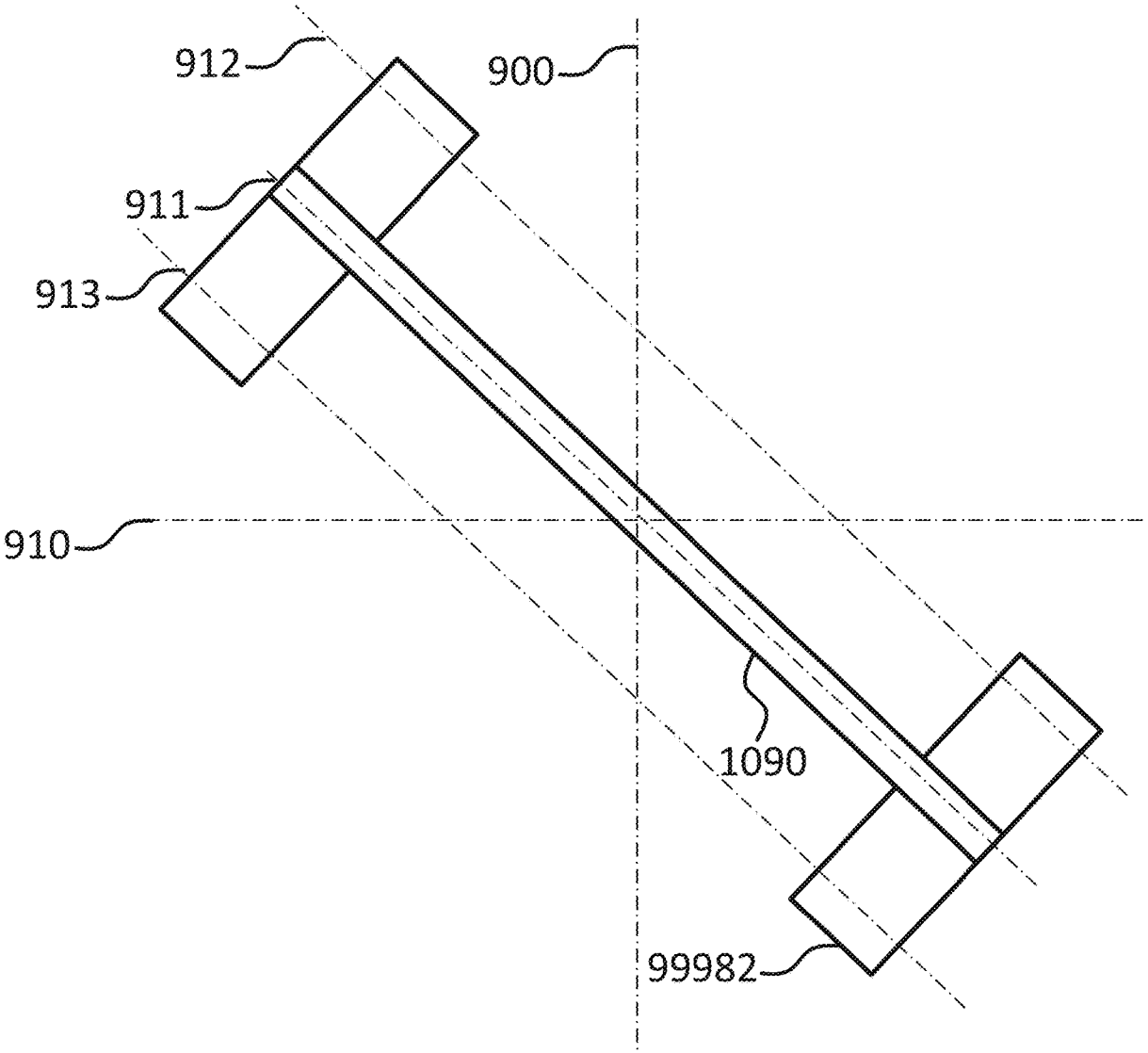

It is briefly noted that while the embodiments detailed above have focused on curved magnets, where the inner circumference of the magnets generally has the same distance from the longitudinal axis 599 with location there about, in some alternate embodiments, the magnets can be bar magnets that are not curved, an example of this is depicted in FIG. 9C, along with the cross-beam. That is, straight, non-curved magnets 99982 can be utilized in at least some exemplary embodiments. It is noted that while the embodiment of FIG. 9C depicts two magnets, in an alternate embodiment, three or more magnets can be utilized. Moreover, in an exemplary embodiment, a plurality of modules 1080 can be utilized in combination with one another, where the crossmembers 1090 are configured to interface with one another or otherwise avoid interfering with one another. That is, in an exemplary embodiment, a first module 1080 can be applied and if the resulting retention force is not sufficient, a second module can be applied to increase the resulting retention force.

Moreover, in an exemplary embodiment, modules 1080 can be utilized that have different size magnets/different magnetic fields generated by the magnets, and a given module can be selected depending on the desired/needed retention force.

Figure 12:
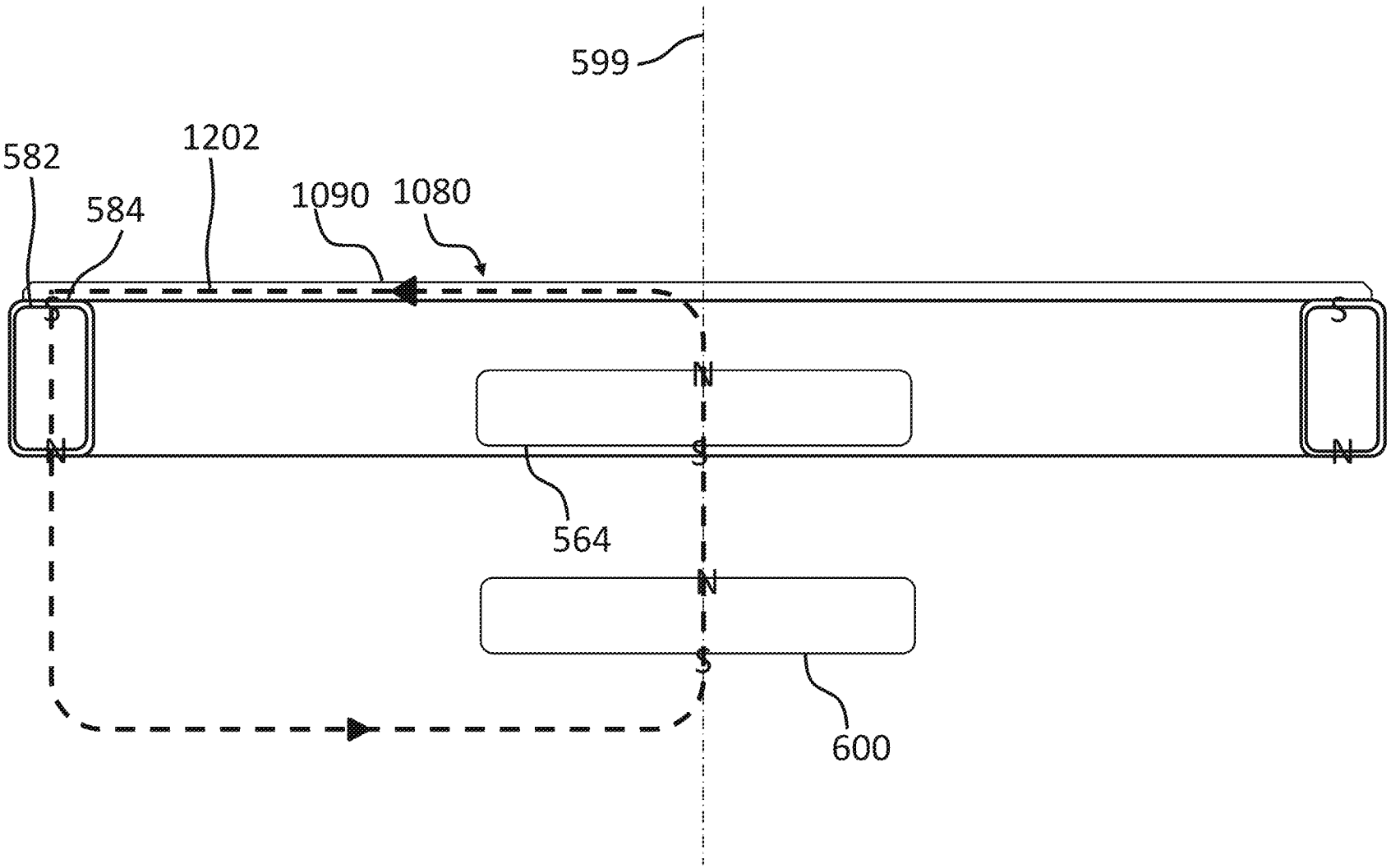
FIG. 12 depicts by way of conceptual illustration and magnetic flux that results from utilization of the module of FIG. 11.

It is noted in an at least some exemplary embodiments, crossmember 1090 can be made of a magnetic material that conducts the flux generated by the magnets in a manner different from that which would otherwise be the case if crossmember 1090 was made of a non-magnetic material (e.g., such as plastic). It is noted that in an exemplary embodiment, crossmember 1090 can comprise a housing made of nonmagnetic material in which is housed a component made of magnetic material. In an exemplary embodiment, soft iron is utilized. Any type of material that will channel the magnetic field generated by the magnets can be utilized. FIG. 12 depicts a portion of an exemplary magnetic field 1202 that results from the utilization of the module 1080 when attached to an external component 540 when the combination of the two is placed against skin of the recipient. Any type of material that can conduct a magnetic flux in a manner that achieves higher retention force, all other things being equal, can be utilized (along with such that is the case without all other things being equal).

As can be seen in FIG. 12, the upper portions of the resulting magnetic flux 1202 are for the most part contained in the crossmember 1090. The magnetic field is channeled to the pole of the magnet 582. This is as opposed to the scenario seen in FIG. 6B, where the magnetic field extends upward a greater distance, or at least the magnetic flux is not as concentrated as is the case in FIG. 12.

Thus, in view of the above, with respect to FIG. 12, in an exemplary embodiment, there is a button sound processor, comprising a first component including a first permanent magnet (e.g., the external component 540 with magnet 564) and second component including soft magnetic material, (e.g., module 1080 with crossmember 1090), wherein the second component is configured to direct a magnetic flux at least partially generated by the first permanent magnet (and/or the implanted magnet) differently from that which would exist in the absence of the second component via the soft magnetic material. As can be seen, the second component includes a second permanent magnet 582. In an exemplary embodiment, the button sound processor is such that the second component is configured such that when the second component is connected to the first component, the poles of the first permanent magnet are parallel with the poles of the second permanent magnet and the soft magnetic plate channels the magnetic field at least partially generated by the first permanent magnet and the second permanent magnet outboard from the first component. However, as will be detailed below, in an exemplary embodiment where the teachings detailed above with respect to the magnets having a canted polarity are utilized, the poles of the second permanent magnet(s) are not parallel.

Figure 13:
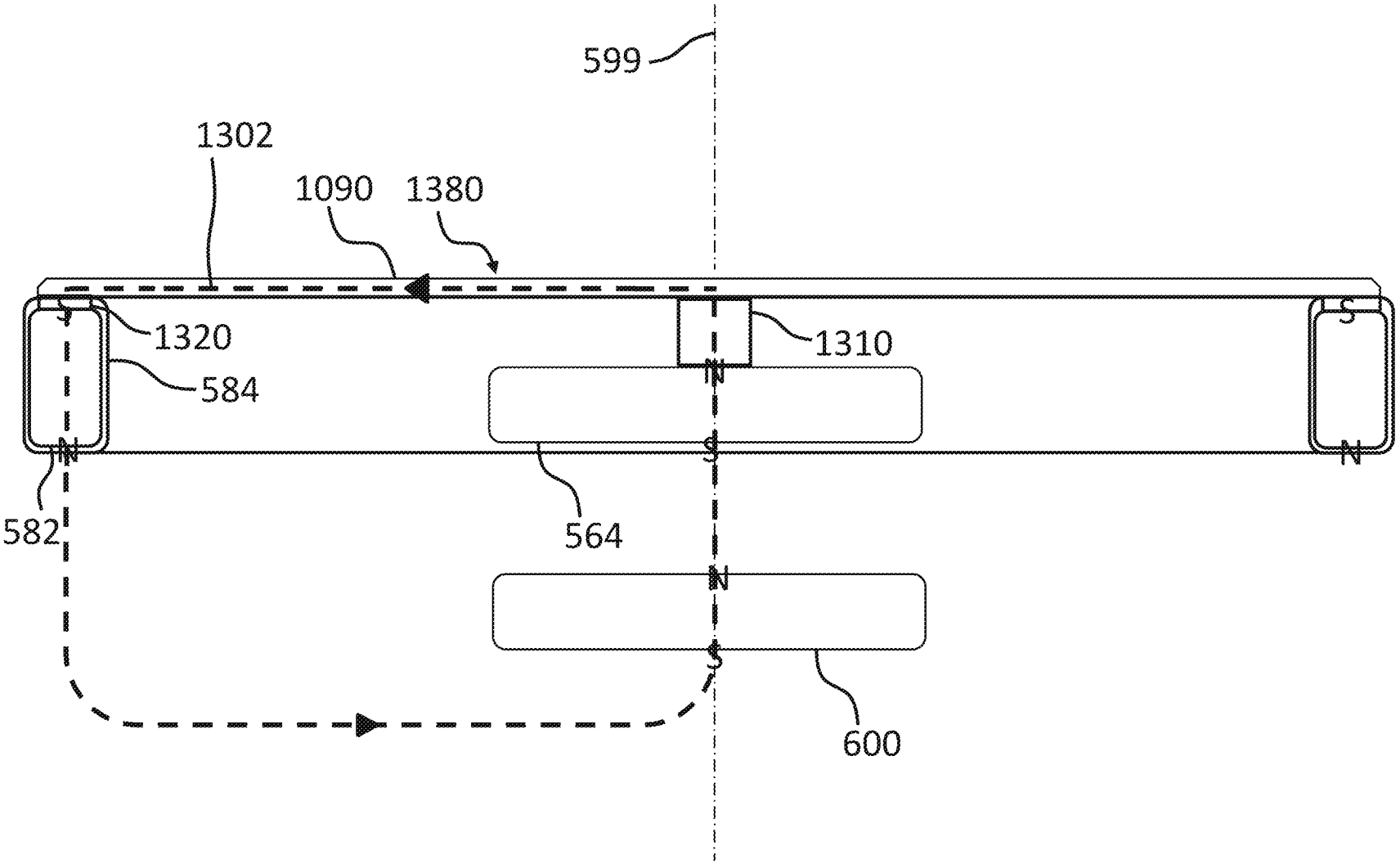
FIG. 13 depicts a variation of the module of FIG. 10.

The embodiment of FIG. 12 depicts the crossmember 1090 being spaced away from the magnets 564 and 582 with respect to structure that is conducive to channeling or otherwise conducting magnetic flux in a manner different from that which results from structure that creates an air gap. That is, in the embodiment of FIG. 12, there are gaps between the crossmember 1090 and the magnets 582 and 564. Referring now to FIG. 13, there is presented an exemplary module 1380 that utilizes crossmember 1090 in addition to magnetic flux conductors 1320 and 1310 (which can be in the form of soft iron cylinders or plates, etc.). Here, in an exemplary embodiment where the crossmember 1090 is completely made of a magnetic material (or, in an alternate embodiment, where the structure 1090 is covered or otherwise sheathed in a nonmagnetic material structure, thus establishing a housing about the structure 1090), the magnetic material of structure 1090, 1310 and 1320 is in direct contact with the magnets of the external assembly. That is, there is no air gap between the permanent magnets and the magnetic structure of the module 1080. In this regard, in an exemplary embodiment, the housing of the first sub-component 550 and the housing of the second sub-component 560 can have an opening through which structure 1310 can pass to reach magnet 564. That said, in an alternative embodiment, there can be air gaps between the magnetic structure and the permanent magnets. By way of example only and not by way of limitation, a housing of the second sub-component 560 can be located between structure 1310 and magnet 564. Still further by way of example only and not by way of limitation, a housing wall of the first sub-component 550 can be located between structure 1310 and magnet 564. By way of example only and not by way of limitation, an opening can be present in the top of the first sub-component 550 that extends towards the permanent magnet 564 in which is received structure 1310. It is also noted that air gaps can exist between the outboard magnets and the crossmember 1090, such as may be the case when the outboard magnets are located in a housing of plastic or the like, where the crossmember 1090 directly contact the plastic and there is no through structure 1320 of magnetic material. Any arrangement that can enable the teachings detailed herein can be utilized in at least some exemplary embodiments.

Thus, in an exemplary embodiment, there is a module that includes the second structure detailed above, where the second structure is a conductor made of soft magnetic material extending from a first side of the first module to a second side of the first module opposite the first side (as seen in FIG. 13), wherein the soft magnetic conductor conducts magnetic flux flowing through a center of the first module to locations outboard of the first module and/or visa-versa (depending on the direction of the magnetic flux—in some embodiments, the magnet 564 has a polarity that is reversed from that shown in FIG. 13 as is also the case with magnet 600, and thus the polarity of magnet 582 would also be reversed from that shown in FIG. 13). As seen in FIG. 13 in view of FIG. 4, the second module includes a permanent magnet located at an end of the conductor at an outboard location relative to the first module. Thus, in some embodiments, the module that is attached to the external component 540 has a structure in the form of a high saturation soft magnetic component that concentrates a magnetic flux from the permanent magnet of the second module (which is the case irrespective of the alignment of the north-south pole (north on top or north on bottom).

Figure 14A:
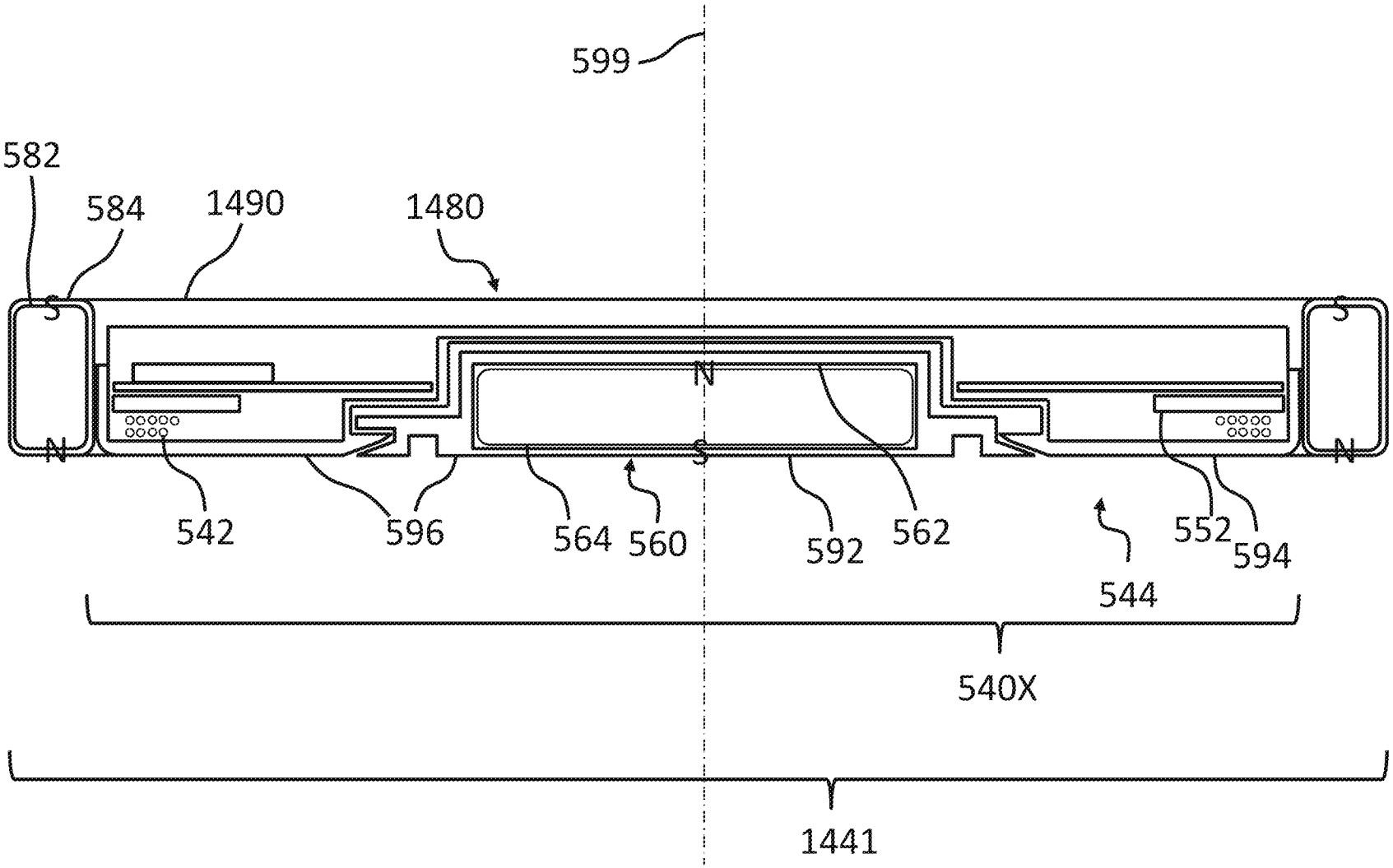
FIGS. 14A, 14B and 14C depict alternate embodiments of respective modules having utilitarian value according to some embodiments.

Note also that in some embodiments, the component that includes magnets 582 (or non-permanent magnet magnetic material—more on this below) is a replacement cover for the first sub-component 550. That is, in an exemplary embodiment, the top of the housing of the first sub-component 550 (e.g., the portion of the housing above seam 505) can be removed and replaced with the module 1080, where structure 1090 is a circular plate that covers the now open housing, thus shielding the internal components in a manner concomitant with the portion of the housing that was removed. FIG. 14A depicts an exemplary embodiment where the top portion of the housing of the first sub-component 550 removed, thus resulting in external component 540X, and replaced with module 1480, that includes structure 1490 that replaces the housing wall that was removed, which structure connects to the housing 584 including the magnet 582. Indeed, in an exemplary embodiment, module 1080 can include the exact same connection components that were utilized with the portion of the housing that was removed to connect that portion of the housing to the bottom portion of the housing of sub-component 550. Thus, in an exemplary embodiment, the soft magnetic plate is a cover of the external component facing away from a skin interfacing side of the external component. That is, in an exemplary embodiment, internal components, such as the electronics of the button sound processor, the processor, a printed circuit board, etc., housed in the housing of the external component, now directly face, without any obstruction or intervening components, the structure of the module 1080, whereas previously, these components instead faced the portion of the housing above seam 505 that is now removed. Such can have utilitarian value with respect to enabling the structure 1310 to be placed closer to the magnet 564/reducing the width of any air gap that is located between structure 1310 and magnet 564, and/or reducing the height/projection away from the skin of the external component. Indeed, even without structure 1310, where instead there is only a plate of magnetic material 1090 which now establishes the top of the housing, because there is no intervening housing wall, and the plate of magnetic material 1090 can now be located where that housing wall was previously located, the width of the air gap is thus reduced (the gap between the plate 1090 and the magnet 564). While the embodiment of FIG. 14A depicts a different type of housing wall than that which was present in FIG. 4, in some exemplary embodiments, the module 1080 is a combination of the top portion of the housing of the first sub-component 550 (the portion above seam 505), albeit made of a magnetic material that is conducive to channeling the magnetic flux, and the magnets 582 (although in some embodiments, as will be described in greater detail below, the magnets 582 are not present, and, instead, the second component/the module attached to the remaining portion of sub-component 550 is devoid of any permanent magnets). Note also that in some embodiments, the concept of utilizing the module as a cover for the components in first sub-component 550 can be applied without the utilization of a magnetic material to channel the magnetic flux. In this regard, with respect to FIG. 5, the top portion of the housing can be permanently connected to the housing 584 such that removal of the top portion of the housing from the bottom portion of the housing also removes the housing 584, and thus the magnet 582 therein. Additional details of the concept of using the module as a cover will be described below.

Figure 14B:
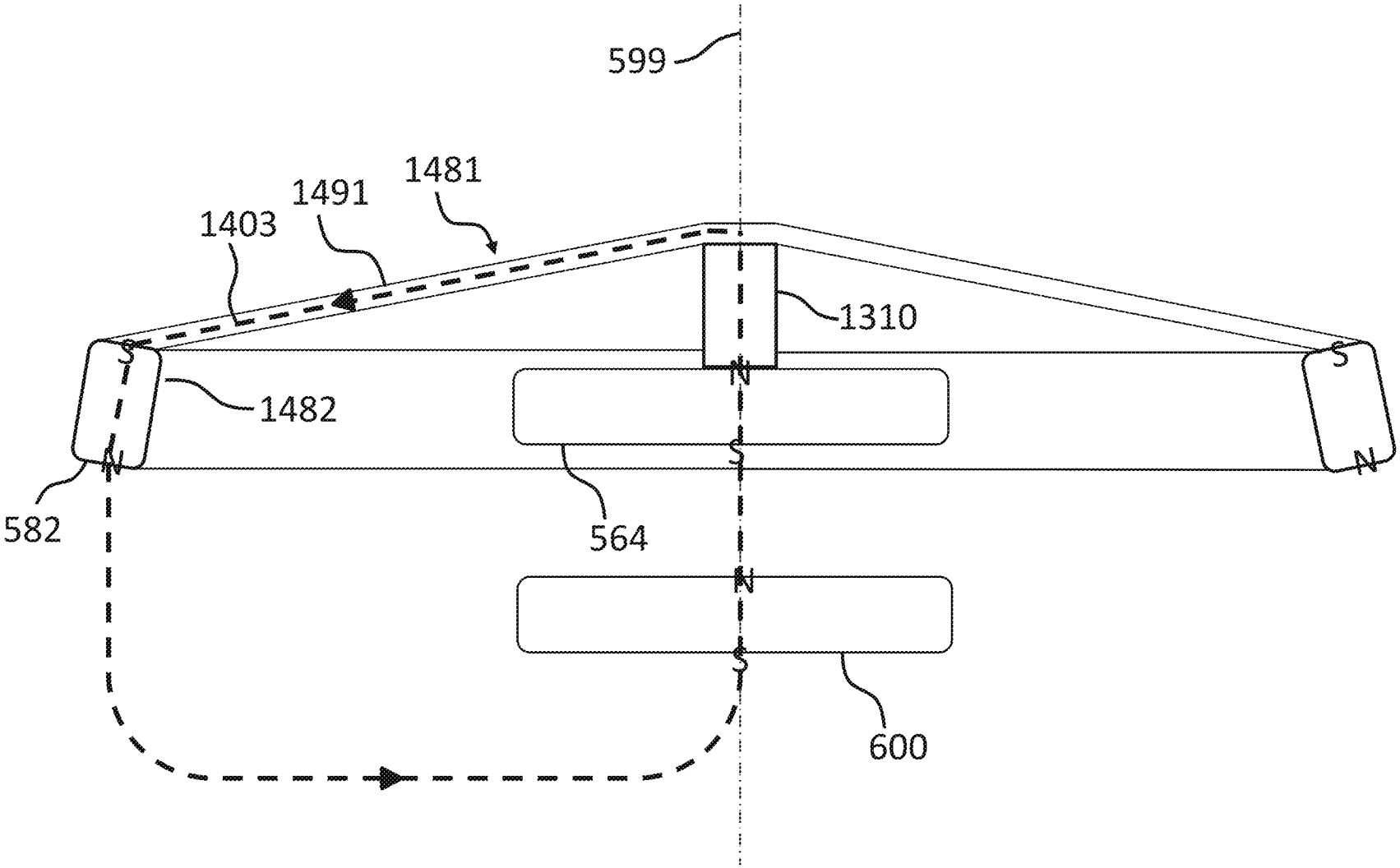
Figure 14C:
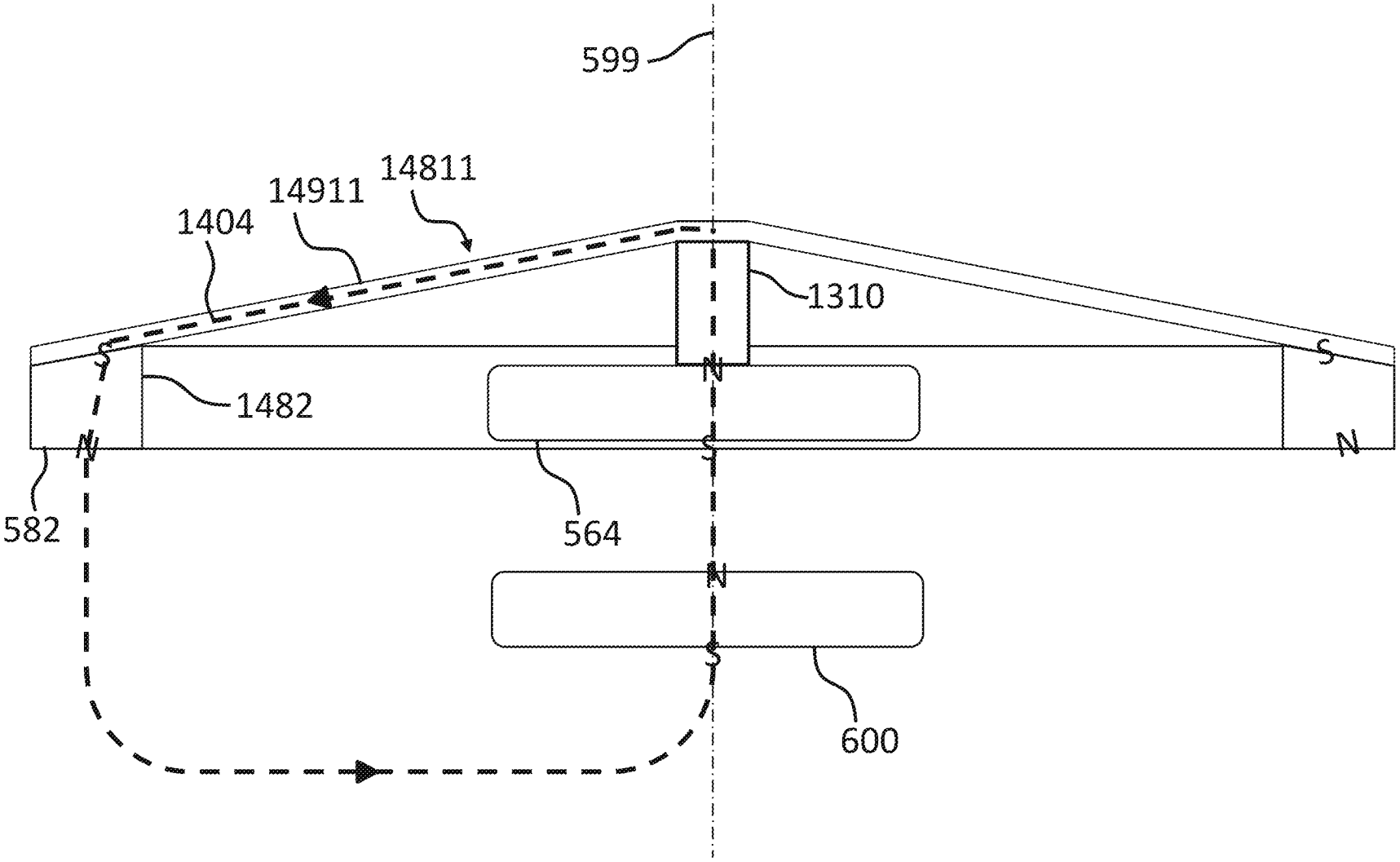

Still further in view of the above, it is again noted that the soft magnetic material can be in the form of a plate extending outboard from the first permanent magnet. In an exemplary embodiment, where the features of the embodiment of FIG. 12 are combined with the features of the embodiments of FIGS. 8 and 9A, the second permanent magnet has a north-south pole canted relative to a north-south pole of the first permanent magnet. This is seen in FIG. 14B, where module 1481 includes structure 1491 that channels the magnetic flux 1402 as is depicted by way of example only and not by way of limitation. In the embodiment of FIG. 14B, structure 1491 is a thin structure extending outboard from the first permanent magnet 564 to the second permanent magnet 582. In this regard, in an exemplary embodiment, structure 1491 is in the form of a shallow truncated cone that directs the magnetic field at least partially generated by the first permanent magnet to the second permanent magnet. (It is noted that the structure 1491 also directs the magnetic field at least partially generated by the magnet 600 and the magnets 582, as those collectively establish the magnetic field 1402.) FIG. 14C is another embodiment of a module, module 14811, where the structure 14911 extends downward from component 1310, where component 1310 is a magnetic component that channels the magnetic flux, and where the structure 1491 is also a magnetic component the channels the magnetic flux (thus component 1310 channels the magnetic flux to structure 1491). Structure 1491 channels the magnetic flux to magnet 582 which is canted (or, more accurately, the poles are canted) relative to the longitudinal axis 599. FIG. 14C depicts a similar concept as that of FIG. 14B.

It is noted that in some embodiments, component 1310 can also be a permanent magnet, as is also the case with component 1320. Indeed, in an exemplary embodiment, any structure detailed herein that is disclosed as a magnetic material can be a permanent magnet. It is also noted that in at least some embodiments, any disclosure herein of a permanent magnet constitutes a disclosure of instead a magnetic material that is not a permanent magnet, such as one that conducts magnetic flux, such as a highly permeable soft magnetic material.

In view of the above, it can be seen that in at least some exemplary embodiments, there is a body piece that includes a structure made up of soft magnetic material (entirely or partially) extending between a first permanent magnet and a second permanent magnet (e.g., the crossmember 1090 of FIG. 10). In an exemplary embodiment, a portion of the structure between the first permanent magnet and the second permanent magnet can be angled relative to the longitudinal axis at an oblique angle. Still further, an angle between the portion of the structure between the first permanent magnet and the second permanent magnet and the north-south axis of the second permanent magnet can be oblique.

Figure 15:
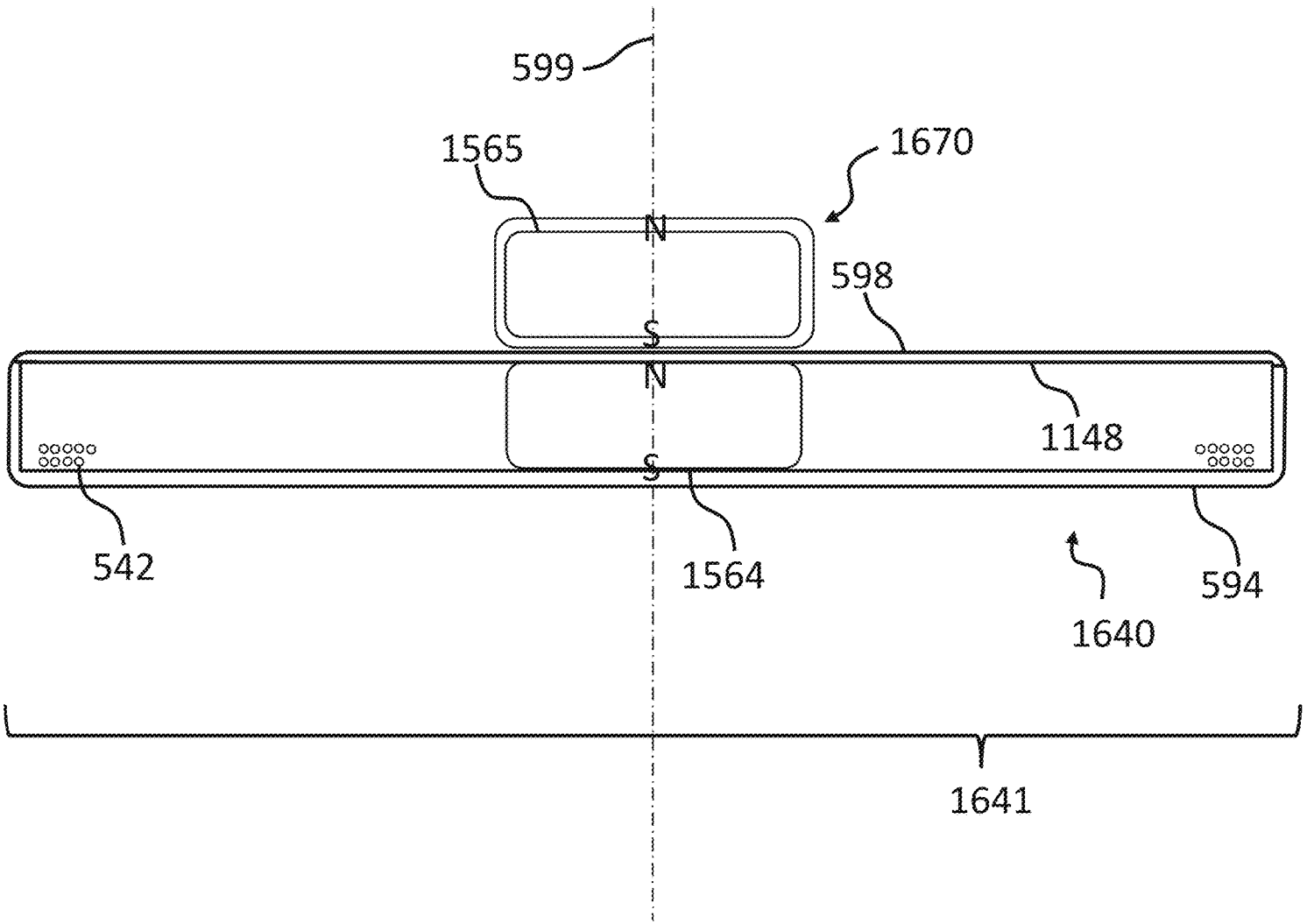
FIGS. 15-17 depict alternate concepts of utilizing an additional magnet to increase retention force, along with another exemplary embodiment of an external component that is different from that of FIG. 4 but which utilizes at least some of the same principles.

FIG. 15 depicts another exemplary embodiment of an external component assembly 1641 that includes an external component 1640 to which is attached a module 1670 in which is located a magnet 1565 located in a housing. Here, this second module that is attached to the first module in the form of the external component 1640 is located on an opposite side of the first module from the skin interfacing side of the first module. As can be seen, the second module 1670 is located on the top of the external component 1640.

In the embodiment depicted in FIG. 15, the module 1670 is attached to the removable component 1640 via a magnetic attraction between the magnet 1565 and the magnet 1564. That said, in some alternate embodiments, in addition to this magnetic attraction, other types of connectors are utilized, such as a snap coupling or the like. Any arrangement that can enable the module 1670 to be connected to the external component 1640 can be utilized in at least some exemplary embodiments.

Briefly, it is noted that this is an exemplary embodiment where the magnet 1564 is generally unremovable, as opposed to the embodiment of FIG. 4 above. That said, in an exemplary embodiment, the top of the housing in which the magnet 1564 is located, housing wall 1148 can be removed so that the magnet 1564 can be replaced with a different size and/or strength magnet. (Some additional features of this will be described in greater detail below.) In any event, in some embodiments the housing wall 1148 is welded to the rest of the housing, thus making the magnet 1564 unremovable. The point is that FIG. 15 presents an embodiment that differs from the embodiment of FIG. 4 with respect to the removability and the changeability associated with the magnet inside the external component. That said, it is also noted that the embodiment of FIG. 4 differs from the embodiment of FIG. 15 in that with respect to embodiments where the magnet is removable, magnet 1564 is removed from the side away from surface 594 (away from the skin interfacing side). Thus, the embodiments of the teachings detailed herein in at least some instances can be practiced with different types of configurations vis-à-vis the external component including the coil 542 and other portions thereof.

In an exemplary embodiment, the magnet 1565 adds to the overall magnetic flux generated by the external components, and thus increases the retention force between the external component in the implanted component.

Figure 16:
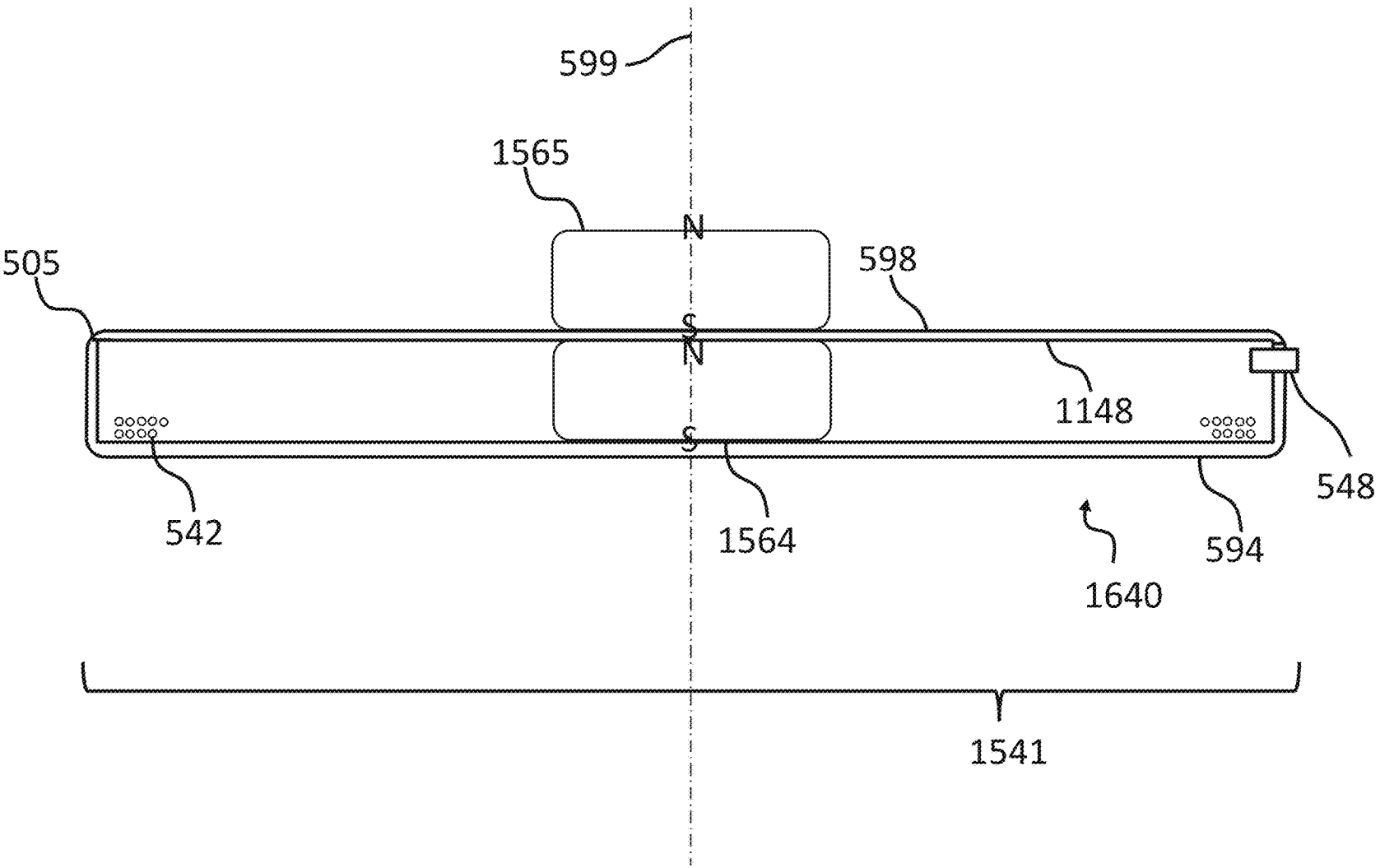
Figure 17:
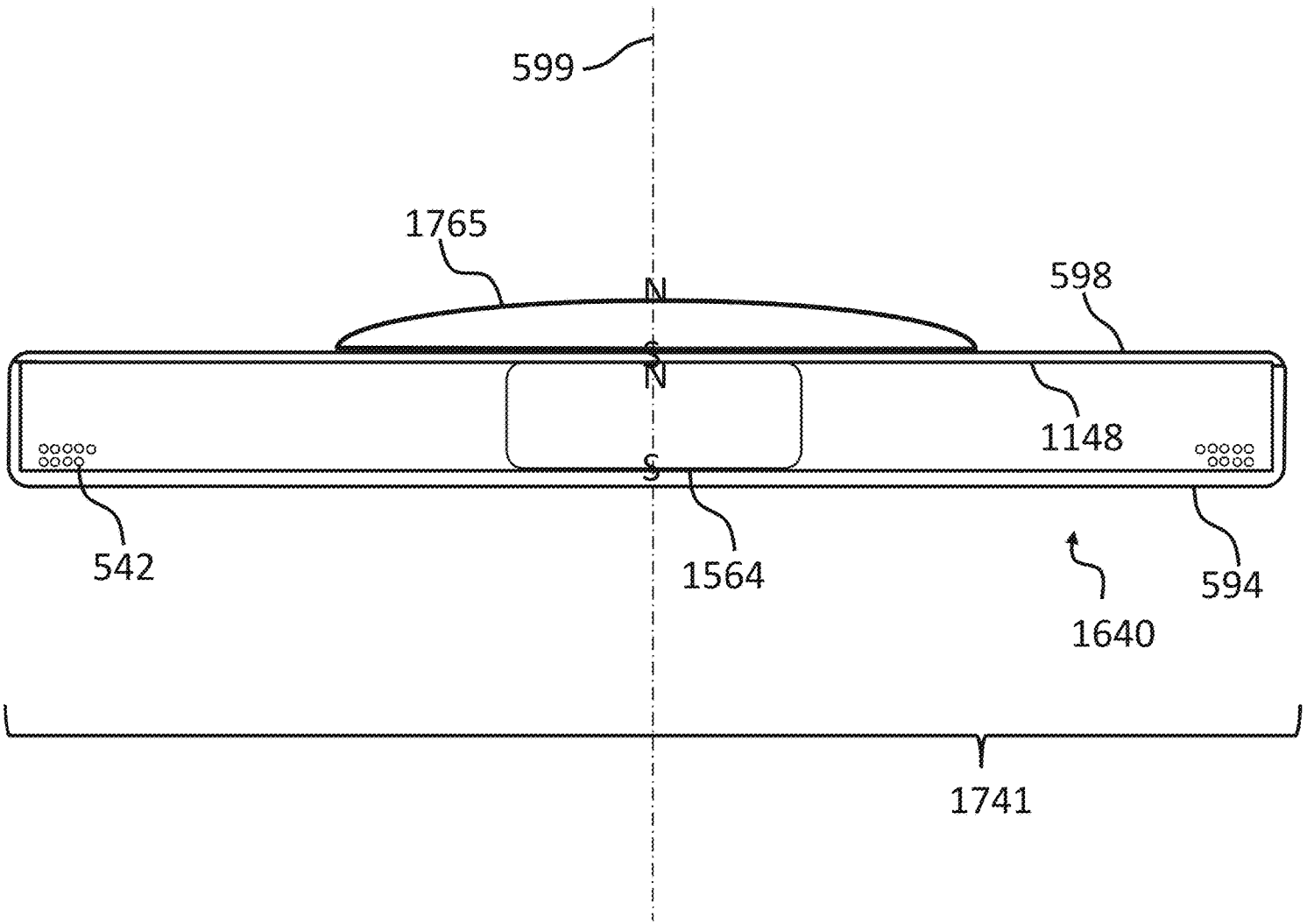

While the embodiment of FIG. 15 depicts a magnet 1565 located in a housing, in an alternate embodiment, instead of a modular form, there is just magnet 1565 that is attached to the upper surface 598 of the external component 1640. This is seen in FIG. 16, where assembly 1541 includes the external component 1640 two which is attached magnet 1565. Again, in an exemplary embodiment, simple magnetic attraction between the magnet 1564 and the magnet 1565 is utilized to hold magnet 1565 and place. It is noted that in at least some exemplary embodiments, where a non-modular format is utilized, magnet 1565 can be painted a color that is generally the same as if not the same as the top surface 598 so that the magnet 1565 is not as distinct. It is also noted that while the embodiment of FIG. 16 depicts a circular magnet having an outer circumference that is generally constant along the length of the longitudinal axis 599, in alternative embodiments, a magnet that is more "streamlined" or "contoured" can be utilized, such as that seen in FIG. 17, where external component assembly 1741 is established via the use of the external component 16402 which is attached magnet 1765 which is rotationally symmetric about axis 599 and is less pronounced than the module of FIG. 15 or even the magnet of FIG. 16.

It is noted that the concept of attaching a magnet to the top of the external component, whether a magnet is in a modularized form or a simple magnet by itself, can also be applied to the embodiment of FIG. 4 and variations thereof.

Figure 18:
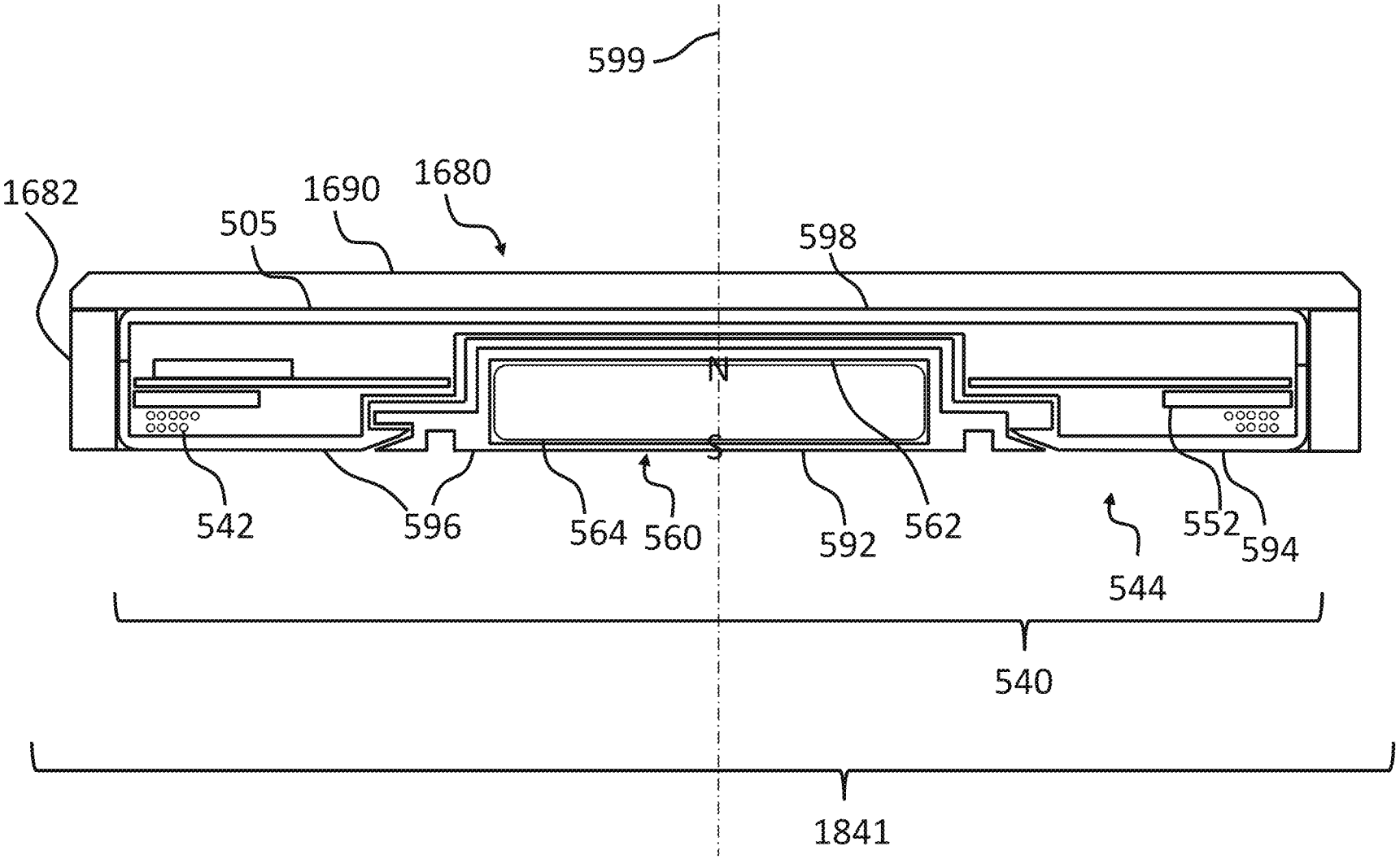
FIG. 18 depicts another exemplary embodiment that utilizes a component added to the external component of FIG. 4 to increase the retention force.
Figure 19:
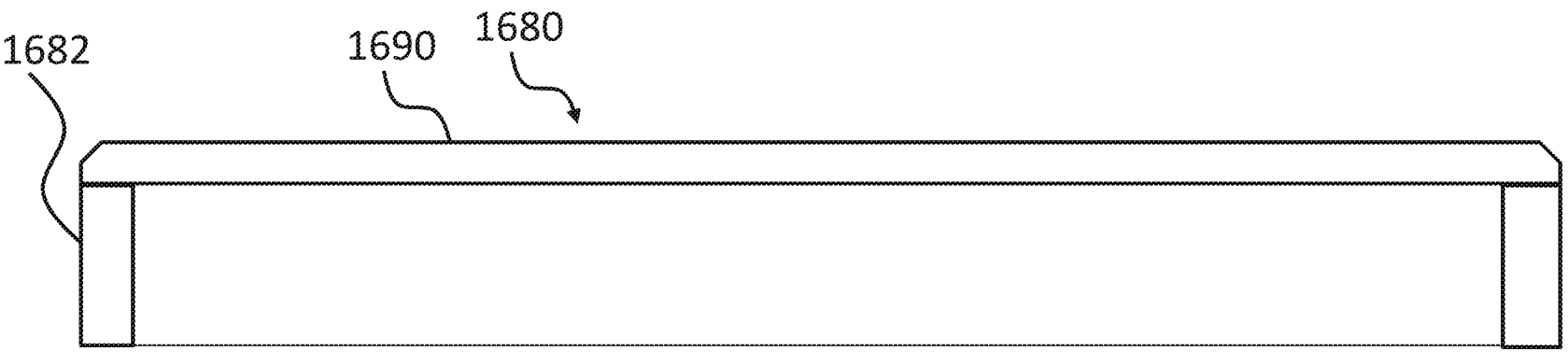
FIG. 19 depicts a cross-sectional view of the component of FIG. 18 that is added to the component of FIG. 4 to increase the retention force.

As noted above, in some embodiments, the module that is attached to the external component 540 does not necessarily include a permanent magnet. Instead, in an exemplary embodiment, the application of conductive magnetic material to conduct the flux generated by magnet 564 is the driver for utilizing an additional component with external component 540. To this end, FIGS. 18 and 19 depict an exemplary component 1680 that includes a crossmember 1690 made out of highly permeable magnetic material to which is attached ring 1682 which is also made out of highly permeable magnetic material (the same material as crossmember 1690 or a different material). While the embodiments of FIGS. 18 and 19 depict a ring and a plate respectively, as components of the sidewalls 1682 and a crossmember 1690, in an alternate embodiment, consistent with the different embodiments with respect to the outboard magnets, sidewall 1682 can be in the form of segmented sections symmetrically arranged about the longitudinal axis 599, and crossmember 1690 can be an elongate structure that extends from one side to the other side, as opposed to a circular plate. Any arrangement that can enable the channeling of the magnetic flux generated by the various magnets can be utilized in at least some exemplary embodiments. In an exemplary embodiment, because of the channeling of the magnetic flux achieved by the magnetic material of component 1680, the resulting magnetic force between magnet 564 and the implanted magnet 600 can be increased relative to that which exists without the component 1680, all other things being equal. Thus, in an exemplary embodiment, there is a component that attaches to the external component 540 resulting in an assembly 1841, where the component that is attached to the external component 540 is devoid of any permanent magnets. In an exemplary embodiment, the component can be entirely made of the magnetic material that is utilized to channel the magnetic flux, while in an alternate embodiment, the component can be a magnetic material that is partially or completely housed in a covering of nonmagnetic material (e.g. plastic).

Figure 20:
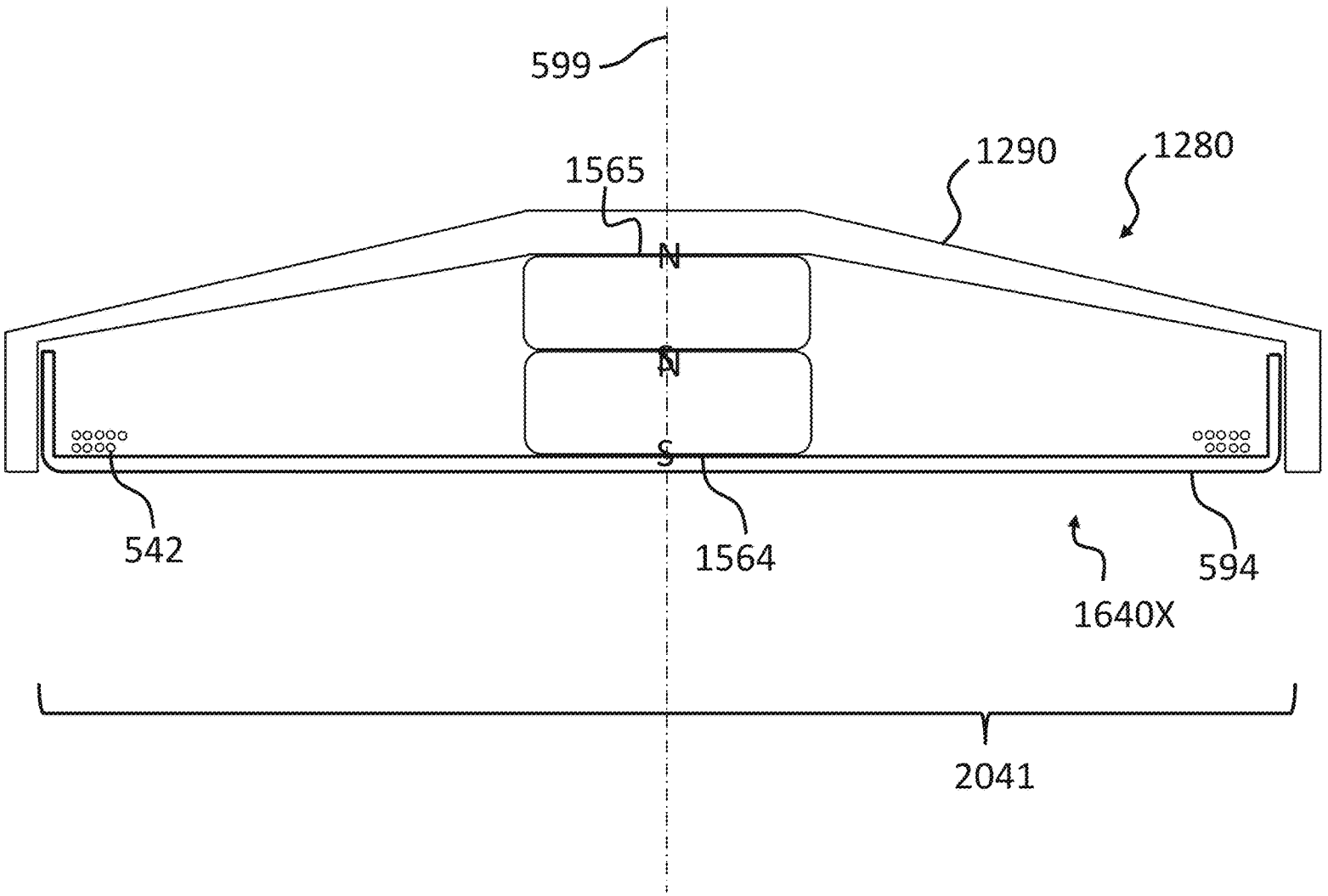
FIG. 20 depicts another exemplary embodiment that utilizes a structure that covers the interior of the removable component, which structure also increases the retention force.
Figure 21:
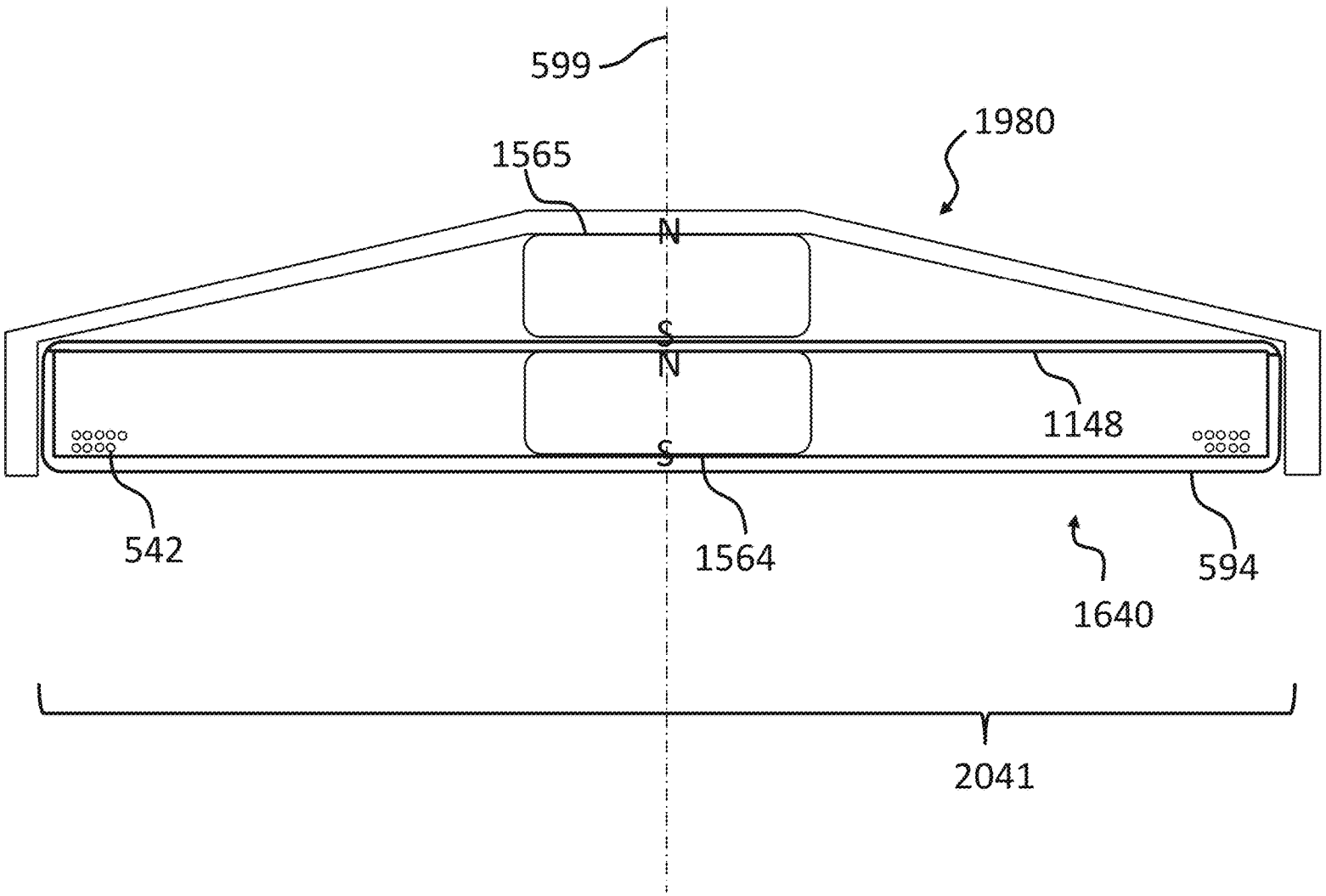
FIG. 21 depicts a variation of the concept of FIG. 20.

It is also noted that the embodiments of FIGS. 18 and 19 can be combined with a permanent magnet. FIG. 20 depicts an exemplary component 2080 which includes a shell 2090 made of a magnetic material along with a magnet 1565 that is essentially permanently attached to shell 2090. FIG. 20 also presents an exemplary embodiment where the component 2080 forms part of a cover for the external component, here represented by component 1640X, which includes the coil 542 and magnet 1564 along with in some embodiments additional circuitry for the button sound processor. Collectively, component 1640X and component 1280 form assembly 2041. It is noted that in some embodiments, the magnet 1656 can be replaced with a component made out of magnetic material but that is not a permanent magnet so as to channel the flux generated by magnet 1564. It is also noted that the embodiment of FIG. 20 can be practiced where there is a housing wall placed between magnet 1565 and magnet 1564, which housing wall extends to the sidewalls of the component 1640X. FIG. 21 depicts an alternate embodiment utilizing the concept of FIG. 20, except that module 1980 is designed to accommodate the fact that there is a housing wall 1148 located between magnet 1564 and magnet 1565. In this regard, in an exemplary embodiment, the module of FIG. 20 replaces the cover of the external component 1640, while the embodiment of FIG. 21 creates a new cover that is utilized with the cover of external component 1640.

Figure 22:
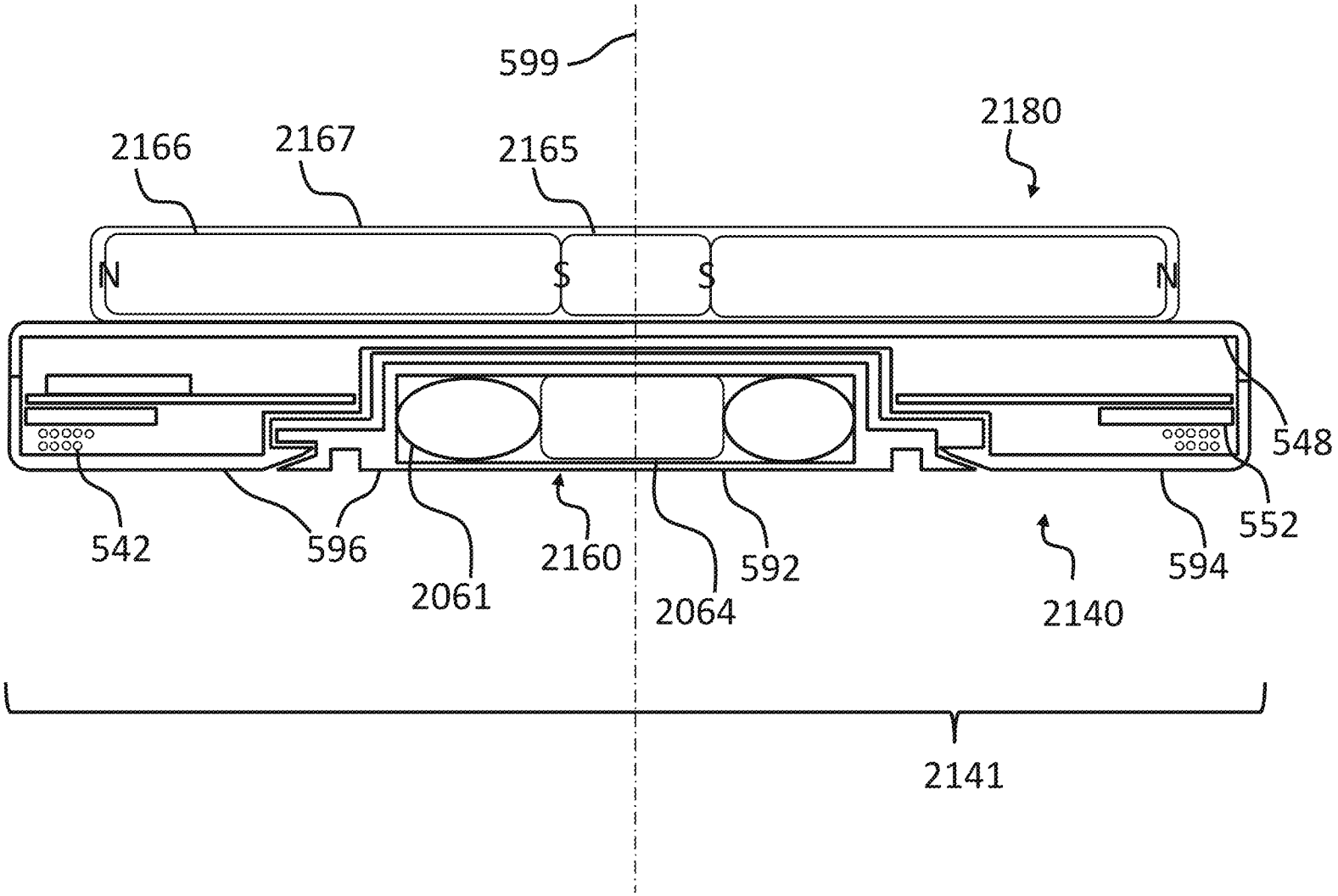
FIG. 22 depicts another exemplary embodiment of a module that can be added to the external component of FIG. 4, along with a modified version of the external component of FIG. 4.

FIG. 22 depicts yet another exemplary embodiment of an external assembly, assembly 2140, which includes a module 2180 attached to the external component 2140, which corresponds to external component 540 detailed above, except that the second sub-component 560 has been replaced with a new sub-component 2160. Sub-component 2160 includes a ferromagnetic material body 2164 in the form of a circular piece of soft magnetic material located in the housing of sub-component 2160. Spacers 2161 are positioned to center component 2064 along the longitudinal axis 599/in the center of sub-component 2160. In an exemplary embodiment, the sub-component 560 including the magnet has been removed, and in its place, new sub-component 2160 has been provided. (Briefly, while the embodiments detailed here are directed towards the elimination of a permanent magnet and the replacement thereof by a magnetic component that is not a permanent magnet, it is to be appreciated that in an alternate embodiment, the new sub-component 2160 could also include a permanent magnet in place of component 2064, which permanent magnet can be smaller than the permanent magnet previously present, so as to reduce the generated magnetic field generated by the external component.) The component 2064 in the form of a circular piece of soft magnetic material is configured to channel the magnetic flux generated by the implanted magnet 600 and, in some embodiments, where the module 2180 is utilized, the permanent magnet thereof in addition to the flux generated by magnet 600. In this regard, it can be seen that module 2180 includes permanent magnet 2166, which is a doughnut magnet, that includes a hole therethrough. In the embodiment of FIG. 22, a component 2165 is located in the hole, which component can be a circular piece of soft magnetic material. Both the circular piece of soft magnetic material and the magnet 2166 can be located in a housing 2167. In an exemplary embodiment, the module 2180 is held to the top housing wall 548 of the external component 2140 via a magnetic attraction between the magnet 2166 and the component 2160. That said, in an alternate embodiment, the module 2180 is coupled to the external component 2140 via a snap coupling or the like.

In an exemplary embodiment, component 2160 combined with component 2165 channels the magnetic flux generated by the implanted magnet 600 and the magnet 2166 so as to result in a retention force between the external component assembly 2141 and the implanted magnet 600 that is greater than that which would be the case if the component 2064 and/or the component 2165 was replaced with its equivalent weight with permanent magnet(s). In an exemplary embodiment, the increased retention force is more than about 1%, 2, 3, 4, 5, 6, 7, 8, 9, 10, 12, 14, 16, 18, 20, 22, 24, 26, 28, 30, 35, 40, 45, 50, 55, 60, 65, 70, 75, 80, 85, or 90% or more, or any value or range of values therebetween in 0.1% increments (e.g., 23.5% to 44.1%, more than 33.3%, etc.).

To be clear, in the exemplary embodiment of FIG. 22, the central magnet of the button sound processor has been replaced by a high saturation soft magnetic component, such as by way of example only cobalt-iron (which is an example of a soft magnetic material that can be utilized with respect to any of the non-permanent magnet magnetic materials detailed herein). Here, the magnetic flux from the magnets in the module 2180 is concentrated so as to have a higher flux density below the button sound processor, which higher flux density interacts with the magnet implanted in the recipient, thus increasing the retention force. In an exemplary embodiment, the cobalt-iron component is a 50-50 combination of the two materials, and has a saturation flux density of 2.4 T. In an exemplary embodiment, the magnet 2166 is a neodymium magnet, and has a flux density less than 1.4 T. It is also noted that while the embodiment of FIG. 22 has been presented in terms of utilizing a single doughnut magnet, in an alternative embodiment, two or more magnets can be utilized. Note also while the embodiment of FIG. 22 is presented in terms of using a single component 2164 and a single component 2165, in an alternative embodiment, multiple components can be respectively utilized.

Figure 23:
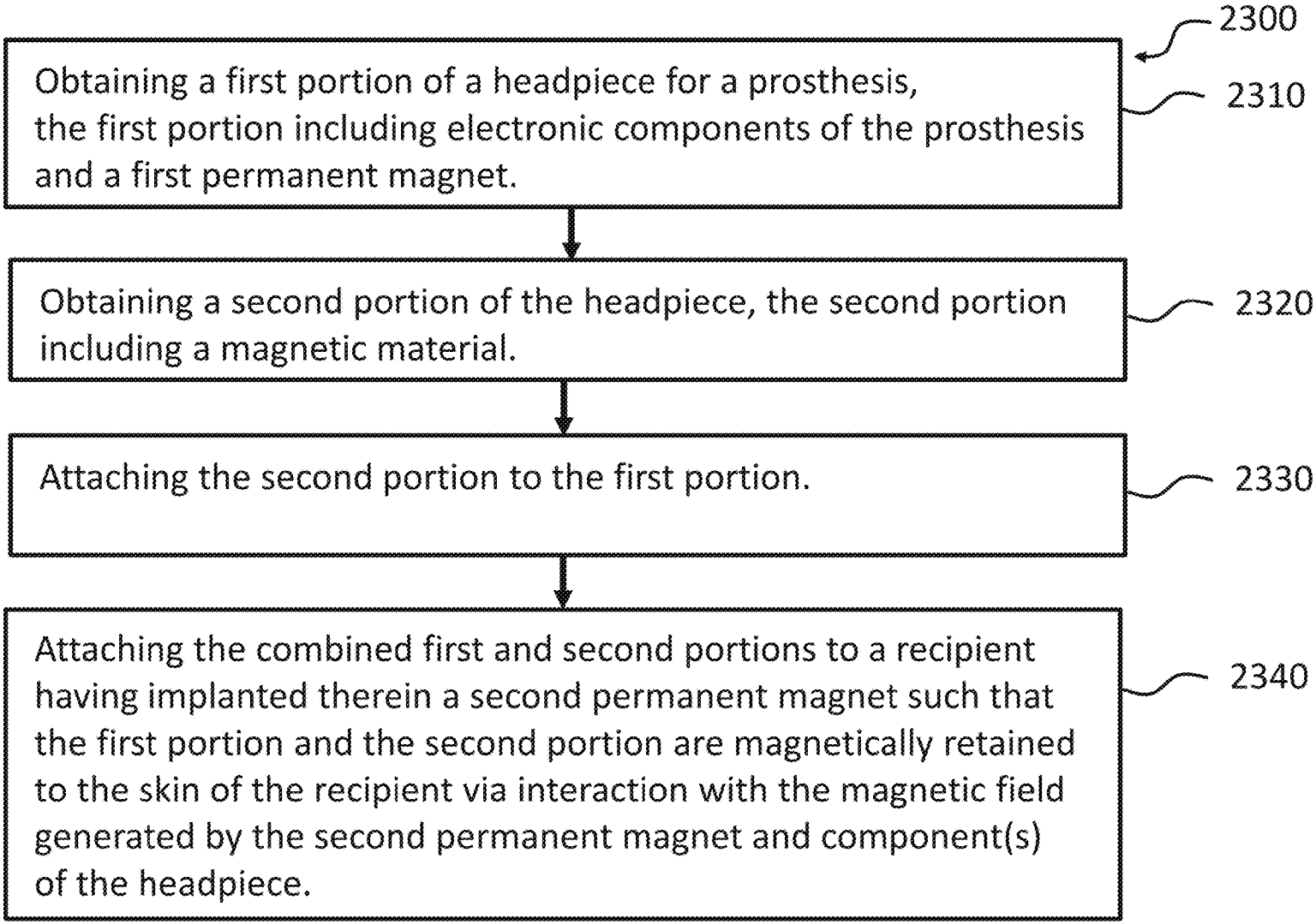
FIG. 23 depicts a flowchart for an exemplary method according to an exemplary embodiment.

In view of the above, it is to be understood that there are methods associated with the teachings herein. In this regard, by way of example only and not by way of limitation, FIG. 23 presents an exemplary flowchart for an exemplary method, method 2300. Method 2300 includes method action 2310, which includes obtaining a first portion of a headpiece for a prosthesis, the first portion including electronic components of the prosthesis and a first permanent magnet. By way of example only and not by way of limitation, this can correspond to obtaining the external component 540 detailed above. Method 2300 further includes method action 2320, which includes obtaining a second portion of the headpiece, the second portion including a magnetic material. By way of example only and not by way of limitation, this can include obtaining any of the second components that have been detailed herein as being attachable to the external component 540 or variations of the external component 540. Method 2300 also includes method action 2330, which includes attaching the second portion to the first portion. In an exemplary embodiment, this can entail obtaining the module 580 and screwing the module 580 onto the external component 540 where the external component 540 has outer threads that interact with the inner threads of the module 580. In an exemplary embodiment, this can entail snapping module 580 on to the housing of the external component 540. Still further, in an exemplary embodiment where there is a central magnet in or as part of the second component (or the second component is in its entirety a permanent magnet), this can entail placing the magnet against the external component 540 such that the magnetic fields of the magnet of the external component 540 and the magnet of the second component interact to hold the second component to the external component 540.

Method 2300 further includes method action 2340, which includes attaching the combined first and second portions to a recipient having implanted therein a second permanent magnet such that the first portion and the second portion are magnetically retained to the skin of the recipient via interaction with the magnetic field generated by the second permanent magnet and component(s) of the headpiece (where the components can include a permanent magnet and the second component or a piece of magnetic material that is not a permanent magnet in the second component). In an exemplary embodiment of method 2300, the magnetic material of the second component alters the magnetic flux established by the second permanent magnet such that the magnetic flux is widened about a longitudinal axis between the second permanent magnet and the first portion relative to that which would be the case in the absence of the second portion. In this regard, in an exemplary embodiment, this feature can be achieved via the use of, for example, the module 580 as the second component, which has the magnets 582 outboard of the permanent magnet 564. Such can also be achieved by way of example by the utilization of module 1680 as the second component, which has the magnetic components 1682 outboard of the magnet 564. Note also that in an exemplary embodiment, the second component can be limited to component 1690. That is, the embodiment of FIG. 18 can be practiced without the magnetic components 1682 flanking the permanent magnet 564. Still further, in embodiments where the second component includes a permanent magnet, depending on the arrangement of the second component, even a centered magnet can result in the widening of the magnetic field. Such might be the case with respect to the embodiment of FIG. 17. The embodiments of FIGS. 20-22 can also potentially achieve the aforementioned widening.

Figure 24:
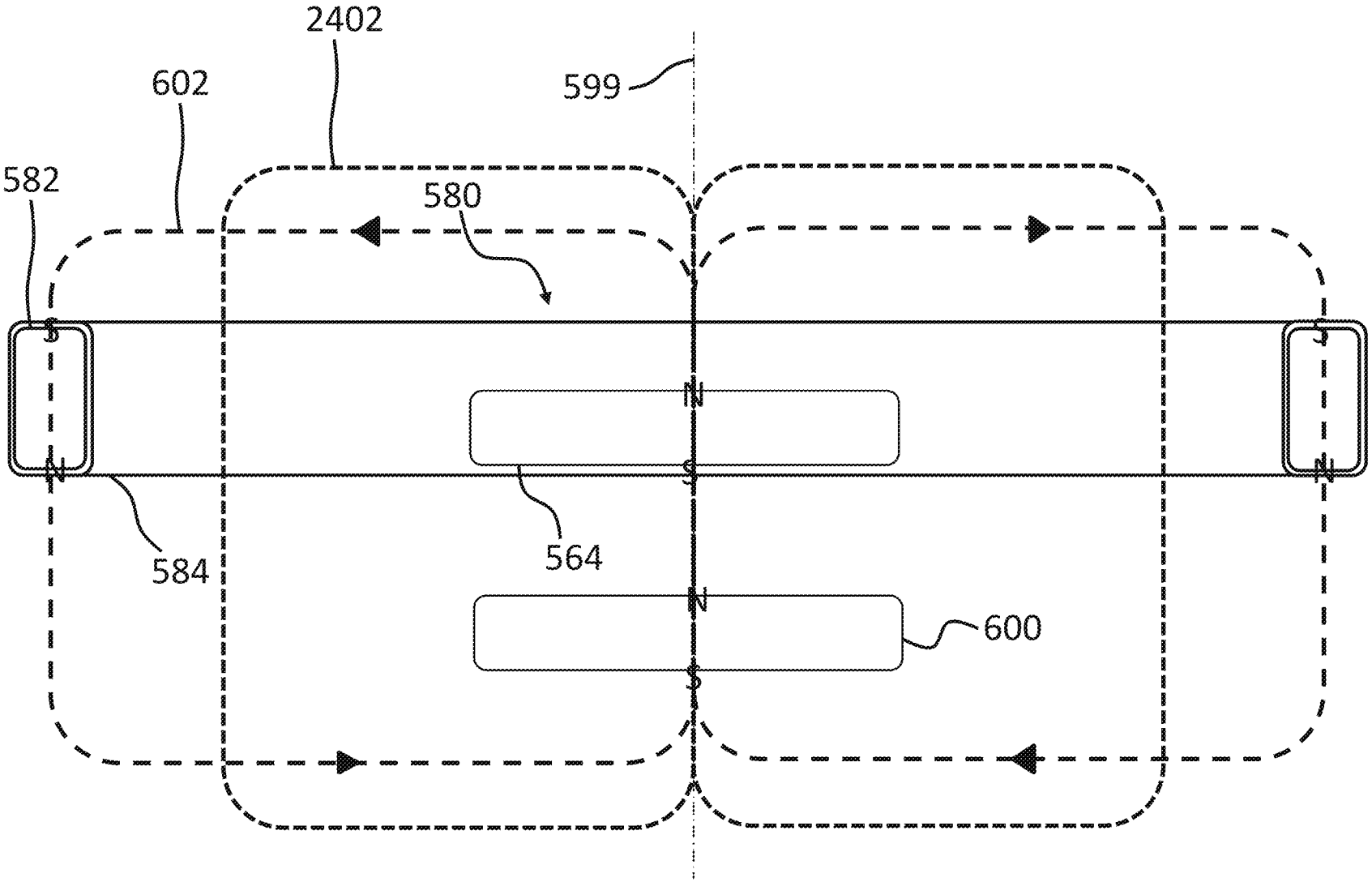
FIG. 24 depicts an exemplary magnetic flux flow according to an exemplary embodiment resulting from the method of FIG. 23.

FIG. 24 depicts by way of conceptual schematic how the module 580 widens the magnetic flux. FIG. 24 is a duplication of the schematic of FIG. 6B, with, superimposed thereon, the magnetic flux 2402 that would exist in the absence of the module 580. As can be seen, the width of flux 602, the flux that results from the addition of magnet(s) 582, about the longitudinal axis of the magnetic flux, is now wider than that which was previously the case. The flux 602 is also shorter relative to flux 2402, as can be seen. It is also noted that in an exemplary embodiment, the width of an imaginary cylinder centered about the longitudinal axis 599 in which X % of the magnetic flux of the total system lies is less than that which is the case without the module 580. In an exemplary embodiment, X is 10%, 15%, 20%, 25%, 30%, 35%, 40%, 45%, 50%, 55%, 60%, 65%, 70%, 75%, 80%, 85%, 90%, 91%, 92%, 93%, 94%, 95%, 96%, 97%, 98%, 99%, or 100%. In an exemplary embodiment, the width is Y percent greater when the module 580 is present, where Y is 1%, 2%, 3%, 4%, 5%, 6%, 7%, 8%, 9%, 10%, 15%, 20%, 25%, 30%, 35%, 40%, 45%, 50%, 55%, 60%, 65%, 70%, or 75%.

As can be seen in FIG. 24, it is also noted that the magnetic flux is shortened with respect to the longitudinal axis 599. In this regard, in an exemplary embodiment, the magnetic material of the second component of the method 2300 alters the magnetic flux established by the second permanent magnet such that the magnetic flux is shortened with respect to the longitudinal axis relative to that which would be the case in the absence of the second portion. In an exemplary embodiment, the distance between two imaginary planes normal to the longitudinal axis 599 between which X % of the magnetic flux of the total system lies greater than that which is the case when the module 580 is present. In an exemplary embodiment, the distance between the two imaginary planes is Y percent less when the module 580 is present.

Figure 25:
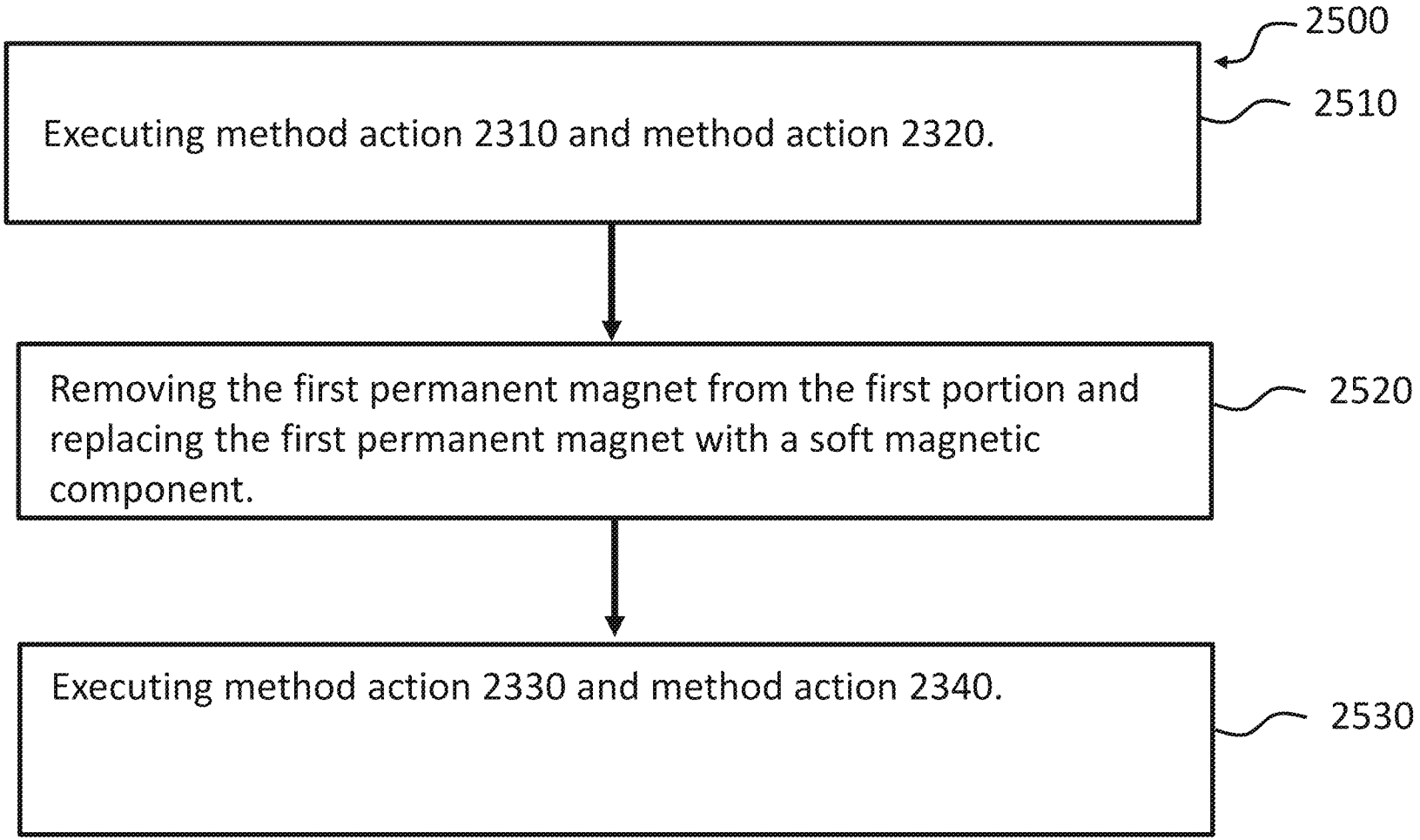
FIG. 25 depicts another exemplary flowchart for an exemplary method according to an exemplary embodiment.

FIG. 25 presents an exemplary flowchart for another exemplary method, method 2500. Method 2500 includes method action 2510, which includes executing method action 2310 and method action 2320. Method 2500 further includes method action 2520, which includes removing the first permanent magnet from the first portion of the headpiece and replacing the first permanent magnet with a soft magnetic component. In an exemplary embodiment, this entails obtaining an external component 540 or a device similar thereto, and removing the second sub-component 560, and replacing that with a sub-component that does not include a permanent magnet, but instead includes a component made of soft magnetic material, such as the sub-component 2060 of FIG. 22. Method 2500 further includes method 2530, which includes executing method action 2330 and method action 2340.

Figure 26:
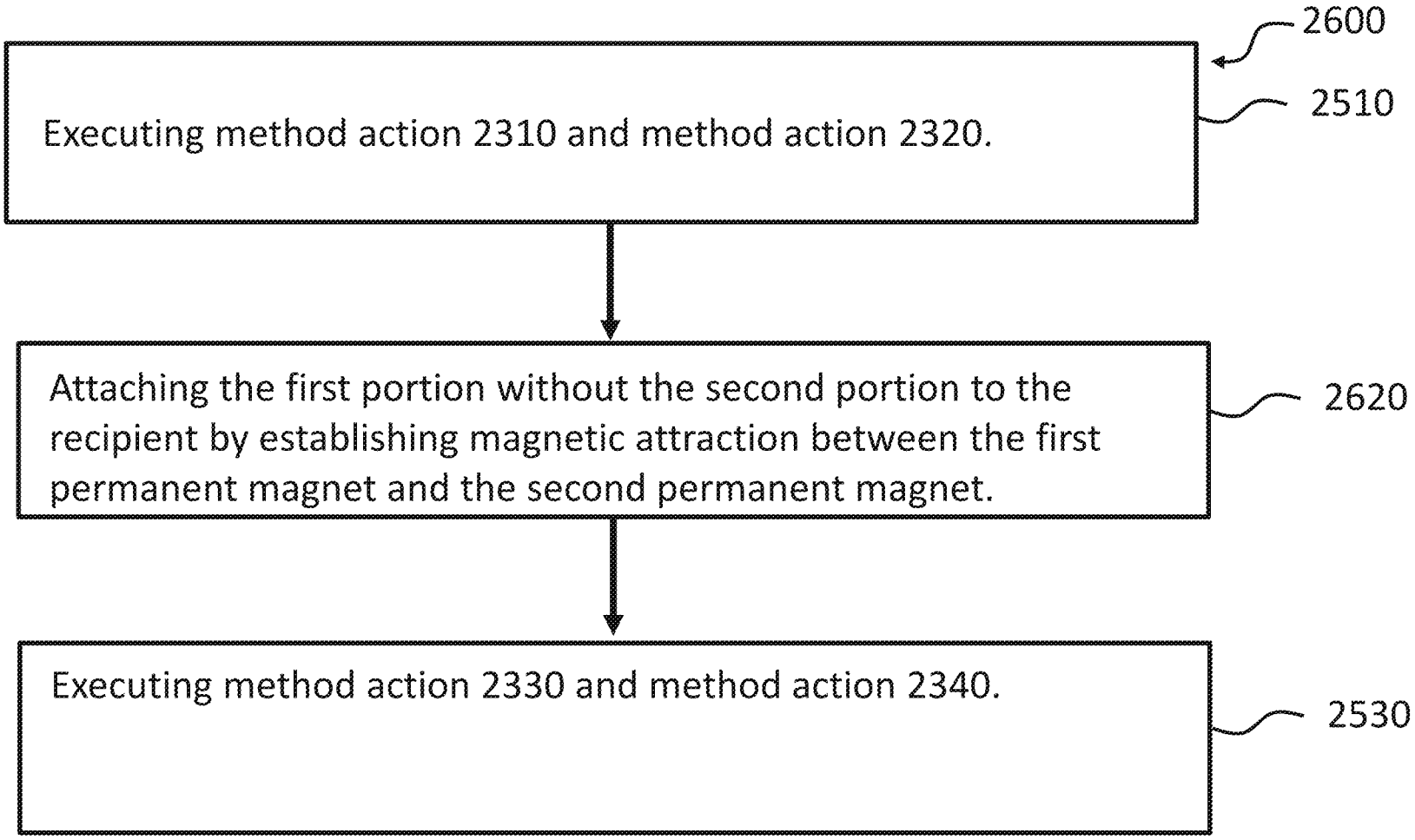
FIG. 26 depicts yet another exemplary flowchart for an exemplary method according to an exemplary embodiment.

FIG. 26 presents a flowchart representing another exemplary method, method 2600.

Method 2600 includes method action 2510, which, as noted above, entails executing method action 2310 and method action 2320. Method 2600 further includes method action 2620, which includes attaching the first portion without the second portion to the recipient by establishing magnetic attraction between the first permanent magnet and the second permanent magnet. In an exemplary embodiment, method action 2620 is executed to evaluate whether or not the first portion (e.g., external component 540 with permanent magnet 564), or more accurately, the magnet thereof, is sufficient to hold the first portion to the recipient, where a determination is made that additional retention force is utilitarian. In an exemplary embodiment, method action 2620 represents the use of the button sound processor for a period of time by the recipient prior to the need for additional retention force (e.g., due to a physiological change of the recipient, due to a change in the habits of the recipient, etc.). Method 2600 further includes method action 2530, which, as noted above, entails executing method action 2330 in method action 2340.

In an exemplary embodiment, method action 2310, the action of obtaining the first portion includes obtaining the first portion with a third portion attached thereto, the third portion being a cover of the headpiece covering a substantial portion of the first portion. In an exemplary embodiment, this can correspond to the housing wall 1148 of FIG. 15 or FIG. 17. In this exemplary embodiment, any of the aforementioned methods or below methods further comprise removing the third portion from the first portion and replacing the third portion with the second portion, wherein the second portion covers a substantial portion of the first portion. This is the case with respect to the configuration of FIG. 21. Here, the magnetic material covers at least a portion of the substantial portion of the first portion covered by the second portion. In an exemplary embodiment, the magnetic material covers at least a substantial portion of the substantial portion of the first portion covered by the second portion. In FIG. 21, the magnetic material covers all of the portion of the first portion covered by the second portion. That said, in some embodiments, the magnetic material is such that it only partially covers the substantial portion of the first portion covered by the second portion, such as is the case when soft magnetic material is utilized as specific conduits to the outboard magnets. For example, in an exemplary embodiment where only two bar magnets are utilized, each located on opposite sides of the external component, the soft magnetic material that extends between the two magnets does not cover the entire opening of the housing, but instead constitutes an elongate body extending from one magnet to the other still, irrespective of the configuration of the soft magnetic material, in an exemplary embodiment, the second portion covers all of the first portion. In an exemplary embodiment, the second portion covers all that was covered by the removed third portion.

Figure 27:
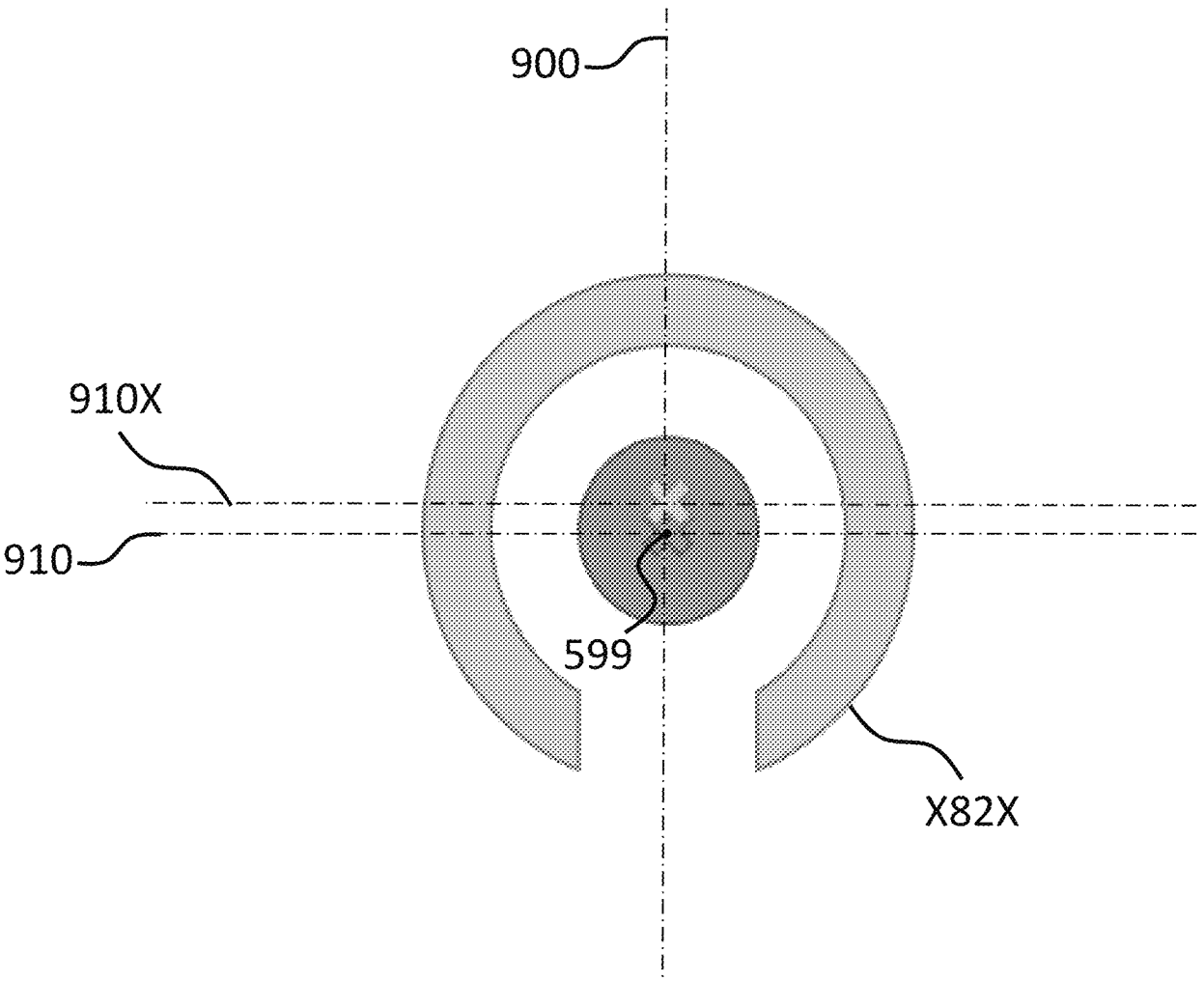
FIGS. 27 and 28 depict in conceptual format additional features of an exemplary system.

As noted above, in some embodiments, the module 580 or 780 is such that the permanent magnet thereof, when used with the external component 540, is configured such that the permanent magnet of the module is misaligned with the implanted magnet 600 when the external component interacts with the magnetic field of the implanted magnet. That is, the magnet of the module 580 or 780 does not mirror the implant magnet. In some embodiments, the base magnet 564 is angularly symmetric (symmetric about the longitudinal axis 599), and the implant magnet 600 is also angularly symmetric. In such embodiments, the symmetry axis for the implanted and external magnets would align (as shown in the figures—alignment with axis 599). If the module magnet, e.g. 582, is also angular symmetric, the symmetry axis of this magnet would also align with the symmetry axes of the other magnets and the external component 540 would stay on the same spot on the head when the module is attached. However, as noted above, in some exemplary embodiments, the retention module added to the external component 540 may not be angularly symmetric, or, more specifically, the magnet(s) thereof may not be angularly symmetric. For example, such might be the case with respect to a retention module that has an opening, such as that for a battery door or for a cable to another component of the prosthesis or an opening, e.g. to provide access to a battery door. FIG. 27 provides a conceptual example of a magnet X82X of the removable module with such an opening (where in an exemplary embodiment, a housing can be included, which housing closely conforms to the outside of the magnet X82X, along with axis lines, where axis 910 and 900 are centered about the longitudinal axis 599, and the angularly symmetric magnet 564 (the base magnet) is centered thereabout (represented by the inner circle), but axis 910X is off-center ("above" the axis 910), representing the fact that there is more magnetic material "above" the axis 910 than below/the center of magnetic flux is located above axis 901. That is, in this embodiment, the outer magnet's geometric center (marked by the cross), is slightly skewed relative to the center of the base magnet. The result is that the combined geometric center of the two magnets is slightly shifted relative to the center of the base magnet 564. This new center will align with the axis of the implant magnet.

In some embodiments, the inductance coil of the external component 540 can be moved within the housing thereof to adjust for the fact that this new alignment regime might result in a slight mismatch of the internal and external coils (which might lower transmission efficiency). For example, the coil can be mounted on an internal trolley system, or slidable tray system or the like, so as to move the coil from alignment with the longitudinal axis 599 which is centered about the base magnet 564, to a location offset therefrom.

Figure 28:
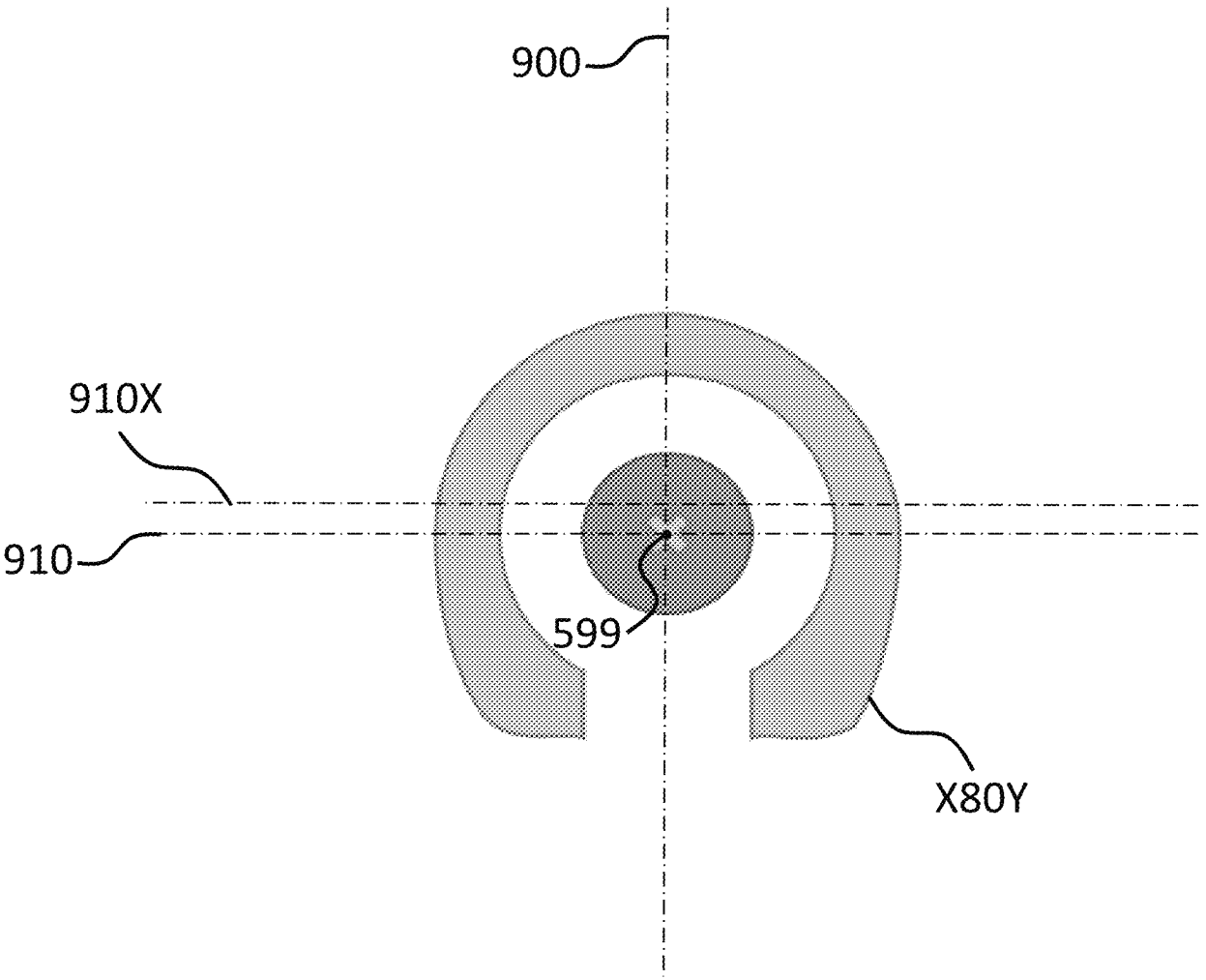

That said, in an alternate embodiment, the retention module in general, and the magnets thereof and particular, can be configured so as to account for this misalignment when using asymmetrical magnets. FIG. 28 depicts an exemplary embodiment where the magnet of the retention module X82Y is such that the resulting geometric center of the combination of the magnet(s) of the retention module and the base magnet (magnet 564) has its geometric center on the symmetry axis of the base magnet (where axis 910X is depicted for a frame of reference). That is, as can be seen, "more" magnetic material has been located at ends of the "C" so as to account for the fact that there is an opening, thus bringing balance to the force (the magnetic force), and restoring order to the system.

It is noted that consistent with the teachings detailed above, with respect to some of the aforementioned methods, the magnetic material alters the magnetic flux established by the second permanent magnet such that the magnetic flux is concentrated and channeled at an oblique angle away from the longitudinal axis at a skin interfacing location relative to that which would be the case in the absence of the second portion. By skin interfacing location, it is meant the location where the magnetic flux enters (or exits) the skin. It is also noted that in an exemplary embodiment, an increase in retention force between the combined first and second portions and the second permanent magnet above that which is the case between only the first portion and the second permanent magnet is higher than the weight of the second portion. By way of example only and not by way of limitation, if the retention force of the external component 540 to the skin of the recipient is A Newtons without the module 580, and with the module, it is A+B Newtons, B is greater than the weight of module 580. Note that this is just an example to illustrate the concept. It is quite possible that B will be less than the weight of module 580. However, this could be the case (B is greater than the weight of the second portion) with respect to at least some of the embodiments detailed herein (e.g., the embodiment of FIG. 18, where component 1860 weighs B Newtons, and the increase in retention force is B+C Newtons). In an exemplary embodiment, C is greater than 1%, 2%, 3%, 4%, 5%, 6%, 7%, 8%, 9%, 10%, 15%, 20%, 25%, 30%, 35%, 40%, 45%, 50%, 55%, 60%, 65%, 70%, 75%, 80%, 85%, 90%, 95%, 100%, 110%, 125%, 150%, or 200% or more of B.

The external component can be any of the external components described in U.S. patent application Ser. No. 15/166,628 filed on May 27, 2016, to inventor Tad Jurkiewicz, entitled Magnet Positioning System, as modified if such has utilitarian value to be practiced with the teachings detailed herein. In an exemplary embodiment, the external component's detailed herein and variations thereof have any or all of the features of the external component described in the aforementioned patent application. Accordingly, this application constitutes a disclosure of one or more embodiments where any one or more teachings herein is combined with any one or more teachings in that patent application.

It is briefly noted that in some embodiments that utilize the two modules, the first module includes a first permanent magnet and the second module includes a second permanent magnet, the second permanent magnet being a different configuration than the first permanent magnet. By different configuration, it is meant that, for example, one magnet is a disk magnet, and another magnet is a bar magnet, or one magnet is a disk magnet, and another magnet is a ring magnet, etc. This as opposed to merely a different size.

In an exemplary embodiment, the height of the external component assembly (distance along the longitudinal axis) is no more than 3, 4, 5, 6, 7, 8, 9, 10, 11, 12, 13, 14 or 15 cm or any value or range of values therebetween in 0.1 cm increments, and a retention force for a given scenario (e.g., given skin flap thickness and given implanted magnet) can be increased at least about 10%, 15%, 20%, 25%, 30%, 35%, 40%, 45%, 50%, 55%, 60%, 65%, 70%, 75%, 80%, 85%, 90%, 95%, or 100% or more or any value or range of values therebetween in 0.1% increments, via the addition of the second component, without increasing the height of the external component from that which was the case prior to the increase, all other things being equal. In an exemplary embodiment, the teachings detailed herein are used without the additional module/with the ordinary external component 540, with skin flap thicknesses of less than 5, 6, 7, 8, 9, 10, 11, 12, 13, 14, or 15 mm and the additional module is used/the external component 540 is modified according to the teachings herein for skin values greater than one or more of those values, such as values that are 10%, 15%, 20%, 25%, 30%, 35%, 40%, 45%, 50%, 55%, 60%, 65%, 70%, 75% greater than the baseline skin flap thickness (one of the aforementioned thicknesses).

In an exemplary embodiment, a retention force is increased from about 400 mN to about 700 mN utilizing the second component, or from about 450 mN to about 680 mN, or from about 480 mN to about 680 nM. The increase can be from 200 mN to any value thereabove to about 1.5 mN or any range of values therebetween in 0.1 mN increments.

It is noted that any disclosure of a device and/or system herein corresponds to a disclosure of a method of utilizing such device and/or system. It is further noted that any disclosure of a device and/or system herein corresponds to a disclosure of a method of manufacturing such device and/or system. It is further noted that any disclosure of a method action detailed herein corresponds to a disclosure of a device and/or system for executing that method action/a device and/or system having such functionality corresponding to the method action. It is also noted that any disclosure of a functionality of a device herein corresponds to a method including a method action corresponding to such functionality. Also, any disclosure of any manufacturing methods detailed herein corresponds to a disclosure of a device and/or system resulting from such manufacturing methods and/or a disclosure of a method of utilizing the resulting device and/or system.

In an exemplary embodiment, there is an external component of a prosthesis, comprising: a first module including a functional component and first structure including magnetic material, wherein the first module is configured to be retained against skin of a recipient via a magnetic field at least partially generated by a permanent magnet implanted in a recipient that interacts with the magnetic material of the first structure, the first module including a skin interfacing surface configured to interact with skin of the recipient when the first module is retained against the skin of the recipient; and a second module including a second structure including magnetic material configured to enhance magnetic retention of the external component to skin of a recipient, wherein the second module is removably attached to the first module and visible from an outside of the external component when the second module is attached to the first module and when viewed from a side opposite the skin interfacing side. In an exemplary embodiment, there is an external component of a prosthesis as detailed above and/or below, wherein the first module includes a first permanent magnet and the second module includes a second permanent magnet, the second permanent magnet being a different configuration than the first permanent magnet. In an exemplary embodiment, there is an external component of a prosthesis as detailed above and/or below, wherein the second module includes a second permanent magnet being made at least in part of the magnetic material, wherein the external component is configured such that the second permanent magnet is misaligned with an implanted magnet when the external component interacts with the magnetic field of the implanted magnet.

In an exemplary embodiment, there is a button sound processor, comprising: a first component including a first permanent magnet; and a second component including magnetic material, wherein the second component is configured to direct a magnetic flux at least partially generated by the first permanent magnet differently from that which would exist in the absence of the second component via the soft magnetic material. In an exemplary embodiment, there is a button sound processor as described above and/or below, wherein the magnetic material is in the form of a structure extending outboard from the first permanent magnet. In an exemplary embodiment, there is a button sound processor as described above and/or below, wherein the soft magnetic plate is a cover of the external component facing away from a skin interfacing side of the external component. In an exemplary embodiment, there is a button sound processor as described above and/or below, wherein the second component includes a second permanent magnet; and the longitudinal axis of the button sound processor extends through the first permanent magnet and not the second permanent magnet.

In an exemplary embodiment, there is a body piece configured for transcutaneous communication with an implanted component implanted in a recipient, comprising: an inductance coil; a first permanent magnet; and a second permanent magnet, wherein the first permanent magnet has a north-south polarity that is parallel to a longitudinal axis of the body piece, the second permanent magnet has a north-south polarity at an oblique angle relative to the north-south polarity of the first permanent magnet, and the body piece is configured such that the second permanent magnet is readily removably connected at least indirectly to the first permanent magnet. In an exemplary embodiment, there is a body piece configured for transcutaneous communication with an implanted component implanted in a recipient as described above and/or below wherein the body piece includes a structure made up of soft magnetic material extending between the first permanent magnet and the second permanent magnet. In an exemplary embodiment, there is a body piece configured for transcutaneous communication with an implanted component implanted in a recipient as described above and/or below wherein the portion of the structure between the first permanent magnet and the second permanent magnet being angled relative to the longitudinal axis at an oblique angle. In an exemplary embodiment, there is a body piece configured for transcutaneous communication with an implanted component implanted in a recipient as described above and/or below wherein an angle between (i) the portion of the structure between the first permanent magnet and the second permanent magnet and (ii) the north-south axis of the second permanent magnet is oblique.

Unless otherwise specified or otherwise not enabled by the art, any one or more teachings detailed herein with respect to one embodiment can be combined with one or more teachings of any other teaching detailed herein with respect to other embodiments.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An apparatus, comprising:

a first component including a first permanent magnet; and a second component including a second permanent magnet, wherein the apparatus is part of a hearing prosthesis, and the apparatus is in signal communication with a sound processor of the hearing prosthesis, the second component is configured to direct a magnetic flux at least partially generated by the first permanent magnet differently from that which would exist in the absence of the second component via the second permanent magnet, the first permanent magnet has a North-South polarity axis, the second permanent magnet has a North-South polarity axis angled relative to the North-South polarity axis of the first permanent magnet, and the first permanent magnet has a face that faces a face of the second magnet facing the first permanent magnet, wherein the faces of the first permanent magnet and the second magnet are flat and parallel to each other.

2. The apparatus of claim 1, wherein:

the apparatus includes a skin interface surface.

3. The apparatus of claim 1, wherein:

the second component extends about a majority of the first component.

4. The apparatus of claim 1, wherein:

the apparatus is an apparatus of a cochlear implant.

5. The apparatus of claim 1, wherein:

with respect to respective cross-sections of the first permanent magnet and the second permanent magnet lying on a plane on a longitudinal axis of the apparatus, the outer shapes of the respective cross-sections are relative to one another.

6. The apparatus of claim 1, wherein:

the second permanent magnet is a ring magnet that encircles the first permanent magnet; and a cross-section of the apparatus lying on a plane lying on a longitudinal axis of the apparatus is such that the north-south pole of the second permanent magnet lies in the plane of the cross-section.

7. The apparatus of claim 1, wherein:

the apparatus includes a first housing directly or indirectly supporting the first permanent magnet; and the apparatus includes a second housing directly or indirectly supporting the second permanent magnet; and the second housing is readily removably connected to the first housing at an outside thereof.

8. The apparatus of claim 1, wherein:

the second permanent magnet is a ring magnet that encircles the first permanent magnet; and a cross-section of the apparatus lying on a plane lying on a longitudinal axis of the apparatus is such that the north-south pole of the second permanent magnet has an equal and opposite angle on either side of the longitudinal axis relative to a longitudinal axis of the apparatus.

9. The apparatus of claim 1, wherein:

the apparatus is an apparatus of an active transcutaneous bone conduction device.

10. The apparatus of claim 1, wherein:

an angle between (i) a portion of a structure between the first permanent magnet and the second permanent magnet of the second component and (ii) the north-south axis of the second permanent magnet is oblique.

11. The apparatus of claim 1, wherein:

the North-South polarity axis of the first permanent magnet is obliquely angled relative to the longitudinal axis of the apparatus;

the North-South polarity axis of the second magnet is obliquely angled relative to the longitudinal axis of the apparatus; and the first permanent magnet is spaced apart from the second magnet in a direction normal to the longitudinal axis of the apparatus.

12. The apparatus of claim 1, wherein:

the first permanent magnet is spaced apart from the second magnet in a direction normal to a longitudinal axis of the apparatus; and the apparatus is a button sound processor.

13. The apparatus of claim 12, wherein:

the apparatus includes a transcutaneous RF communication inductance coil of the hearing prosthesis in signal communication with the sound processor.

14. The apparatus of claim 1, wherein:

a magnetic flux generated by the first permanent magnet and the second magnet has a flow extending from at least a longitudinal axis of an assembly including the first and second magnets to at least one of the first or second magnets, the flow being normal to the longitudinal axis of the assembly, wherein the first permanent magnet is on a first side of the longitudinal axis and the second magnet is on a second side of the longitudinal axis, the second side being on an opposite side of the longitudinal axis relative to the first side.

15. The apparatus of claim 1, wherein:

the angular relation between the respective North-South polarity axes results in an increase in a retention force with a magnet of another apparatus of the hearing prosthesis by at least 15% relative to that which would be the case in the absence of the angular relation.

16. The apparatus of claim 1, wherein:

the angular relation between the respective North-South polarity axes results in an increase in a retention force with a magnet of another apparatus of the hearing prosthesis by at least 20% relative to that which would be the case in the absence of the angular relation.

17. The apparatus of claim 1, wherein:

the angular relation between the respective North-South polarity axes results in an increase in a retention force with a magnet of another apparatus of the hearing prosthesis by at least 25% relative to that which would be the case in the absence of the angular relation.

18. The apparatus of claim 1, wherein:

the angular relation between the respective North-South polarity axes results in an increase in a retention force with a magnet of another apparatus of the hearing prosthesis by at least 30% relative to that which would be the case in the absence of the angular relation.

19. The apparatus of claim 1, wherein:

the North-South polarity axis of the first permanent magnet is obliquely angled relative to a longitudinal axis of the apparatus; and the North-South polarity axis of the second magnet is obliquely angled relative to the longitudinal axis of the apparatus.

20. The apparatus of claim 1, wherein:

the angular relation between the respective North-South polarity axes results in an increase in a retention force with a magnet of another apparatus of the hearing prosthesis by at least 10% relative to that which would be the case in the absence of the angular relation.

21. The apparatus of claim 1, wherein:

the apparatus is a transcutaneous RF communication sub-component of the hearing prosthesis.

22. An apparatus, comprising:

a first permanent magnet portion; and a second permanent magnet portion, the second permanent magnet portion being part of a same assembly as the first permanent magnet portion, wherein the apparatus is an apparatus of a transcutaneous RF communication sub-portion of a hearing prosthesis, the RF communication sub-portion is in signal communication with a sound processor of the hearing prosthesis, the second portion is configured to direct a magnetic flux at least partially generated by the first permanent magnet portion differently from that which would exist in the absence of the second portion via the second permanent magnet portion, the first permanent magnet portion has a North-South polarity axis, the second permanent magnet portion has a North-South polarity axis angled relative to the North-South polarity axis of the first permanent magnet portion, and the first permanent magnet portion has a face that faces a face of the second permanent magnet portion facing the first permanent magnet portion, wherein the faces of the first permanent magnet portion and the second permanent magnet portion are flat and parallel to each other.

23. The apparatus of claim 22, wherein:

the apparatus is an apparatus of a cochlear implant.

24. The apparatus of claim 22, wherein:
with respect to respective cross-sections of the first permanent magnet portion and the second permanent magnet portion lying on a plane on a longitudinal axis of the apparatus, the outer shapes of the respective cross-sections are different relative to one another.

25. The apparatus of claim 22, wherein:
apparatus is an apparatus of an active transcutaneous bone conduction device.

26. The apparatus of claim 22, wherein:
an angle between (i) a portion of a structure between the first permanent magnet portion and the second permanent magnet portion of the second component and (ii) the north-south axis of the second permanent magnet is oblique.

27. The apparatus of claim 22, wherein:
the first permanent magnet portion is spaced apart from the second permanent magnet portion in a direction normal to a longitudinal axis of the apparatus.

28. The apparatus of claim 22, wherein:
the North-South polarity axis of the first permanent magnet portion is obliquely angled relative to a longitudinal axis of the apparatus;
the North-South polarity axis of the second permanent magnet portion is obliquely angled relative to the longitudinal axis of the apparatus; and
the first permanent magnet portion is spaced apart from the second permanent magnet portion in a direction normal to the longitudinal axis of the apparatus.

29. The apparatus of claim 22, wherein:
a magnetic flux generated by the first permanent magnet portion and the second permanent magnet portion has a flow extending from at least a longitudinal axis of the assembly to at least one of the first or second permanent magnet portions, the flow being normal to the longitudinal axis of the assembly, wherein the first permanent magnet portion is on a first side of the longitudinal axis and the second permanent magnet portion is on a second side of the longitudinal axis, the second side being on an opposite side of the longitudinal axis relative to the first side.

30. The apparatus of claim 22, wherein:
the angular relation between the respective North-South polarity axes results in an increase in a retention force with a magnet of another apparatus of the hearing prosthesis by at least 15% relative to that which would be the case in the absence of the angular relation.

31. The apparatus of claim 22, wherein:
the angular relation between the respective North-South polarity axes results in an increase in a retention force with a magnet of another apparatus of the hearing prosthesis by at least 20% relative to that which would be the case in the absence of the angular relation.

32. The apparatus of claim 22, wherein:
the angular relation between the respective North-South polarity axes results in an increase in a retention force with a magnet of another apparatus of the hearing prosthesis by at least 25% relative to that which would be the case in the absence of the angular relation.

33. The apparatus of claim 22, wherein:
the angular relation between the respective North-South polarity axes results in an increase in a retention force with a magnet of another apparatus of the hearing prosthesis by at least 30% relative to that which would be the case in the absence of the angular relation.

34. The apparatus of claim 22, wherein:
the North-South polarity axis of the first permanent magnet portion is obliquely angled relative to a longitudinal axis of the apparatus; and
the North-South polarity axis of the second magnet portion is obliquely angled relative to the longitudinal axis of the apparatus.

35. The apparatus of claim 22, wherein:
the angular relation between the respective North-South polarity axes results in an increase in a retention force with a magnet of another apparatus of the hearing prosthesis by at least 10% relative to that which would be the case in the absence of the angular relation.

36. An apparatus, comprising:
a first component including a first permanent magnet; and
a second component including a second permanent magnet, wherein
the apparatus is part of a hearing prosthesis, and the apparatus is in signal communication with a sound processor of the hearing prosthesis,
the second component is configured to direct a magnetic flux at least partially generated by the first permanent magnet differently from that which would exist in the absence of the second component via the second permanent magnet,
the first permanent magnet has a North-South polarity axis,
the second permanent magnet has a North-South polarity axis,
the North-South polarity axis of the first permanent magnet is obliquely angled relative to a longitudinal axis of the apparatus,
the North-South polarity axis of the second permanent magnet is obliquely angled relative to the longitudinal axis of the apparatus, and
the obliquely angled polarity axes are angularly fixed relative to one another and increase a retention force with another magnet of another apparatus of the hearing prosthesis separated by skin by at least 10% relative to that which would be the case in the absence of the oblique angling.

37. The apparatus of claim 36, wherein:
the obliquely angled polarity axes increase a retention force with the another magnet by at least 15% relative to that which would be the case in the absence of the oblique angling.

38. The apparatus of claim 36, wherein:
the obliquely angled polarity axes increase a retention force with the another magnet by at least 20% relative to that which would be the case in the absence of the oblique angling.

39. The apparatus of claim 36, wherein:
the obliquely angled polarity axes increase a retention force with the another magnet by at least 30% relative to that which would be the case in the absence of the oblique angling.

40. The apparatus of claim 36, wherein:
the apparatus is a button sound processor.

41. The apparatus of claim 40, wherein:
the apparatus includes a transcutaneous RF communication inductance coil of the hearing prosthesis in signal communication with the sound processor.

42. The apparatus of claim 36, wherein:
the first permanent magnet is spaced apart from the second magnet in a direction normal to a longitudinal axis of the apparatus.

43. The apparatus of claim 36, wherein:

a magnetic flux generated by the first permanent magnet and the second magnet has a flow extending from at least a longitudinal axis of an assembly including the first and second magnets to at least one of the first or second magnets, the flow being normal to the longitudinal axis of the assembly, wherein the first permanent magnet is on a first side of the longitudinal axis and the second magnet is on a second side of the longitudinal axis, the second side being on an opposite side of the longitudinal axis relative to the first side.

44. The apparatus of claim 36, wherein:

the first permanent magnet has a face that faces a face of the second magnet facing the first permanent magnet, wherein the faces of the first permanent magnet and the second magnet are flat and parallel to each other.

* * * * *